US012303007B2

(12) United States Patent
McGuire et al.

(10) Patent No.: US 12,303,007 B2
(45) **Date of Patent: *May 20, 2025**

(54) ROLLING COLLAPSIBLE TRAVEL LUGGAGE

(71) Applicant: KARSTEN MANUFACTURING CORPORATION, Phoenix, AZ (US)

(72) Inventors: Brian J. McGuire, Phoenix, AZ (US); Ryan J. Bruce, Phoenix, AZ (US); James D. Martell, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 92 days.

This patent is subject to a terminal disclaimer.

(21) Appl. No.: 18/066,098

(22) Filed: Dec. 14, 2022

(65) Prior Publication Data

US 2023/0109765 A1 Apr. 13, 2023

Related U.S. Application Data

(63) Continuation-in-part of application No. 17/835,842, filed on Jun. 8, 2022, now Pat. No. 11,910,899, which
(Continued)

(51) Int. Cl.
*A45C 7/00* (2006.01)
*A45C 5/14* (2006.01)
(Continued)

(52) U.S. Cl.
CPC ..... *A45C 7/0036* (2013.01); *A45C 5/14* (2013.01); *A45C 13/002* (2013.01); *A45C 13/103* (2013.01)

(58) Field of Classification Search
CPC ..... A45C 7/0036; A45C 5/14; A45C 13/002; A45C 13/103
See application file for complete search history.

(56) References Cited

U.S. PATENT DOCUMENTS 385,138 A 6/1888 Reinisch
3,139,164 A 6/1964 Sol
(Continued)

FOREIGN PATENT DOCUMENTS

CN 2562627 7/2003
EP 2594152 7/2014
(Continued)

OTHER PUBLICATIONS

GB Search Report dated Jul. 12, 2013 received for related patent Appl. No. GB 1302326.2.
(Continued)

*Primary Examiner* — Tri M Mai

(57) ABSTRACT

A rolling luggage bag includes a cover fixedly coupled to a base, the base including a first side opposite a second side and a bottom face extending there between, wherein the cover comprises a plurality of panels, arranged in a direction away from the base, wherein the plurality of panels defines an interior chamber, a first wheel and a second wheel coupled to the base, the first and second wheels configured to rotate about an axis of rotation and separated by a first distance along the axis of rotation, at least a portion of each of the first and second wheels projecting from the first side and from the bottom face, and a third wheel and a fourth wheel coupled to the bottom face, the third and fourth wheels configured to independently swivel about a respective swivel axis and separated by a second distance extending between the swivel axes. When the rolling luggage is in an upright position, the first, second, third, and fourth wheels all contact a surface the luggage bag stands on.

20 Claims, 26 Drawing Sheets

Related U.S. Application Data is a continuation of application No. 16/439,542, filed on Jun. 12, 2019, now Pat. No. 11,388,965, which is a continuation-in-part of application No. 16/163,371, filed on Oct. 17, 2018, now Pat. No. 11,178,948, which is a continuation of application No. 15/000,280, filed on Jan. 19, 2016, now Pat. No. 10,159,318.

(60) Provisional application No. 62/684,133, filed on Jun. 12, 2018, provisional application No. 62/189,598, filed on Jul. 7, 2015, provisional application No. 62/105,636, filed on Jan. 20, 2015.

(51) Int. Cl.
*A45C 13/00* (2006.01)
*A45C 13/10* (2006.01)

(56) References Cited

U.S. PATENT DOCUMENTS

| | | | | |
|---|---|---|---|---|
| 3,316,951 | A * | 5/1967 | Jacobson | A63B 55/406 206/315.3 |
| 3,935,931 | A | 2/1976 | Kaplan | |
| 4,063,581 | A | 12/1977 | Williams | |
| 4,629,040 | A | 12/1986 | Jones | |
| 4,674,747 | A | 6/1987 | Mazzocco | |
| 4,679,670 | A | 7/1987 | Wickman | |
| 4,813,520 | A | 3/1989 | Lin | |
| 5,265,894 | A | 11/1993 | Dunn | |
| 5,288,003 | A | 2/1994 | MacDonald | |
| 5,289,906 | A | 3/1994 | Guidi | |
| 5,515,897 | A | 5/1996 | Fehan | |
| 5,551,561 | A | 9/1996 | MacRae | |
| 5,660,476 | A | 8/1997 | DeCoster | |
| 5,676,295 | A | 10/1997 | Gelb | |
| 5,975,170 | A | 11/1999 | Anguiano | |
| 6,179,101 | B1 | 1/2001 | Lin | |
| 6,315,115 | B1 | 11/2001 | Bradshaw | |
| 6,401,890 | B1 | 6/2002 | Tan | |
| 6,439,585 | B1 | 8/2002 | Tan | |
| 6,443,274 | B1 | 9/2002 | Klamm | |
| 6,520,327 | B1 | 2/2003 | Boardman | |
| 6,533,086 | B1 | 3/2003 | Waddell | |
| 6,557,702 | B1 | 5/2003 | Sanderson | |
| 6,679,358 | B2 | 1/2004 | Be | |
| 6,892,773 | B1 | 5/2005 | Wenzler | |
| 6,901,979 | B1 | 6/2005 | Herold | |
| 6,926,129 | B2 | 8/2005 | Hoberman | |
| 7,134,548 | B2 | 11/2006 | Meehan | |
| 7,143,912 | B2 | 12/2006 | Caneba | |
| 7,232,018 | B1 | 6/2007 | Salander | |
| 7,424,950 | B2 | 9/2008 | Burgess | |
| 7,434,683 | B1 | 10/2008 | Harper | |
| 7,458,451 | B2 | 12/2008 | Godshaw | |
| 7,500,547 | B2 | 3/2009 | Bettua | |
| 7,617,797 | B2 | 11/2009 | Lam | |
| 7,780,355 | B2 | 8/2010 | Malloy | |
| 7,849,984 | B2 | 12/2010 | Whalen | |
| 7,975,816 | B1 | 7/2011 | Lin | |
| 8,157,068 | B2 | 4/2012 | Sapyta | |
| 9,332,817 | B2 | 5/2016 | Salek | |
| 9,420,859 | B2 * | 8/2016 | Bourette | A45C 7/0068 |
| 9,681,717 | B2 | 6/2017 | Meersschaert | |
| 9,999,284 | B1 | 6/2018 | Tan | |
| 10,159,318 | B2 * | 12/2018 | McGuire | A45C 7/0036 |
| 10,219,601 | B2 | 3/2019 | Selvi | |
| 10,327,523 | B2 | 6/2019 | Liang | |
| 11,178,948 | B2 * | 11/2021 | McGuire | A45C 7/0036 |
| 11,388,965 | B2 * | 7/2022 | McGuire | A45C 7/0036 |
| 11,910,899 | B2 * | 2/2024 | McGuire | A45C 7/0036 |
| 11,930,905 | B2 * | 3/2024 | McGuire | A45C 5/14 |
| 2001/0023835 | A1 | 9/2001 | Besnard | |
| 2002/0190490 | A1 | 12/2002 | Yang | |
| 2004/0134811 | A1 * | 7/2004 | Lai | A63B 55/00 206/315.3 |
| 2005/0034947 | A1 | 2/2005 | Nykoluk | |
| 2005/0284718 | A1 | 12/2005 | Tai | |
| 2009/0255770 | A1 | 10/2009 | Slater | |
| 2011/0083933 | A1 | 4/2011 | Engel | |
| 2013/0334081 | A1 | 12/2013 | Loudenslager | |
| 2015/0053520 | A1 | 2/2015 | Findlay | |
| 2020/0253345 | A1 * | 8/2020 | Thorn | A45C 13/262 |

FOREIGN PATENT DOCUMENTS

| | | |
|---|---|---|
| FR | 2906690 | 4/2008 |
| WO | 2006097960 | 9/2006 |

OTHER PUBLICATIONS

UKIPO First and Second Search Reports for GB 1601026.6, dated Mar. 17, 2016 and Apr. 18, 2016.

International Search Report and Written Opinion of the International Searching Authority for PCT/US22/81570, dated Mar. 21, 2023.

* cited by examiner

ROLLING COLLAPSIBLE TRAVEL LUGGAGE

CROSS-REFERENCE TO RELATED APPLICATIONS

This is a continuation in part of U.S. Non-Provisional application Ser. No. 17/835,842, filed on Jun. 8, 2022, which is a continuation of U.S. Non-Provisional application Ser. No. 16/439,542, filed on Jun. 12, 2019, which is a continuation in part of U.S. Non-Provisional application Ser. No. 16/163,371, filed on Oct. 17, 2018, which is a continuation of U.S. Non-Provisional application Ser. No. 15/000,280, filed on Jan. 19, 2016, which claims priority to U.S. Provisional Patent Application No. 62/105,636, filed on Jan. 20, 2015, and U.S. Provisional Patent Application No. 62/189,598, filed on Jul. 7, 2015. U.S. Non-Provisional application Ser. No. 16/439,542 further claims priority to U.S. Provisional Patent Application No. 62/684,133, filed on Jun. 12, 2018, all of which are incorporated by reference herein in their entirety.

FIELD OF THE INVENTION

The present disclosure relates to rolling collapsible travel luggage, and more specifically to wheeled travel luggage that is easier to transport when in use, which is collapsible to provide a smaller storage footprint when not in use, and that has an expanded access opening to more easily place and position contents into the luggage.

BACKGROUND

Rolling travel luggage is generally known in the art. However, known rolling travel luggage has certain limitations. For example, existing luggage typically includes three or more swivel caster wheels that allow the luggage to roll in any direction while in an upright position. While convenient, the luggage is susceptible to movement in unintended directions as the only wheels that engage the ground or floor are the swivel caster wheels, with nothing to stop unintended rotation or rolling of these wheels.

As another limitation, existing luggage typically defines an internal chamber by rigid or relatively inflexible side, back and/or front portions. For example, the front side may open away from the remaining rigid sides to provide an access opening to the internal chamber. While the rigid sides provide protection for the contents inside, they inhibit insertion of a large or otherwise bulky object, such as a golf bag containing a set of golf clubs. To place the large or bulky object into the internal chamber, a user must feed the object into the access opening at an oblique or other awkward angle to the luggage. And during insertion, the user may be required to constantly change the angle between the object and luggage to avoid contact with the rigid sides until the object is received in the internal chamber. The constant angle change can be cumbersome, difficult, and awkward for a user.

As yet another limitation, some types of existing luggage include side wheels and a handle provided at a top portion of the luggage. A user grasps the handle, tilts the luggage to engage the side wheels with the ground, and is free to roll the luggage in the tilted position. The majority of the luggage load, however, is transferred to the user through the top handle, leading to strain on the arm, wrist, and/or forearm of the user.

SUMMARY OF THE INVENTION

A rolling luggage bag includes a cover coupled to a base, the base including a first side opposite a second side and a bottom face extending there between, a first wheel and a second wheel coupled to the base, the first and second wheels configured to rotate about an axis of rotation and separated by a first distance along the axis of rotation, at least a portion of each of the first and second wheels projecting from the first side and from the bottom face, and a third wheel and a fourth wheel coupled to the bottom face, the third and fourth wheels configured to independently swivel about a respective swivel axis and separated by a second distance extending between the swivel axes. When the rolling luggage is in an upright position, the first, second, third, and fourth wheels all contact a surface the luggage bag stands on.

In other embodiments, the collapsible luggage bag can include a back portion connected to a first side portion and a second side portion, a front flap removably connected to the first side portion, the second side portion, and the back portion by a connection member, and a base connected to the back portion, the front flap, and optionally removable from the first side portion, and the second side portion. The first and second side portions pivot away from each other about respective folds between the respective side portion and the back portion when the front flap is removed.

Other features and aspects will become apparent by consideration of the following detailed description and accompanying drawings.

Figure 1:
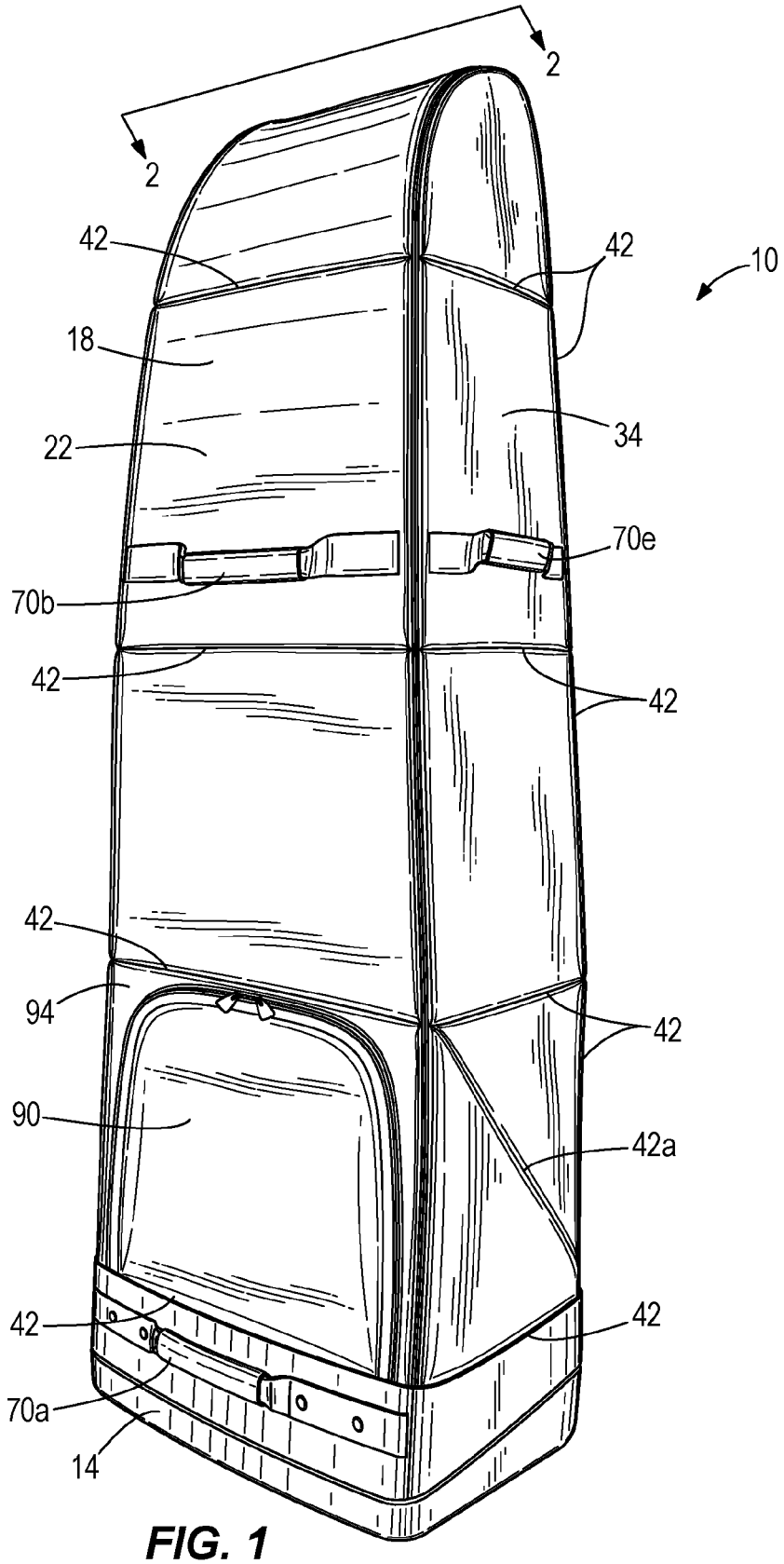
FIG. 1 is a perspective view of a rolling collapsible travel luggage bag in an upright position.

Before any embodiments of the disclosure are explained in detail, it should be understood that the disclosure is not limited in its application to the details or construction and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

DETAILED DESCRIPTION

For ease of discussion and understanding, and for purposes of description only, the following detailed description illustrates a rolling luggage bag 10 as an elongated luggage bag suitable for transporting large items, such as a golf bag, golf clubs, and one or more golf accessories. The golf bag is of a size suitable to carry a plurality of full length golf clubs, for example a set of golf clubs that includes a combination of one or more of a driver, a wood, a hybrid, an iron, a wedge, and/or a putter. A full length golf club is not collapsible, and has a length of approximately 32 inches to approximately 49 inches, depending on the club. An example of a large golf accessory includes a full length golf umbrella, which has a length of approximately 36 inches to approximately 48 inches, and opens to an arc or canopy size of approximately 50 inches to 68 or more inches. It should be appreciated that the elongated luggage bag is provided for purposes of illustration and aspects of the luggage bag 10 disclosed herein may be incorporated into luggage of any size, shape, or orientation.

FIG. 1 illustrates a rolling luggage bag 10. The luggage bag 10 includes a base 14 connected to a cover 18. As illustrated in FIGS. 2-6, the cover 18 includes a front portion 22 (or front flap), a back portion 26 or (back flap), a first side portion 30 (flap 30), and a second side portion 34 (or flap). The front portion 22 is oriented opposite the back portion 26, and the first side portion 30 is oriented opposite the second side portion 34. In addition, the back portion 26 is connected or otherwise integrally formed as one piece with the first and second side portions 30, 34. The front portion 22 may have a selectively removable connection to the back, first side, and second side portions 26, 30, 34 to open or provide access to the interior chamber of the luggage bag 10. The selective removable connection between the front portion 22 and back, first side, and second side portions 26, 30, 34 may provide different degrees or amounts of access to the interior chamber of the luggage bag 10. Stated otherwise, the removable connection may provide an opening or partial opening to the interior chamber. For example, the selectively removable connection may be formed by a zipper having a pair of sliders 100*a*, 100*b* that meet in a closed position at the top or end of the luggage bag 10 opposite the base 14 (see FIGS. 4A-B). The sliders 100*a*, 100*b* may be moved along the zipper in opposite directions along a portion of the zipper to provide partial access to the interior chamber, such as a first standing access position shown in FIG. 8, or entirely along the zipper to provide maximum access to the interior chamber, such as a second access position shown in FIG. 9.

Figure 16:
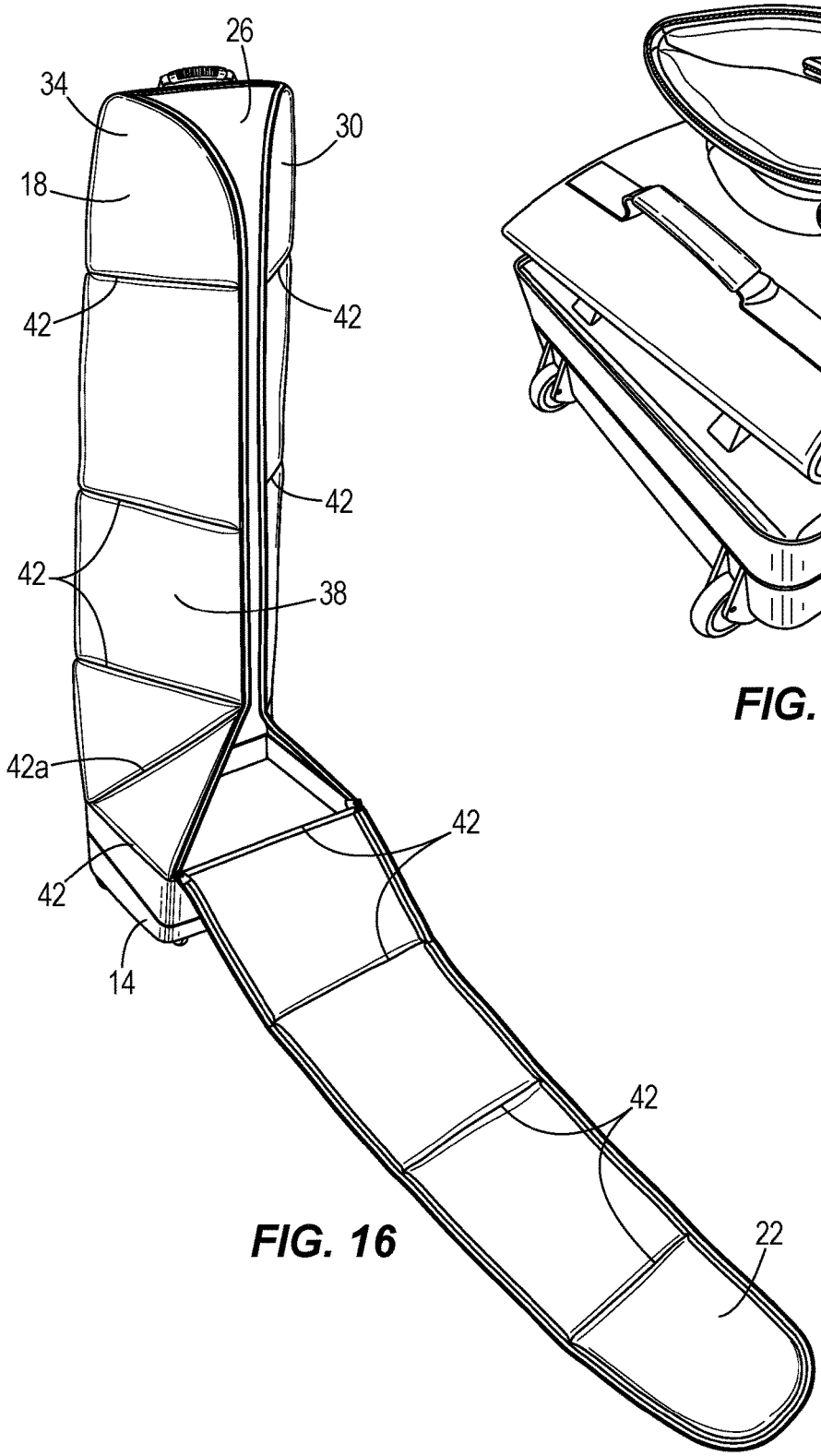
FIG. 16 is a perspective view of the rolling collapsible travel luggage bag of FIG. 1 in the upright position with the front flap disengaged from a first side portion, a second side portion, and a back portion.

The front, back, first side, and second side portions 22, 26, 30, 34 are each formed of a plurality of panels interconnected by an outer shell 38 (see FIG. 16). In most embodiments, the outer shell 38 is formed of a cloth or other fabric. For example, the fabric may be polyester, nylon, canvas, denim, or any other fabric material suitable for use in a luggage type application. In each of the portions 22, 26, 30, 34, the outer shell 38 includes stitching to seal the outer shell 38 and to define a plurality of pockets, each of which receives a respective panel. Between adjacent pockets in each portion 22, 26, 30, 34 are folds 42 (see FIGS. 1-9, and 16). To form the folds 42, stitching is provided at desired fold locations on the outer shell 38 of each portion 22, 26, 30, 34. In other embodiments, the folds 42 may be formed in any other suitable or desired manner to facilitate folding of each portion 22, 26, 30, 34. The folds 42 are not only provided between adjacent or consecutive panels in each portion 22, 26, 30, 34, but are generally provided between adjacent or consecutive panels between portions 26, 30, 34.

Referring to FIGS. 7A-7D, each portion 22, 26, 30, 34 is shown with the outer shell 38 removed and illustrating the plurality of panels 46. In most embodiments, each panel 46 is formed of a polyethylene board material $[(C_2H_2)_nH_2]$, a foam material, a cloth material, or a combination thereof. The polyethylene board material may be any industry standard grade, including, but not limited to, ultra-high molecular weight polyethylene (UHMWPE), ultra-low molecular weight polyethylene (ULMWPE), high molecular weight polyethylene (HMWPE), high-density polyethylene (HDPE), high-density cross-linked polyethylene (HDXLPE), cross-linked polyethylene (PEX), medium-density polyethylene (MDPE), linear low-density polyethylene (LLDPE), low-density polyethylene (LDPE), very-low density polyethylene (VLDPE), and chlorinated polyethylene (CPE). In other embodiments, the panels 46 may be formed of polyurethane, acrylonitrile butadiene styrene, combinations thereof, or any other suitable material.

The panels 46 of each portion 22, 26, 30, 34 are arranged in panel zones, panel rings, or bands that are horizontally stacked or arranged in a direction away from the base 14. The panel zones 50 generally extend around a circumference of the luggage bag 10. Depending on the panel zone 50 and location along portions 22, 26, 30, 34, any panel 46 may be formed of a different material (e.g., a foam material, a board material, or a combination of foam and board material), may have a different panel thickness, and/or a different panel stiffness or rigidity.

A first or bottom panel zone 50*a* is located along a base of each portion 22, 26, 30, 34 and has a first panel height or length $H_1$, measured vertically (orthogonal to a ground plane) when the luggage bag 10 is in an upright position. In some embodiments, the first panel height $H_1$ is less than approximately 15 cm. The first panel height $H_1$ can be approximately 5.0 cm, 5.5 cm, 6.0 cm, 6.5 cm, 7.0 cm, 7.5 cm, 8.0 cm, 8.5 cm, 9.0 cm, 9.5 cm, 10.0 cm, 10.5 cm, 11.0 cm, 11.5 cm, 12 cm, 12.5 cm, 13.0 cm, 13.5 cm, 14.0 cm, 14.5 cm, or 15.0 cm. In one exemplary embodiment, first panel height $H_1$ is approximately 6.5 cm. In other embodiments, the first panel height $H_1$ can be less than 6.5 cm, 6.4 cm, 6.3 cm, 6.2 cm, 6.1 cm, or 6.0 cm based on the size, shape, or orientation of the luggage bag 10. In other embodiments, the first panel height $H_1$ can be greater than 6.5 cm, 6.6 cm, 6.7 cm, 6.8 cm, 6.9 cm, or 7.0 cm based on the size, shape, or orientation of the luggage bag 10. The first panel zone 50*a* includes panels 46*a* formed of a stiff board material having a thickness of approximately 1.75 mm. In some embodiments, the panels 46*a* of the first panel zone 50*a* are rectangular in shape, however in other embodiments may be any suitable or desired shape or combination of shapes. For example, the panels 46*a* of the first panel zone 50*a* may be sloped or have a narrowing height $H_1$ (see FIG. 3) to conform to the base 14. The panels 46*a* of the first panel zone 50*a* engage or otherwise connect to the base 14 (see FIG. 3).

Figure 8:
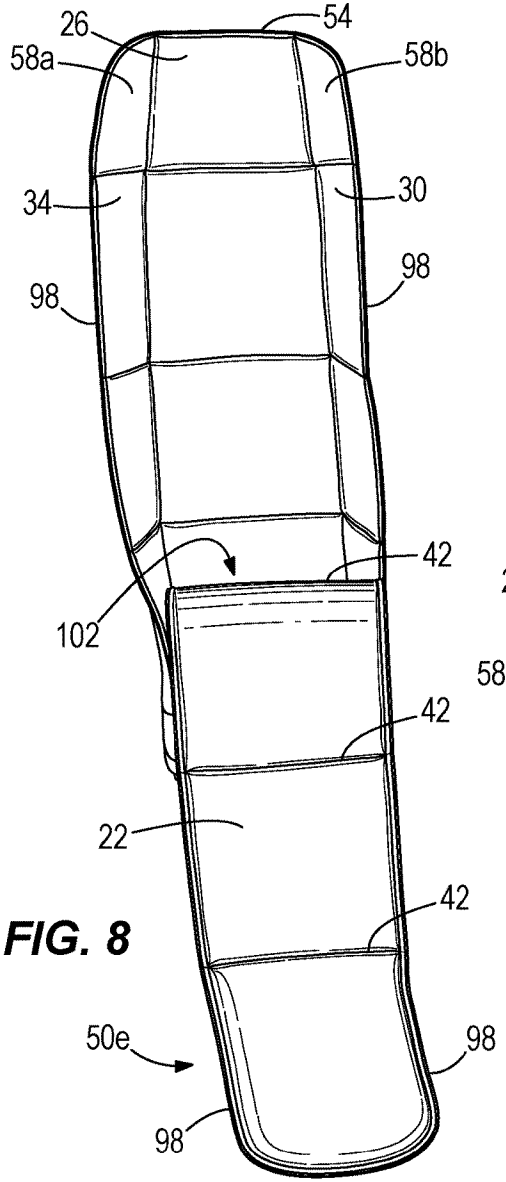
FIG. 8 is a perspective view of the rolling collapsible travel luggage bag of FIG. 1 in the upright position with the front flap partially disengaged to provide access to an interior chamber.

Positioned adjacent the first panel zone 50*a* in a direction away from base 14 is a second panel zone 50*b* along each portion 22, 26, 30, 34. The second panel zone 50*b* has a second panel height or length $H_2$, measured vertically (orthogonal to a ground plane) when the luggage bag 10 is in an upright position. In some embodiments, the height $H_2$ can be less than 50 cm. In some embodiments, the second panel height or length $H_2$ can be 20 cm, 21 cm, 22 cm, 23 cm, 24 cm, 25 cm, 26 cm, 27 cm, 28 cm, 29 cm, 30 cm, 31 cm, 32 cm, 33 cm, 34 cm, 35 cm, 36 cm, 37 cm, 38 cm, 39 cm, 40 cm, 41 cm, 42 cm, 43 cm, 44 cm, 45 cm, 46 cm, 47 cm, 48 cm, 49 cm, or 50 cm. In one exemplary embodiment, the second panel height $H_2$ is approximately 30 cm. In other embodiments, the second panel height $H_2$ can be less than 30 cm, 29 cm, 28 cm, 27 cm, 26 cm, or 25 cm based on the size, shape, or orientation of the luggage bag 10. In other embodiments, the second panel height $H_2$ can be greater than 30 cm, 31 cm, 32 cm, 33 cm, 34 cm, or 35 cm based on the size, shape, or orientation of the luggage bag 10. The front portion 22 of the second panel zone 50*b* includes a panel 46*b*. The back, first side, and second side portions 26, 30, 34 of the second panel zone 50*b* include panels 46*b* formed of a relatively stiff board material combined with foam. In many embodiments, the stiff board material has a thickness of approximately 2.5 mm. The positioning of the panels 46*b* near or approximate the base 14 provides structural support for the back, first side, and second side portions 26, 30, 34 while the luggage bag 10 is in the upright position, as illustrated in FIG. 8.

In some embodiments, the panels of the second panel zone 50*b* in the front and back portions 22, 26 have a generally rectangular shape while the panels in the first side and second side portions 30, 34 have a generally square shape; however, this square shape is defined by two separate triangular panels having an angled fold 42*a* there between, which facilitates collapsibility of the cover 18 (discussed in more detail below). In some embodiments, the panels in the first side and second side portions 30, 34 have a generally trapezoidal shape. In other embodiments, the panels of the second panel zone 50*b* may be any suitable or desired shape or combination of shapes.

Adjacent the second panel zone 50*b* in a direction away from base 14 is a third panel zone 50*c* along each portion 22, 26, 30, 34. The third panel zone 50*c* has a third panel height or length $H_3$, measured vertically (orthogonal to a ground plane) when the luggage bag 10 is in an upright position. In some embodiments, the third panel height or length $H_3$ can be 20 cm, 21 cm, 22 cm, 23 cm, 24 cm, 25 cm, 26 cm, 27 cm, 28 cm, 29 cm, 30 cm, 31 cm, 32 cm, 33 cm, 34 cm, 35 cm, 36 cm, 37 cm, 38 cm, 39 cm, or 40 cm. In one exemplary embodiment, the third panel height $H_3$ is approximately 32 cm. In other embodiments, the third panel height $H_3$ can be less than 30 cm, 29 cm, 28 cm, 27 cm, 26 cm, or 25 cm based on the size, shape, or orientation of the luggage bag 10. In other embodiments, the third panel height $H_3$ can be greater than 30 cm, 31 cm, 32 cm, 33 cm, 34 cm, or 35 cm based on the size, shape, or orientation of the luggage bag 10. The front portion 22 and side portions 30, 34 of the third panel zone 50*c* each include a panel 46*c* formed of a relatively stiff board material combined with foam. In many embodiments, the stiff board material has a thickness of approximately 1.0 mm. The back portion 26 of the third panel zone 50*c* includes a panel 46*a* as previously described. In some embodiments, the panels of the third panel zone 50*c* in the front, back, first side, and second side portions 22, 26, 30, 34 have a generally trapezoidal shape. In other embodiments, the panels of the third panel zone 50*c* in the front, back, first side, and second side portions 22, 26, 30, 34 have a generally rectangular shape. In other embodiments, the panels of the third panel zone 50*c* may be any suitable or desired shape or combination of shapes.

A fourth panel zone 50*d* is adjacent the third panel zone 50*c* in a direction away from base 14 along each portion 22, 26, 30, 34, and has a fourth panel height or length $H_4$, measured vertically (orthogonal to a ground plane) when the luggage bag 10 is in an upright position. In some embodiments, the fourth panel height or length $H_4$ can be 20 cm, 21 cm, 22 cm, 23 cm, 24 cm, 25 cm, 26 cm, 27 cm, 28 cm, 29 cm, 30 cm, 31 cm, 32 cm, 33 cm, 34 cm, 35 cm, 36 cm, 37 cm, 38 cm, 39 cm, or 40 cm. In one exemplary embodiment, the fourth panel height $H_4$ is approximately 32 cm. In other embodiments, the fourth panel height $H_4$ can be less than 30 cm, 29 cm, 28 cm, 27 cm, 26 cm, or 25 cm based on the size, shape, or orientation of the luggage bag 10. In other embodiments, the fourth panel height $H_4$ can be greater than 30 cm, 31 cm, 32 cm, 33 cm, 34 cm, or 35 cm based on the size, shape, or orientation of the luggage bag 10. In many embodiments, the fourth panel zone 50*d* is substantially the same as the third panel zone 50*c* with regard to panel type, positioning, and shape.

At the top of each portion 22, 26, 30, 34 furthest from the base 14 is a fifth panel zone or top panel zone 50*e*. The back, first side, and second side portions 26, 30, 34 of the top panel zone 50*e* have a fifth panel height or length $H_5$, measured vertically (orthogonal to a ground plane) when the luggage bag 10 is in an upright position. In some embodiments, the fifth panel height or length $H_5$ can be 10 cm, 11 cm, 12 cm, 13 cm, 14 cm, 15 cm, 16 cm, 17 cm, 18 cm, 19 cm, 20 cm, 21 cm, 22 cm, 23 cm, 24 cm, 25 cm, 26 cm, 27 cm, 28 cm, 29 cm, or 30 cm. In one exemplary embodiment, the fifth panel height $H_5$ is approximately 20 cm. In other embodiments, the fifth panel height $H_5$ can be less than 30 cm, 29 cm, 28 cm, 27 cm, 26 cm, or 25 cm based on the size, shape, or orientation of the luggage bag 10. In other embodiments, the fifth panel height $H_5$ can be greater than 20 cm, 21 cm, 22 cm, 23 cm, 24 cm, or 25 cm based on the size, shape, or orientation of the luggage bag 10. In some embodiments, the back portion 26 includes a panel in the top panel zone 50*e* generally trapezoidal in shape and having an end edge 54. The first and second side portions 30, 34 each include a panel in the top panel zone 50*e* that has a respective arcuate edge 58*a*, 58*b*. In such an embodiment, the arcuate edges 58*a*, 58*b* lead to the end edge 54 of the back portion 26 (see FIGS. 8 and 9).

Figure 2:
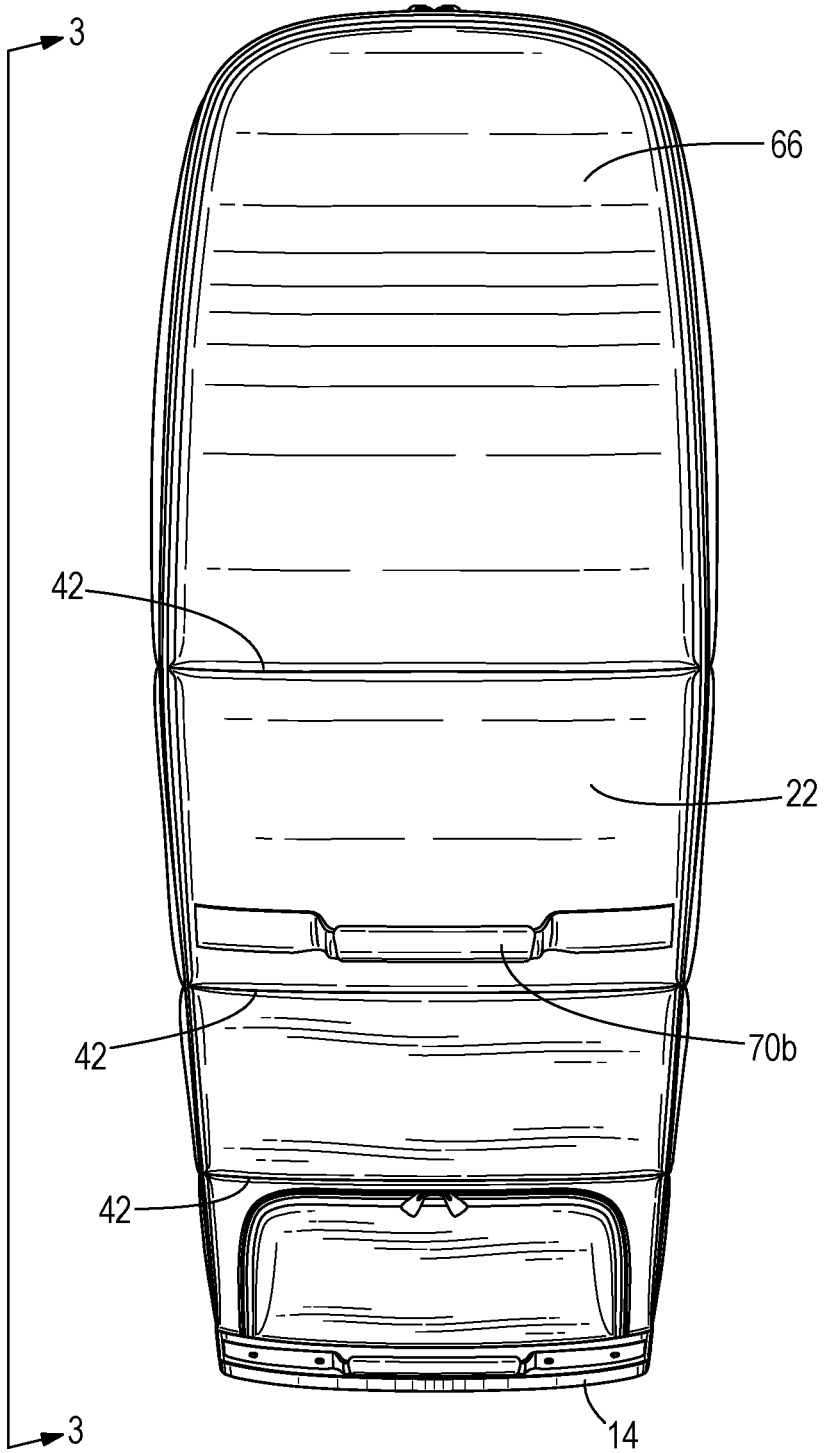
FIG. 2 is a perspective view from the top of the rolling collapsible travel luggage bag of FIG. 1 taken along line 2-2 of FIG. 1.

The front portion 22 of the top panel zone 50*e* has a sixth panel height or length $H_6$, measured vertically (orthogonal to a ground plane) when the luggage bag 10 is in an upright position. In many embodiments, sixth panel height $H_6$ is generally greater than the fifth panel height $H_5$. In some embodiments, the sixth panel height or length $H_6$ can be 28 cm, 29 cm, 30 cm, 31 cm, 32 cm, 33 cm, 34 cm, 35 cm, 36 cm, 37 cm, 38 cm, 39 cm, 40 cm, 41 cm, 42 cm, 43 cm, 44 cm, 45 cm, 46 cm, 47 cm, or 48 cm. In one exemplary embodiment, the sixth panel height $H_6$ is approximately 38.5 cm. In other embodiments, the sixth panel height $H_6$ can be less than 40 cm, 39 cm, 38 cm, 37 cm, 36 cm, or 35 cm based on the size, shape, or orientation of the luggage bag 10. In other embodiments, the sixth panel height $H_6$ can be greater than 30 cm, 31 cm, 32 cm, 33 cm, 34 cm, or 35 cm based on the size, shape, or orientation of the luggage bag 10. In some embodiments, the panel within zone 50*e* of the front portion 22 includes a parabolic edge 62 that removably connects to the arcuate edges 58*a*, 58*b* and to the end edge 54, and the additional panel height $H_6$ of the front portion 22 defines or forms a curved or an arcuate face 66 (see FIGS. 2-3) that extends over or overlaps a portion of a base footprint defined by a periphery of the base 14, as best illustrated in FIG. 2. In such an embodiment, the arcuate face 66 removably connects to the back, first side, and second side portions 26, 30, 34.

Figures 7A, 7B, 7C, 7D:
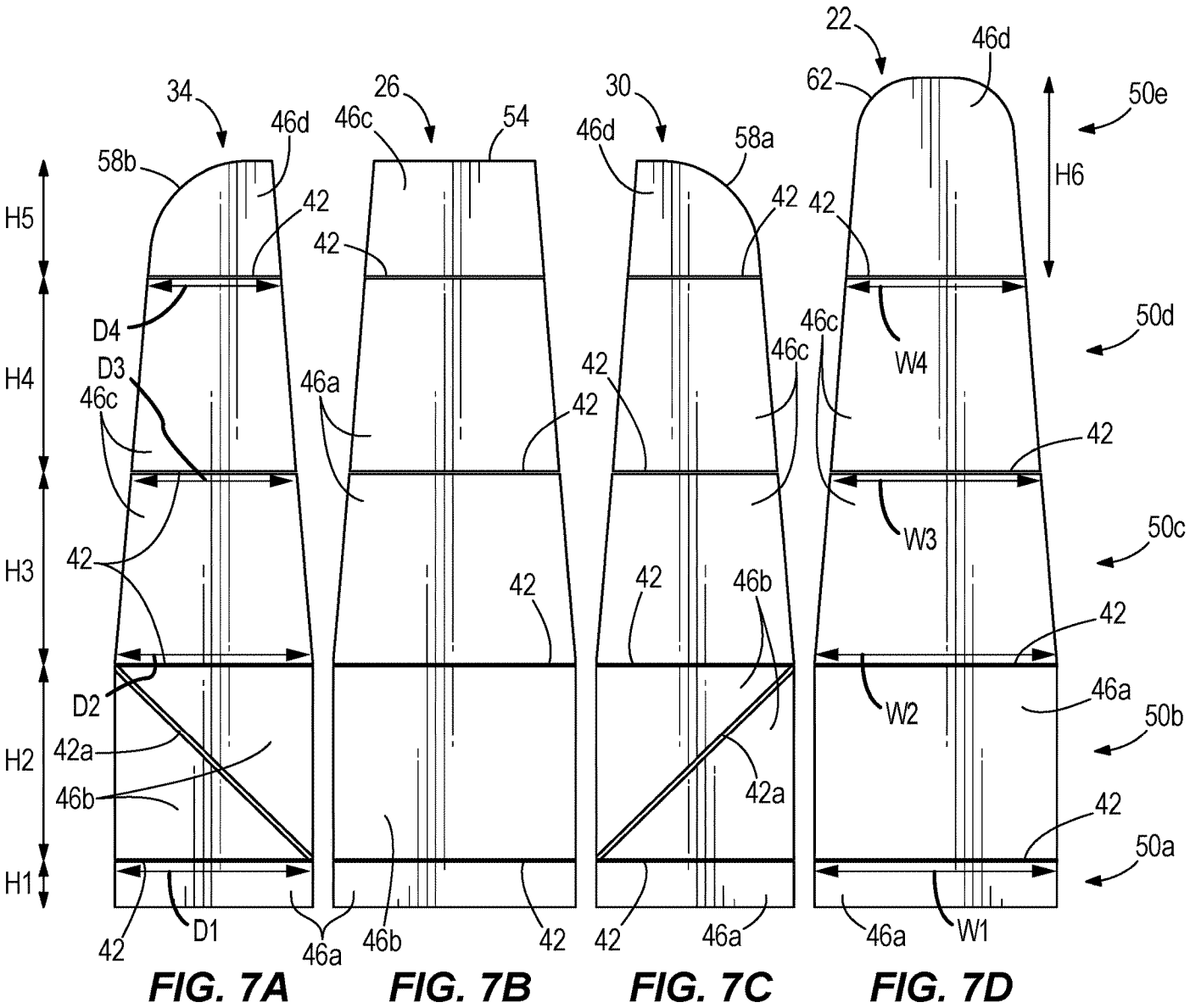
FIG. 7A is an elevation view of the second side portion of the rolling collapsible travel luggage bag of FIG. 1, with the outer shell removed to illustrate the respective panels.
FIG. 7B is an elevation view of the back portion of the rolling collapsible travel luggage bag of FIG. 1, with the outer shell removed to illustrate the respective panels.
FIG. 7C is an elevation view of the first side portion of the rolling collapsible travel luggage bag of FIG. 1, with the outer shell removed to illustrate the respective panels.
FIG. 7D is an elevation view of the front flap of the rolling collapsible travel luggage bag of FIG. 1, with the outer shell removed to illustrate the respective panels.

In some embodiments, the panel heights $H_1$, $H_2$, $H_3$, and $H_4$ vary across the front, back, first side, and second side sections. In some embodiments, the front portion 22 is slightly angled after assembly and the back portion 26 is approximately vertical, with respect to the ground plane when the luggage bag 10 in an upright position. Due to the angled orientation of the front portion 22, when the front section is laid out flat, as illustrated in FIG. 7D, the panel heights of the front portion 22 can be slightly greater than the panel heights of the back 26, the first side portion 30, and the second side 34 portion (height difference is not visible in the illustration). Similarly, in some embodiments, the panel height of the first side portion 30 and the second side portion 34 can be slightly greater than the panel heights of the back portion 26. In some embodiments, the differences in panel section heights can be minimal, varying by a length between 0 cm and 0.2 cm. However, in other embodiments, the fourth panel height $H_4$ is greater in the front portion 22 than in the back portion 26 by a length between 1.5 cm and 3.5 cm. Embodiments, similar to the embodiment of FIGS. 22 and 23, have a fourth panel 50*d* that is angled in the front portion 22. Thus, these embodiments comprise a greater difference in the fourth panel height $H_4$ between sections.

The front portion 22 can have a width measured parallel to the folds 42 from a point where the front portion 22 intersects the first side portion 30 to a point where the front portion 22 intersects the second side portion 34. The back portion 26 can have a width measured parallel to the folds 42 from a point where the back portion 26 intersects the first side portion 30 to a point where the back portion 26 intersects the second side portion 34. In many embodiments, the width of the front portion 22 is the same as or similar to the width of the back portion 26 at any given height.

A first width $W_1$ of the back portion 26 is measured at the fold line between the first panel zone 50*a* and the second panel zone 50*b*. The first width $W_1$ can range between 35 cm and 50 cm. In some embodiments, the first width $W_1$ can be 35 cm, 36 cm, 37 cm, 38 cm, 39 cm, 40 cm, 41 cm, 42 cm, 43 cm, 44 cm, 45 cm, 46 cm, 47 cm, 48 cm, 49 cm, or 50 cm. In the illustrated embodiment, the first width $W_1$ is approximately 43 cm. In many embodiments, a first width of the front portion 22 is the same as or similar to the first width $W_1$ of the back portion 26.

A second width $W_2$ of the back portion 26 is measured at the fold line between the second panel zone 50*b* and the third panel zone 50*c*. The second width $W_2$ can range between 35 cm and 50 cm or between 35 cm and 40 cm. In some embodiments, the second width $W_2$ can be 35 cm, 36 cm, 37 cm, 38 cm, 39 cm, 40 cm, 41 cm, 42 cm, 43 cm, 44 cm, 45 cm, 46 cm, 47 cm, 48 cm, 49 cm, or 50 cm. In the illustrated embodiment, the second width $W_2$ is approximately 39 cm. In many embodiments, a second width of the front portion 22 is the same as or similar to the second width $W_2$ of the back portion 26.

A third width $W_3$ of the back portion 26 is measured at the fold line between the third panel zone 50*c* and the fourth panel zone 50*d*. The third width $W_3$ can range between 25 cm and 45 cm or between 30 cm and 40 cm. In some embodiments, the third width $W_3$ can be 35 cm, 36 cm, 37 cm, 38 cm, 39 cm, 40 cm, 41 cm, 42 cm, 43 cm, 44 cm, 45 cm, 46 cm, 47 cm, 48 cm, 49 cm, or 50 cm. In the illustrated embodiment, the third width $W_3$ is approximately 39 cm. In many embodiments, a third width of the front portion 22 is the same as or similar to the third width $W_3$ of the back portion 26.

A fourth width $W_4$ of the back portion 26 is measured at the fold line between the fourth panel zone 50*d* and the fifth panel zone 50*e*. The fourth width $W_4$ can range between 20 cm and 45 cm or between 20 cm and 30 cm. In some embodiments, the fourth width $W_4$ can be 20 cm, 21 cm, 22 cm, 23 cm, 24 cm, 25 cm, 26 cm, 27 cm, 28 cm, 29 cm, 30 cm, 31 cm, 32 cm, 33 cm, 34 cm, 35 cm, 36 cm, 37 cm, 38 cm, 39 cm, 40 cm, 41 cm, 42 cm, 43 cm, 44 cm, or 45 cm. In the embodiment illustrated in FIGS. 20-23, the fourth width $W_4$ is approximately 27 cm. In many embodiments, a fourth width of the front portion 22 is the same as or similar to the fourth width $W_4$ of the back portion 26.

The first side portion 30 can have a depth measured parallel to the folds 42 from a point where the first side portion 30 intersects the back portion 26 to a point where the first side portion 30 intersects the front portion 22. The second side portion 34 can have a depth measured parallel to the folds 42 from a point where the second side portion 34 intersects the back portion 26 to a point where the second side portion 34 intersects the front portion 22. At any given height, the depth of the first side portion 30 is the same as the depth of the second side portion. The depths of each portion are carefully selected to allow various golf bags to be secured within the interior chamber 102.

A first depth $D_1$ of the second side portion 34 is measured at the fold line between the first panel zone 50*a* and the second panel zone 50*b*. In many embodiments, the first depth $D_1$ can range between 20 cm and 40 cm, or between 25 cm and 35 cm. In some embodiments, the first depth $D_1$ can be 20 cm, 21 cm, 22 cm, 23 cm, 24 cm, 25 cm, 26 cm, 27 cm, 28 cm, 29 cm, 30 cm, 31 cm, 32 cm, 33 cm, 34 cm, 35 cm, 36 cm, 37 cm, 38 cm, 39 cm, or 40 cm. In one exemplary embodiment, the first depth $D_1$ is approximately 30 cm. In other embodiments, the first depth $D_1$ can be less than 30 cm, 29 cm, 28 cm, 27 cm, 26 cm, or 25 cm based on the size, shape, or orientation of the luggage bag 10. In other embodiments, the first depth $D_1$ can be greater than 30 cm, 31 cm, 32 cm, 33 cm, 34 cm, or 35 cm based on the size, shape, or orientation of the luggage bag 10. In many embodiments, a first depth of the first side portion 30 is the same as the first depth $D_1$ of the second side portion 34.

A second depth $D_2$ of the second side portion 34 is measured at the fold line between the second panel zone 50*b* and the third panel zone 50*c*. In many embodiments, the second depth $D_2$ can range between 20 cm and 35 cm, or between 25 cm and 35 cm. In some embodiments, the second depth $D_2$ can be 20 cm, 21 cm, 22 cm, 23 cm, 24 cm, 25 cm, 26 cm, 27 cm, 28 cm, 29 cm, 30 cm, 31 cm, 32 cm, 33 cm, 34 cm, or 35 cm. In one exemplary embodiment, the second depth $D_2$ is approximately 29 cm. In other embodiments, the second depth $D_2$ can be less than 30 cm, 29 cm, 28 cm, 27 cm, 26 cm, or 25 cm based on the size, shape, or orientation of the luggage bag 10. In other embodiments, the second depth $D_2$ can be greater than 25 cm, 26 cm, 27 cm, 28 cm, 29 cm, or 30 cm based on the size, shape, or orientation of the luggage bag 10. In many embodiments, a second depth of the first side portion 30 is the same as the second depth $D_2$ of the second side portion 34.

A third depth $D_3$ of the second side portion 34 is measured at the fold line between the third panel zone 50*c* and the fourth panel zone 50*d*. In many embodiments, the third depth $D_3$ can range between 20 cm and 35 cm, or between 25 cm and 30 cm. In some embodiments, the third depth $D_3$ can be 20 cm, 21 cm, 22 cm, 23 cm, 24 cm, 25 cm, 26 cm, 27 cm, 28 cm, 29 cm, 30 cm, 31 cm, 32 cm, 33 cm, 34 cm, or 35 cm. In one exemplary embodiment, the third depth $D_3$ is approximately 26 cm. In other embodiments, the third depth $D_3$ can be less than 30 cm, 29 cm, 28 cm, 27 cm, 26 cm, or 25 cm based on the size, shape, or orientation of the luggage bag 10. In other embodiments, the third depth $D_3$ can be greater than 25 cm, 26 cm, 27 cm, 28 cm, 29 cm, or 30 cm based on the size, shape, or orientation of the luggage bag 10. In many embodiments, the third depth of the first side portion 30 is the same as the third depth $D_3$ of the second side portion 34.

A fourth depth $D_4$ of the second side portion 34 is measured at the fold line between the fourth panel zone 50*d* and the fifth panel zone 50*e*. In many embodiments, the fourth depth $D_4$ can range between 10 cm and 35 cm, or between 12 cm and 20 cm. In some embodiments, the fourth depth $D_4$ can be 10 cm, 11 cm, 12 cm, 13 cm, 14 cm, 15 cm, 16 cm, 17 cm, 18 cm, 19 cm, 20 cm, 21 cm, 22 cm, 23 cm, 24 cm, 25 cm, 26 cm, 27 cm, 28 cm, 29 cm, 30 cm, 31 cm, 32 cm, 33 cm, 34 cm, or 35 cm. In one exemplary embodiment, the fourth depth $D_4$ is approximately 16 cm. In other embodiments, the fourth depth $D_4$ can be less than 30 cm, 29 cm, 28 cm, 27 cm, 26 cm, or 25 cm based on the size, shape, or orientation of the luggage bag 10. In other embodiments, the fourth depth $D_4$ can be greater than 25 cm, 26 cm, 27 cm, 28 cm, 29 cm, or 30 cm based on the size, shape, or orientation of the luggage bag 10. In many embodiments, the fourth depth of the first side portion 30 is the same as the fourth depth $D_4$ of the second side portion 34.

The back portion 26 includes in the top panel zone 50*e* a panel 46*c* formed of a relatively stiff board material combined with foam. The stiff board material has a thickness of approximately 1.0 mm. The front, first side, and second side portions 22, 30, 34 include in the top panel zone 50*e* a panel 46*d* formed of foam and that does not include a board material. Forming the panels 46*d* from foam provides flexibility to the front, first side, and second side portions 22, 30, 34 to facilitate formation of the arcuate face 66 (see FIGS. 2-3) of the front portion 22 in the top panel zone 50*e*.

It should be appreciated that a greater thickness of the board material leads to a more rigid or a greater stiffness panel. For example, the panels in the second panel zone 50*b* are more rigid and/or have a greater stiffness than the panels in the top panel zone 50*e*. Generally, the overall stiffness or rigidity of the panels decreases from the base 14 upward toward the arcuate face 66.

The cover 18 can comprise between 15 to 30 total panels 46. In some embodiments, the cover 18 comprises between 15 to 20, 17 to 25, 20 to 25, or 25 to 30 total panels 46. For example, the cover 18 illustrated in FIG. 3 comprises twenty-two total panels 46. In some embodiments, the cover 18 comprises at least 20 panels, 21 panels, 22 panels, 23 panels, 24 panels, or 25 panels. In other embodiments, the cover 18 comprises no more than 25 panels, 24 panels, 23 panels, 22 panels, 21 panels, or 20 panels. The total number of panels may be based on the size, shape, and/or collapsibility of the luggage bag 10.

In one exemplary embodiment, the luggage bag 10 has a height or length, defined by the sum of heights $H_1$ to $H_5$, of approximately 120.5 cm (or approximately 47.5 inches). In other embodiments, the luggage bag 10 may have a height or length in a range of approximately 110 cm to approximately 140 or more cm. Stated another way, the luggage bag 10 may have a height or length suitable to receive a golf bag and/or one or more full length golf clubs.

Figure 3:
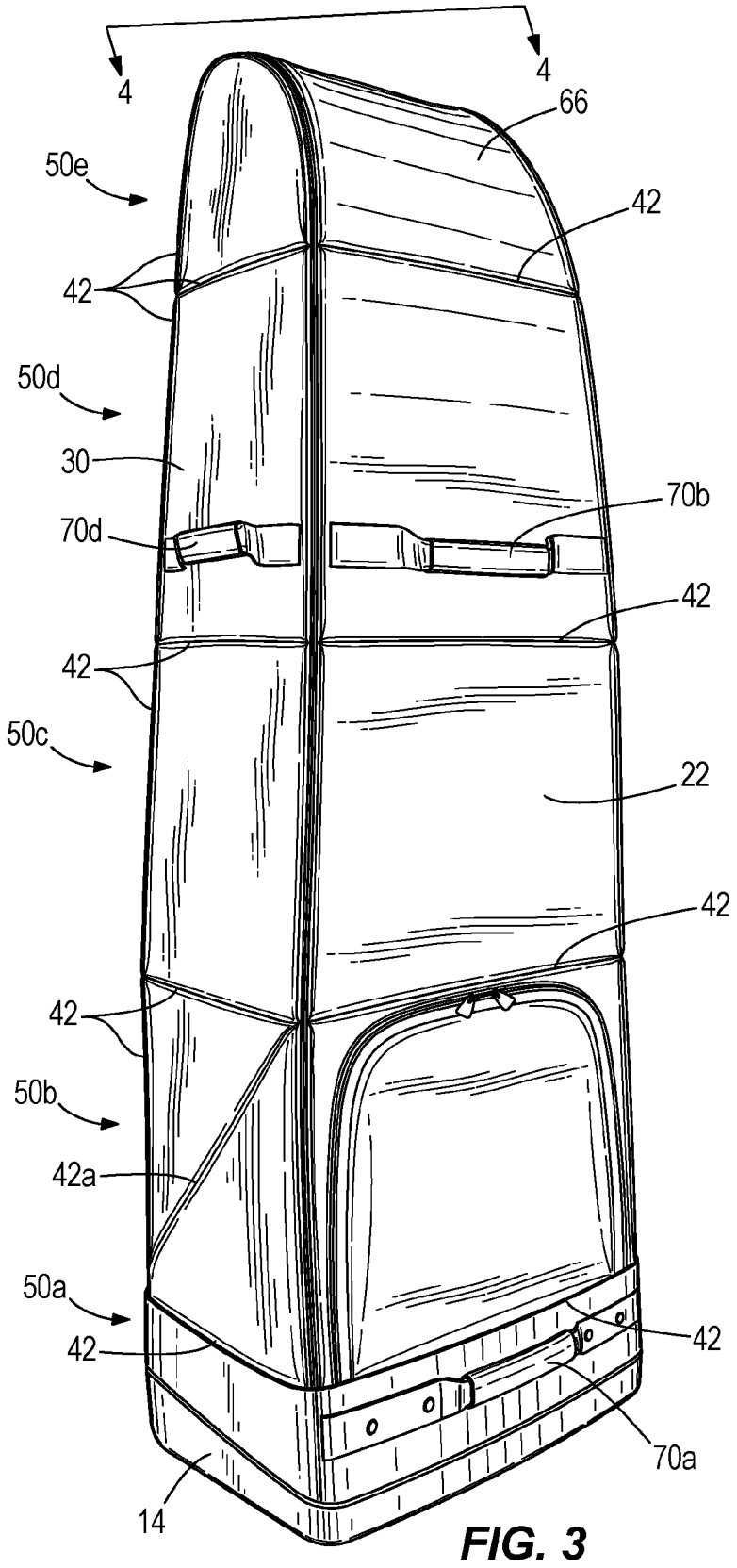
FIG. 3 is a perspective view from a first side of the rolling collapsible travel luggage bag of FIG. 1 taken along line 3-3 of FIG. 2.

Referring back to FIGS. 1-6, the luggage bag 10 includes a plurality of handles 70 to assist with lifting and otherwise carrying the luggage bag 10. As illustrated in FIGS. 1 and 3, a first handle 70*a* is connected to the front portion 22 in the first panel zone 50*a* proximate or near the base 14 to provide a user a location to grasp near the base 14. Referring to FIGS. 1-6, a plurality of second handles 70*b*, 70*c*, 70*d*, 70*e* are respectively connected to the front portion 22, back portion 26, first side portion 30, and second side portion 34. The second handles 70*b*, 70*c*, 70*d*, 70*e* are illustrated in the same horizontal plane around the luggage bag 10, approximately 70 cm to 90 cm from the base 14 (or surface on which the base 14 is positioned). In other embodiments, the second handles 70*b*, 70*c*, 70*d*, 70*e* may be offset, staggered, or positioned on panels in other panel zones 50, and at various distances from the base 14 (or surface on which the base 14 is positioned). In addition, fewer or more than four second handles 70*b*, 70*c*, 70*d*, 70*e* may be connected to luggage bag 10. The first handle 70*a* and second handles 70*b*, 70*c*, 70*d*, 70*e* may be any suitable handle for use with luggage. In the illustrated embodiments, the handles 70*a*, 70*b*, 70*c*, 70*d*, 70*e* are formed of a durable fabric, and include a handle wrap. In other embodiments, the handles 70*a*, 70*b*, 70*c*, 70*d*, 70*e* may be formed of any suitable materials.

Figure 4A:
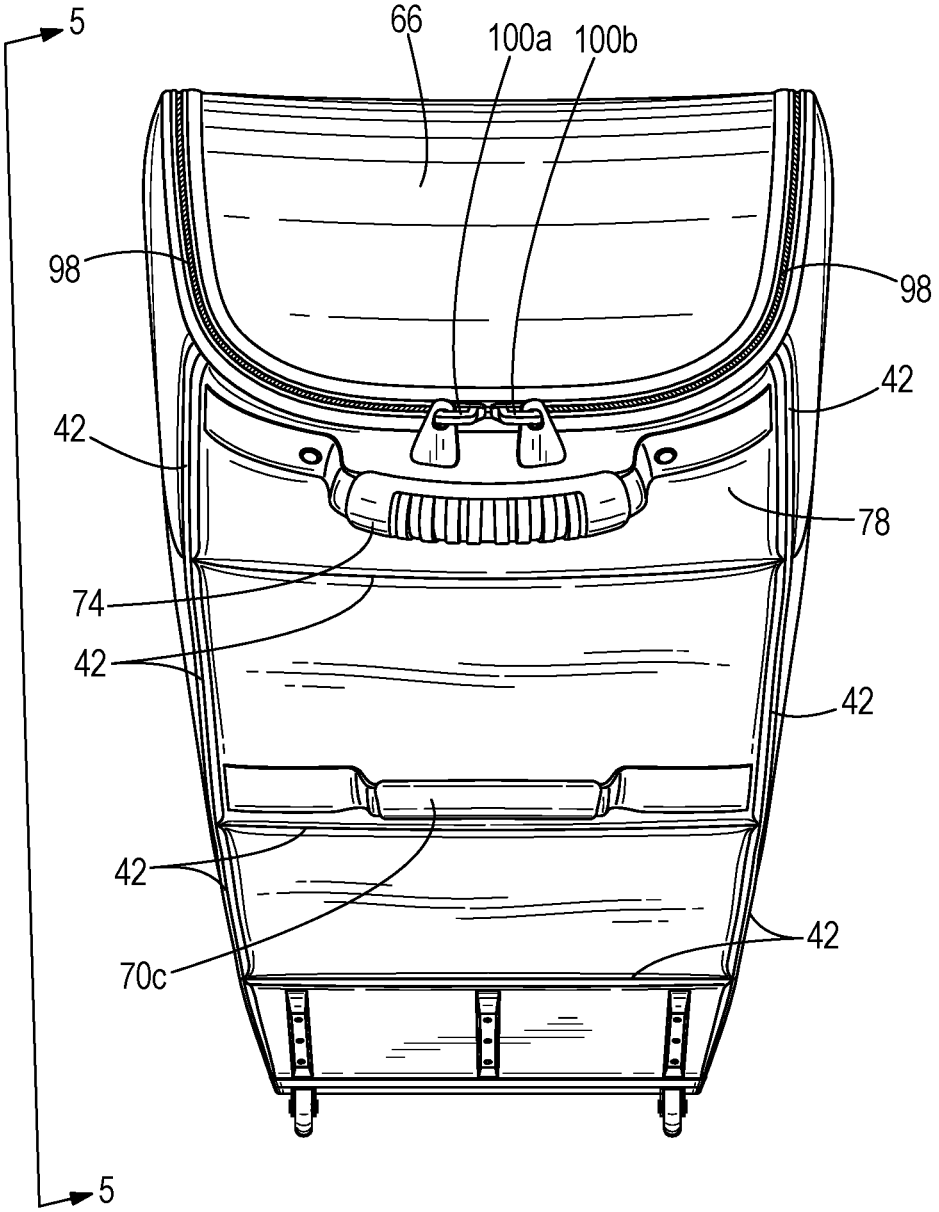
FIG. 4A is a perspective view from the rear of the rolling collapsible travel luggage bag of FIG. 1 taken along line 4-4 of FIG. 3, illustrating a first position of a rolling handle.
Figure 4B:
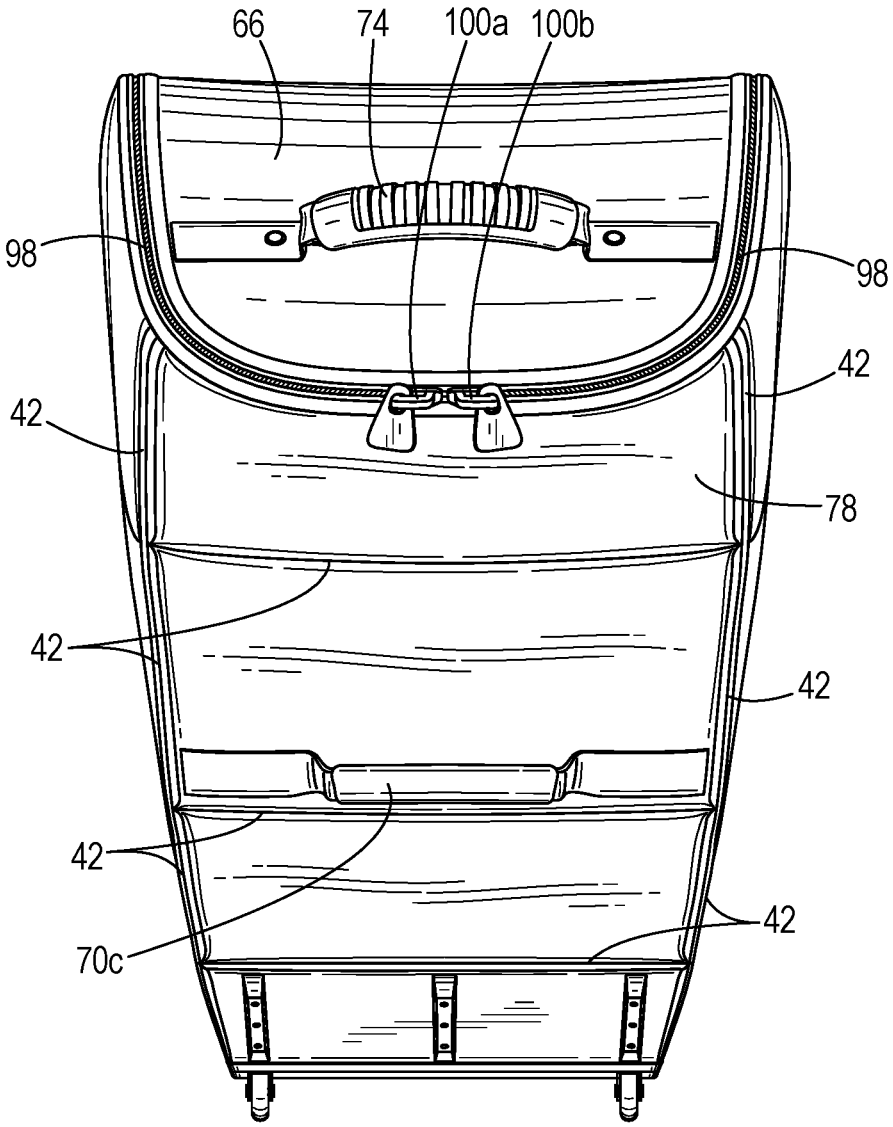
FIG. 4B is a perspective view from the rear of the rolling collapsible travel luggage bag of FIG. 1 taken along line 4-4 of FIG. 3, illustrating a second position of the rolling handle.
Figure 5:
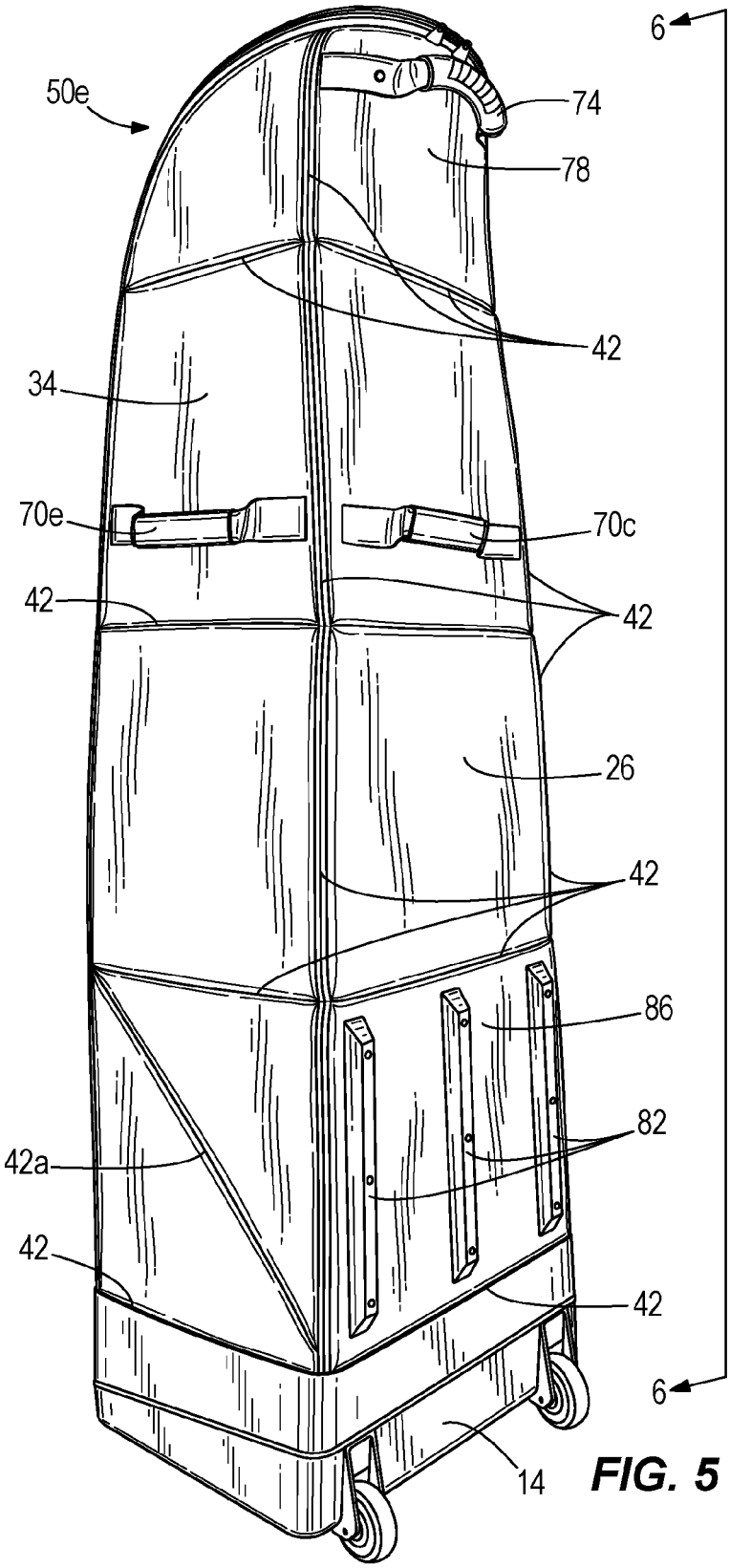
FIG. 5 is a perspective view from a second side of the rolling collapsible travel luggage bag of FIG. 1 taken along line 5-5 of FIG. 4A.
Figure 6:
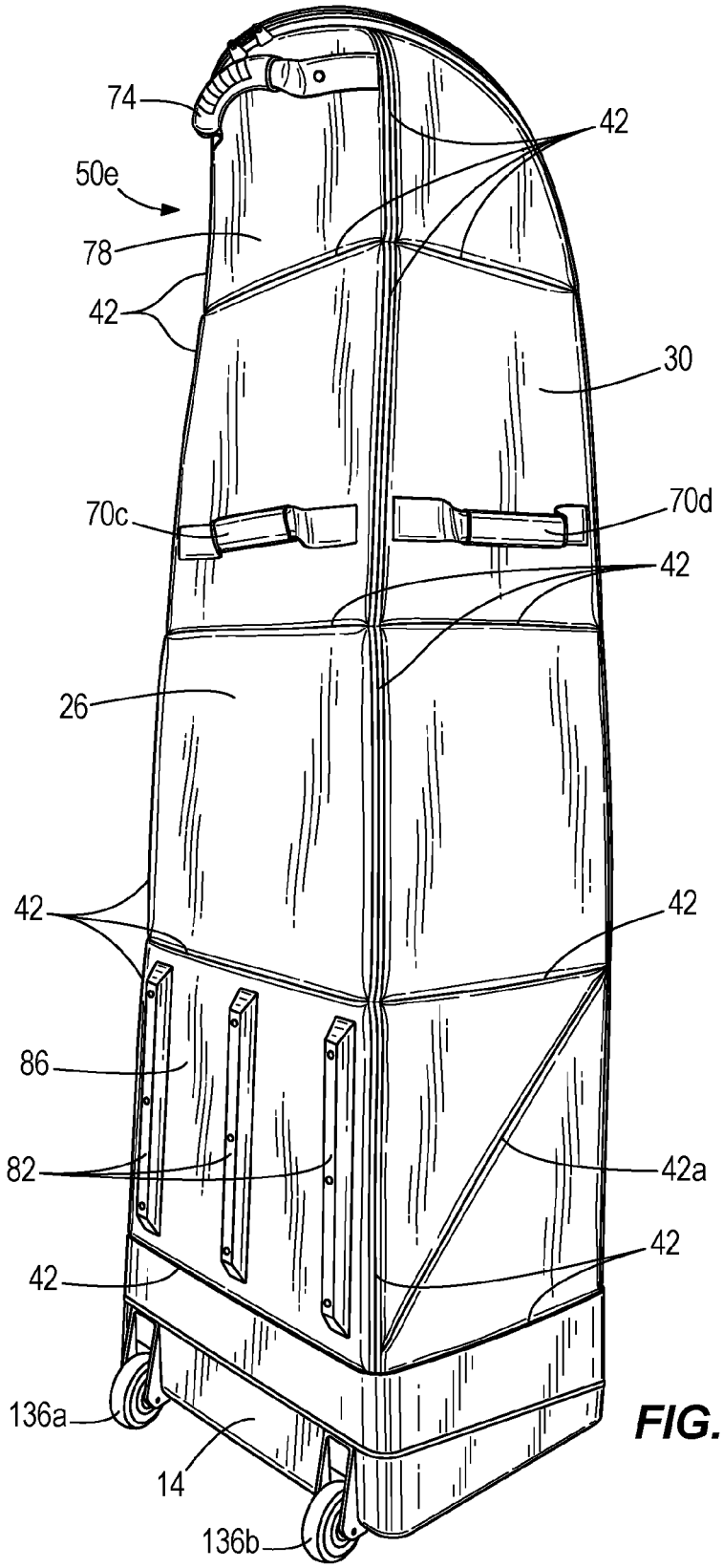
FIG. 6 is a perspective view from the rear of the rolling collapsible travel luggage bag of FIG. 1 taken along line 6-6 of FIG. 5.

Referring to FIGS. 4A, 5, and 6, the luggage bag 10 includes a rolling handle 74 provided on a panel or top back panel 78 on the back side 26 within the top panel zone 50*e*. In the illustrated embodiment, the rolling handle 74 projects away from the back side 26, and is located adjacent or towards the end edge 54 (see FIG. 8) of the panel 78. In other embodiments, the handle 74 may be located at any desired location along the panel 78. The rolling handle 74 is shown as reinforced with a rubber handle wrap but can be any other suitable handle for use with luggage bag 10. In yet other embodiments, and as illustrated in FIG. 4B, the rolling handle 74 may instead be positioned on the arcuate face 66. Alternatively, the luggage bag 10 may include two rolling handles 74, with one positioned on the panel 78 (for example the position illustrated in FIG. 4A) and the other on the arcuate face 66 (for example the position illustrated in FIG. 4B).

Referring now to FIGS. 5 and 6, the luggage bag 10 includes a bumper in the form of rails 82 positioned on a panel or bottom back panel 86 within the second panel zone 50*b*, adjacent but separate from the base 14. The rails 82 extend upward, away from the base 14 and provide protection against luggage damage when the luggage bag 10 is pulled over a curb or other uneven surface. In the illustrated embodiment, the rails 82 are arranged on the single panel 86 and do not extend to any adjacent panel or to the base 14, thereby facilitating collapsibility of the luggage bag 10 (further detailed below). In one or more examples of embodiments, the rails 82 are approximately 20 cm to 30 cm long with a width of approximately 2 cm to 5 cm. In other embodiments the rails 82 may be any length or width suitable for providing protection against damage to the luggage bag 10 while facilitating collapsibility of the luggage bag 10. In the illustrated embodiment, the luggage bag 10 includes three total rails 82, with outermost first and second rails 82 in respective vertical alignment with wheels 136*a*, 136*b*. A third middle rail 82 is approximately equidistant from the outermost rails 82. In other embodiments, any suitable number of rails 82 may be implemented, for example two rails 82 or four or more rails 82. In yet other embodiments, additional bumpers, or rails 82 may be positioned on other panels, including in the first or bottom panel zone 50*a* or on the base 14.

FIGS. 6A-6D illustrate an alternative embodiment of the luggage bag 10 having a bumper or bumper assembly 180 that extends from the base 14 along a portion of the cover 18. The bumper 180 includes rails 182 that removably engage a corresponding rail extension 186 projecting from the base 14. The combination of the rails 182 and rail extensions 186 provide protection against luggage damage when the luggage bag 10 is pulled over a curb or other uneven surface by providing a bumper that continuously or directionally extends from the base 14 along a portion of the cover 18, while also facilitating collapsibility of the luggage bag 10 through disengagement of the rails 182 from the rail extensions 186. While the illustrated embodiment depicts the plurality of rails 182 and the plurality of corresponding rail extensions 186 as three rails 182 and three rail extensions 186, in other embodiments, the plurality of rails 182 may include any number of rails 182 (e.g., two to six or more) and the plurality of rail extensions 186 may include any corresponding number of rail extensions 186 (e.g., two to six or more).

Figure 6A:
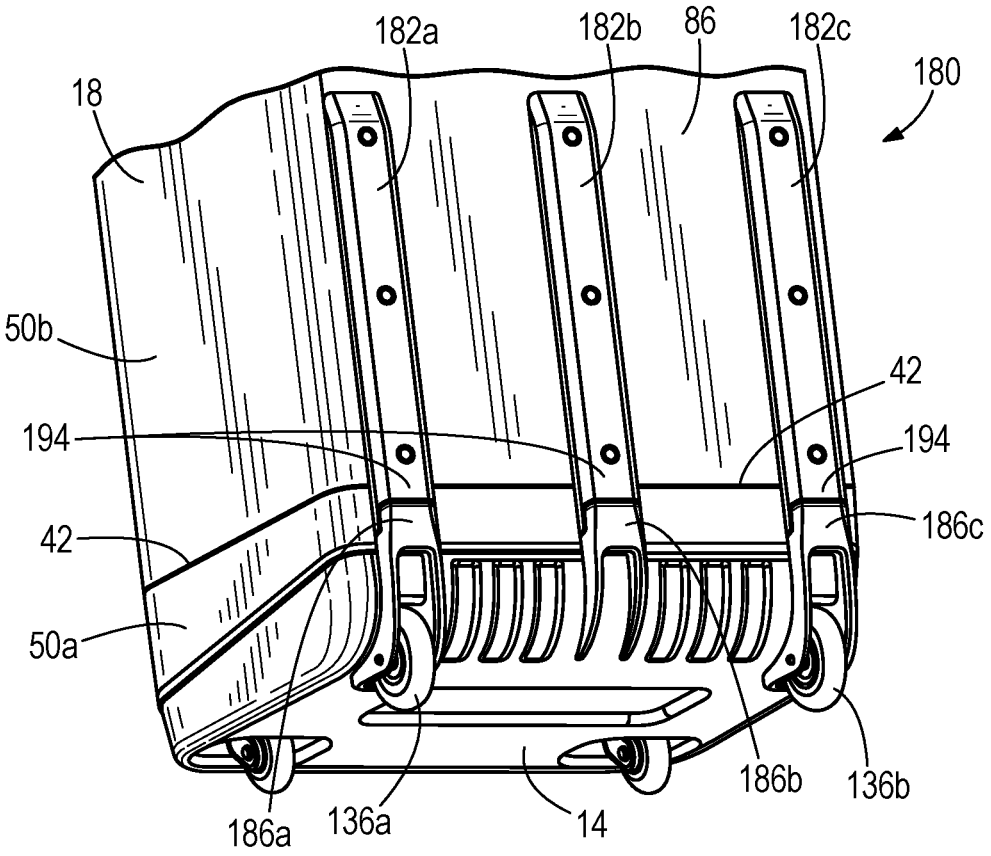
FIG. 6A is a perspective view of an alternative embodiment of the rails for use with the rolling collapsible travel luggage bag illustrated in FIGS. 5 and 6 and shown in an upright position.
Figure 6B:
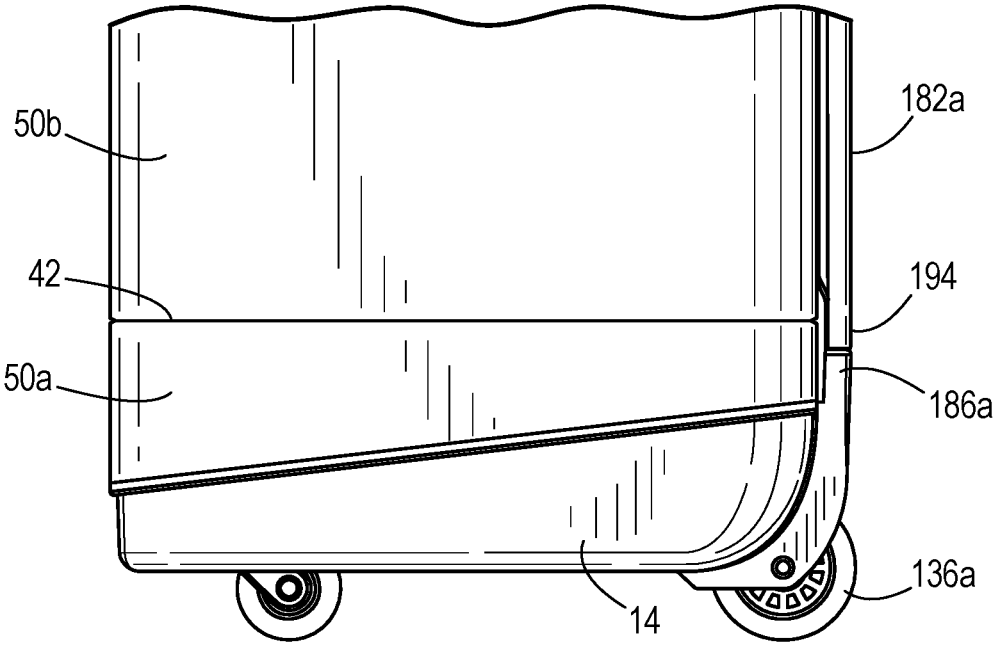
FIG. 6B is a side view of the rolling collapsible travel luggage bag of FIG. 6A.

Referring to FIGS. 6A-6B, the rails 182 are illustrated as a plurality of rails 182*a, b, c* positioned on a panel or bottom back panel 86 within the second panel zone 50*b*. Each rail 182*a, b, c* is coupled to the panel 86 by one or more attachment members, illustrated as a plurality of rivets through each rail 182*a, b, c*. In other embodiments, the rails 182*a, b, c* can be attached to the panel 86 by any suitable attachment member. Each rail 182*a, b, c* defines a channel 190 (best shown in FIG. 6C). The channel 190 may further be defined by an elongated portion 194 of the rail 182*a, b, c* (shown in FIGS. 6B and 6D), which is integrally formed with the rail 182*a, b, c*. The rails 182*a, b, c* extend from the panel 86 in the second panel zone 50*b* towards the base 14, crossing the fold 42 between the first and second panel zones 50*a, b* into the first panel zone 50*a*. More specifically, the elongated portion 194 of each rail 182*a, b, c* crosses the fold 42 between the first and second panel zones 50*a, b* and into the first panel zone 50*a*. Each rail 182 is approximately 1.9 inches wide, but in other embodiments may be anywhere from 1.5 inches to 3.0 inches or more wide.

Referring to FIGS. 6A-6D, the rail extensions 186 are illustrated as a plurality of rail extensions 186*a, b, c* that are positioned on and project away from the base 14. In the embodiment shown, the rail extensions 186*a, b, c* are each generally in alignment with and project towards the corresponding rails 182*a, b, c*. The outermost rail extensions 186*a, c* are further generally aligned with respective wheels 136*a, b* of the base 14, while the intermediate rail extension 186*b* is between, and may be centered between, the outermost rail extensions 186*a, c*.

Figure 6C:
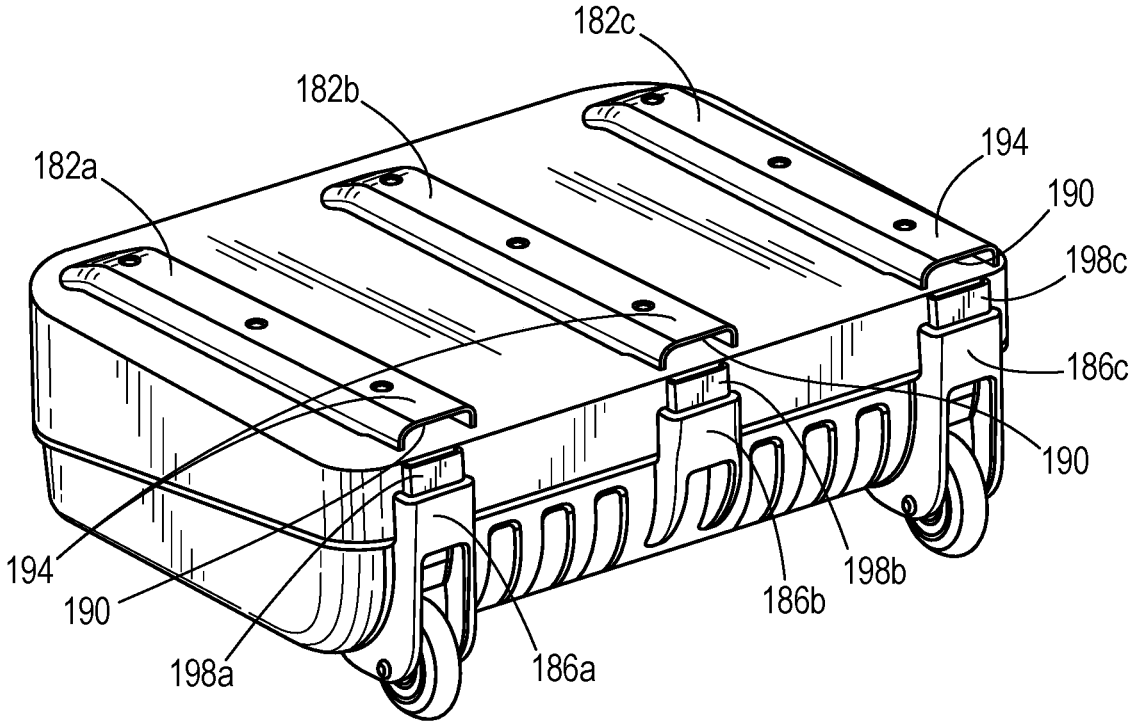
FIG. 6C is a perspective view of the rolling collapsible travel luggage bag of FIG. 6A shown in a collapsed, folded position.
Figure 6D:
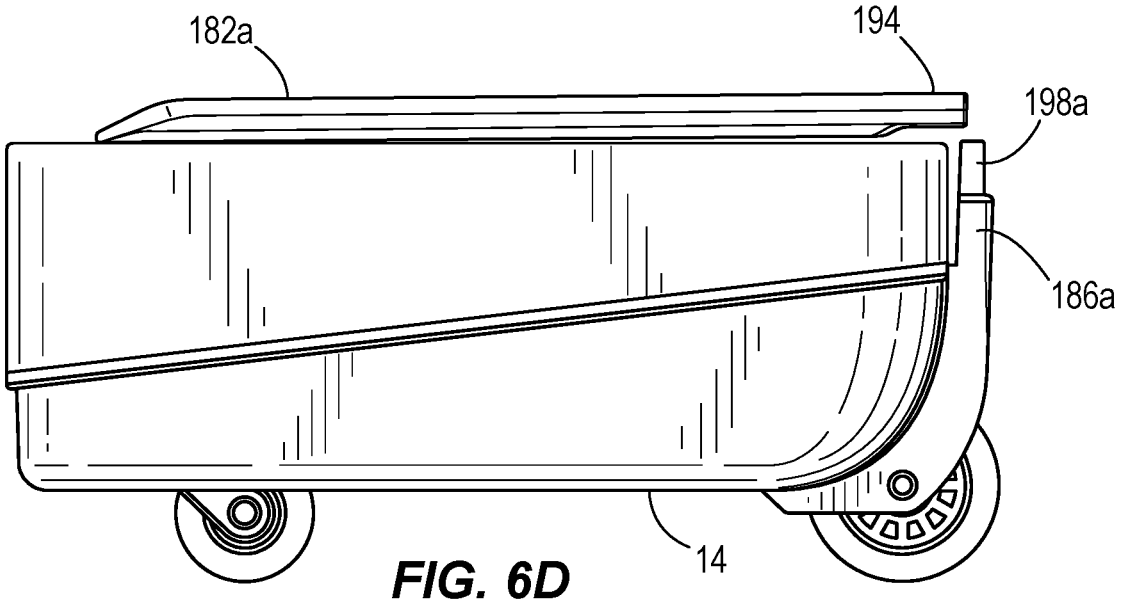
FIG. 6D is a side view of the rolling collapsible travel luggage bag of FIG. 6C.

Each rail extension 186*a, b, c* includes a projection 198*a, b, c* (shown in FIGS. 6C-6D). Each projection 198 is approximately 1.5 inches wide, but in other embodiments may be anywhere from 1.2 inches to 2.0 inches or more wide, and more specifically may be any width that is complementary to an associated rail 182 in order to facilitate engagement between the rail 182 and the projection 198. Each rail extension 186 extends approximately 1.8 inches from the base 14, with the projection 198 being approximately 0.6 inches (or 33% of the rail extension 186 length). In other embodiments, the length of the rail extension 186 may be any suitable length, and the corresponding length of the projection 198 may be any suitable length or percentage of the rail extension 186 length.

Each of the rails 182*a, b, c* removably engages a corresponding rail extension 186*a, b, c*. More specifically, each projection 198*a, b, c* is removably received by the elongated portion 194 of the channel 190 of a corresponding rail 182*a, b, c* to form the bumper 180, which continuously extends from the base 14 along a portion of the cover 18 when the luggage bag 10 is in the upright position illustrated in FIGS. 6A-6B (or a closed configuration, as shown in FIG. 1). While the illustrated embodiment discloses the removable engagement in the form of the rails 182*a, b, c* receiving a portion of a corresponding rail extension 186*a, b, c*, in other embodiments any suitable removable engagement between the rails 182 and rail extensions 186 can be used. For example, the rail extensions 186 may alternatively define a respective channel having a size suitable to receive a portion of a corresponding rail 182. As another example, each rail 182 may removably couple to a corresponding rail extension 186 by a connection member (e.g., a snap button, an interference fit, or other suitable fastener). In yet another embodiment, a combination of removable engagement as illustrated in FIGS. 6A-6D together with the use of one or more connection members may be employed.

To facilitate collapsibility of the luggage bag 10, each of the rails 182*a, b, c* disengages a corresponding rail extension 186*a, b, c* when the luggage bag 10 is in a collapsed, folded position (or a collapsed configuration) as illustrated in FIGS. 6C-6D. To disengage each rail 182*a, b, c* from the corresponding rail extension 186*a, b, c*, the user collapses the panel 86 having the attached rails 182*a, b, c* along the fold 42. The rails 182*a, b, c* disengage from the associated rail extensions 186*a, b, c*, as the rails 182*a, b, c* separate from the associated projections 198*a, b, c* during collapse of the cover 18. In other embodiments, the rails 182*a, b, c* may disengage from the associated rail extensions 186*a, b, c* by sliding, pivoting, lifting away, or otherwise through any suitable manner of separating the rails 182*a, b, c* from the rail extensions 186*a, b, c*.

Figure 27A:
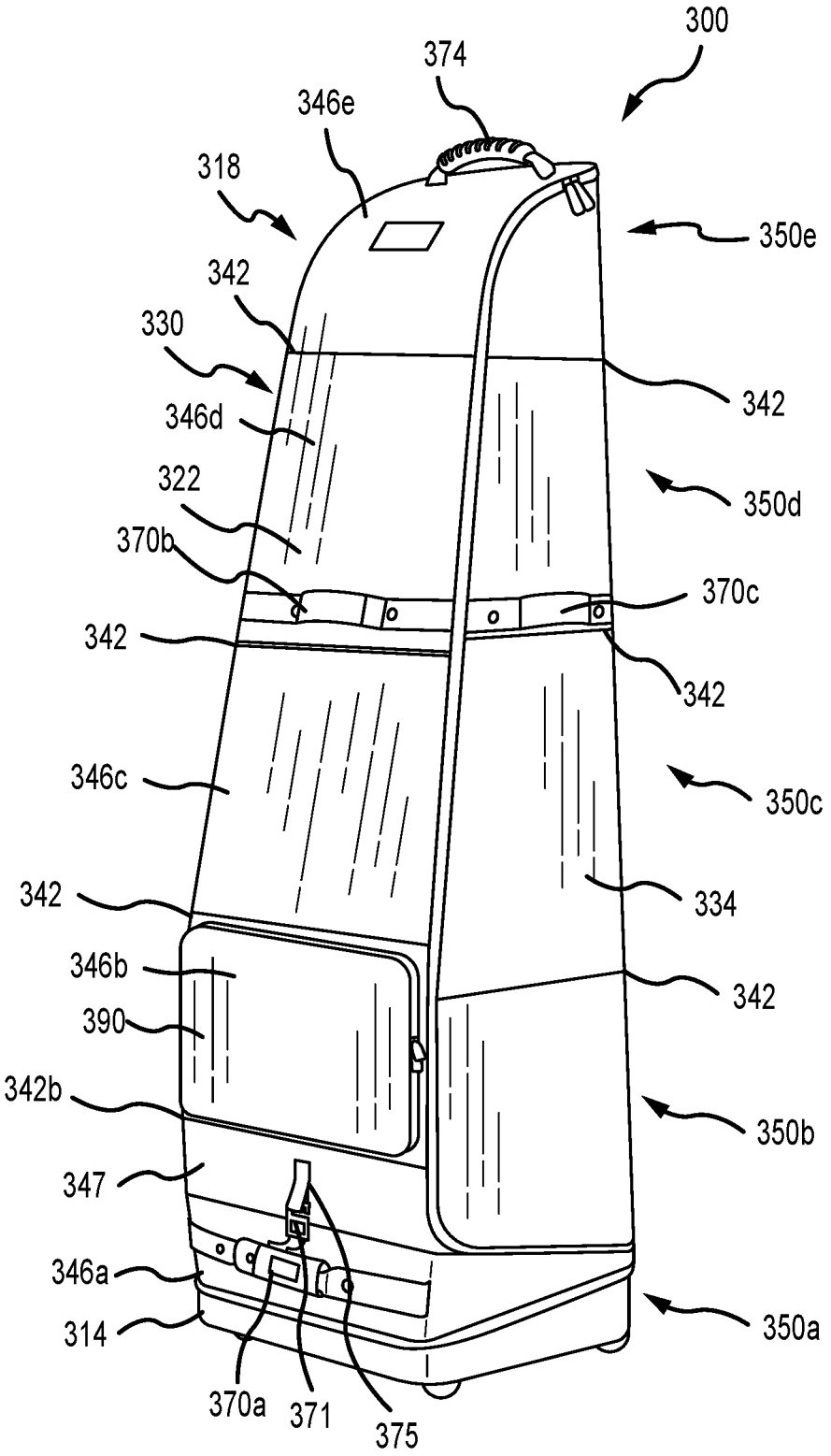
FIG. 27A is a front perspective view of an embodiment of a collapsible travel luggage bag in an upright position.

Referring back to FIG. 1, in some embodiments, the luggage bag 10 includes a storage pocket 90 on the front portion 22, more specifically on a panel or bottom front panel 94 within the second panel zone 50*b*, adjacent but separate from the base 14. Referring to FIG. 27A, in some embodiments, the storage pocket 90 is located on the front portion 322, above the sub panel 347, as discussed in more detail below. The storage pocket 90 includes a zipper, zip fastener, or any other suitable fastener to permit access to the inside of the storage pocket 90. In other embodiments, the storage pocket 90 can be located on another panel on the front, back, first side, or second side portions 22, 26, 30, 34. In addition, more than one storage pocket 90 may be located on the luggage bag 10. To facilitate collapsibility of the luggage bag 10, the storage pocket 90 is arranged on a single panel, and does not extend to any adjacent panel or to the base 14.

Referring now to FIG. 8, in some embodiments, the back portion 26 is integrally formed with the first side portion 30 and second side portion 34. For example, the back, first side, and second side portions 26, 30, 34 can be stitched together or otherwise connected or formed as a unitary portion of cover 18. In some embodiments, a connection member 98 (see also FIGS. 4A-B) in the form of a zip fastener or zipper separates the front portion 22 from the first and second side portions 30, 34 and the back portion 26. In such an embodiment, a first portion of the connection member 98 defines a portion of a perimeter of the front portion 22, while a second portion of the connection member 98 defines a portion of a perimeter of the first and second side portions 30, 34, and extends along the arcuate edges 58*a*, 58*b* to the end edge 54 of the back portion 26. The connection member 98 thus removably connects the front portion 22 to the back, first side, and second side portions 26, 30, 34. In some embodiments, the connection member 98 further separates the first and second side portions 30, 34 from the base 14. In such an embodiment, the connection member 98 thus removably connects the front portion 22 to the back, first side, and second side portions 26, 30, 34, and further removably connects the first and second side portions 330, 334 from the base 314.

It should be appreciated that the connection member 98 may be any suitable device or assembly for connecting the front portion 22 to the back, first side, and second side portions 26, 30, 34, including, but not limited to, a hook and loop fastener, a zip fastener, or a fly fastener. In addition, while the connection member 98 is illustrated in FIGS. 44A-B with two, opposing sliders 100*a*, 100*b* (such as in a two-way or a double-separating zip fastener), in other embodiments the connection member 98 may include one slider, or three or more sliders.

When the front portion 22 is connected to or engaged with the back, first side, and second side portions 26, 30, 34 (as shown in FIG. 1), the portions 22, 26, 30, 34 define an interior chamber 102 for receiving items for transport. The front portion 22 may be selectively or partially disconnected or disengaged from the back, first side, and second side portions 26, 30, 34 so that a user has various degrees of access to the interior chamber 102. In FIG. 8, the luggage bag 10 is shown in the upright position with only a part of the front portion 22 connected or engaged with the first side and second side portions 30, 34 by one or more connection members 98 (hereinafter referred to as connection member 98), thereby partially exposing the interior chamber 102. By partially exposing the interior chamber 102, a user may place and position items into the interior chamber 102 while the luggage bag 10 remains in the upright position (or is otherwise free standing).

As illustrated in FIG. 8, the luggage bag 10 is provided in the partial access or first standing access position. The front portion 22 is illustrated as bent over the fold 42 provided between panels in the second and third panel zones 50*b*, 50*c*. It should be appreciated that the front portion 22 may be selectively or partially disconnected from the back, first side, and second side portions 26, 30, 34 as to allow any desired number of panel zones 50 to bend or fold over a desired fold 42 in the front portion 22 and thereby provide varying amounts of access to the interior chamber 102.

Figure 9:
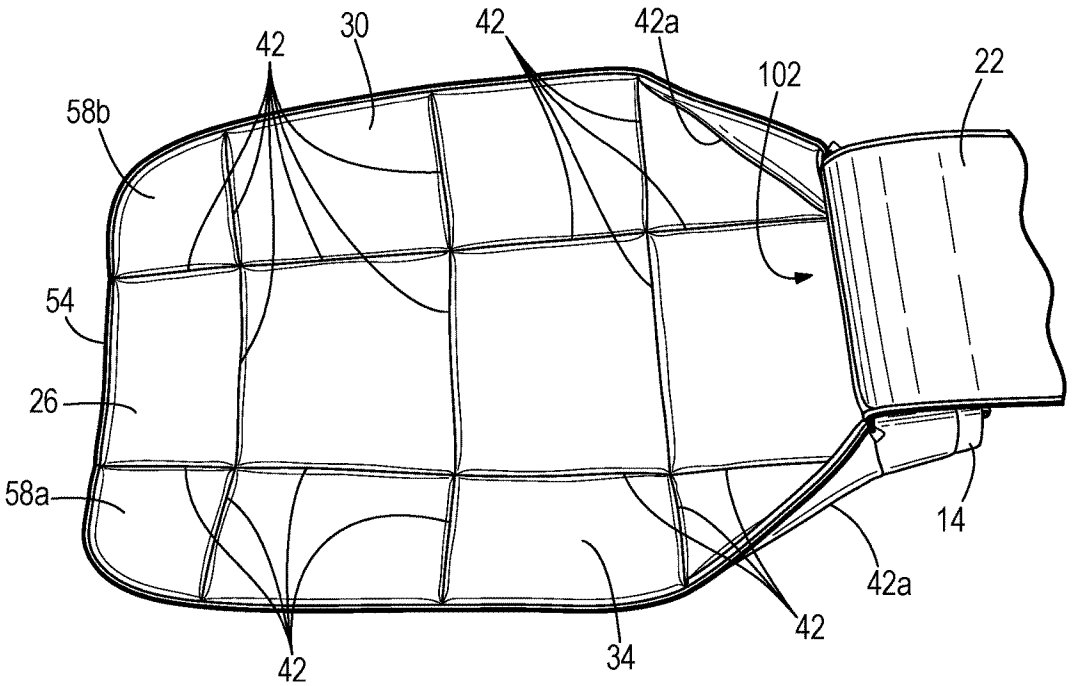
FIG. 9 is a partial view of the rolling collapsible travel luggage bag of FIG. 1 illustrating a butterfly opening providing access to the interior chamber without obstruction from a portion of a cover, and with a portion of the front flap shown.

Referring now to FIG. 9, in some embodiments, components of the luggage bag 10 also fold or bend to form a butterfly opening, or second opening access position, in order to provide greater access to the interior chamber 102. In some embodiments, with the luggage bag 10 placed with the back portion 26 positioned on a floor or other supporting surface, the connection member 98 may be opened so that the front portion 22 is no longer connected with the back, first side, and second side portions 26, 30, 34, but remains connected to the base 14 to expose the interior chamber 102. In other embodiments, the connection member 98 may be opened so that the front portion 22 is no longer connected with the back, first side, and second side portions 26, 30, 34, and the first and second side portions are no longer connected with the base 14.

In some embodiments, the first and second side portions 30, 34 remain attached to the base 14. In these embodiments, the first and second side portions 30, 34 are then free to pivot or fold away from each other along the respective folds 42 (or seams) between the side portions 30, 34 and the back portion 26. As the first and second side portions 30, 34 fold away from each other, the portions 30, 34 are each at an oblique angle to the back portion 26. The panels of the side portions 30, 34 in the second panel zone 50*b* also fold about the angled folds 42*a*.

Figure 29:
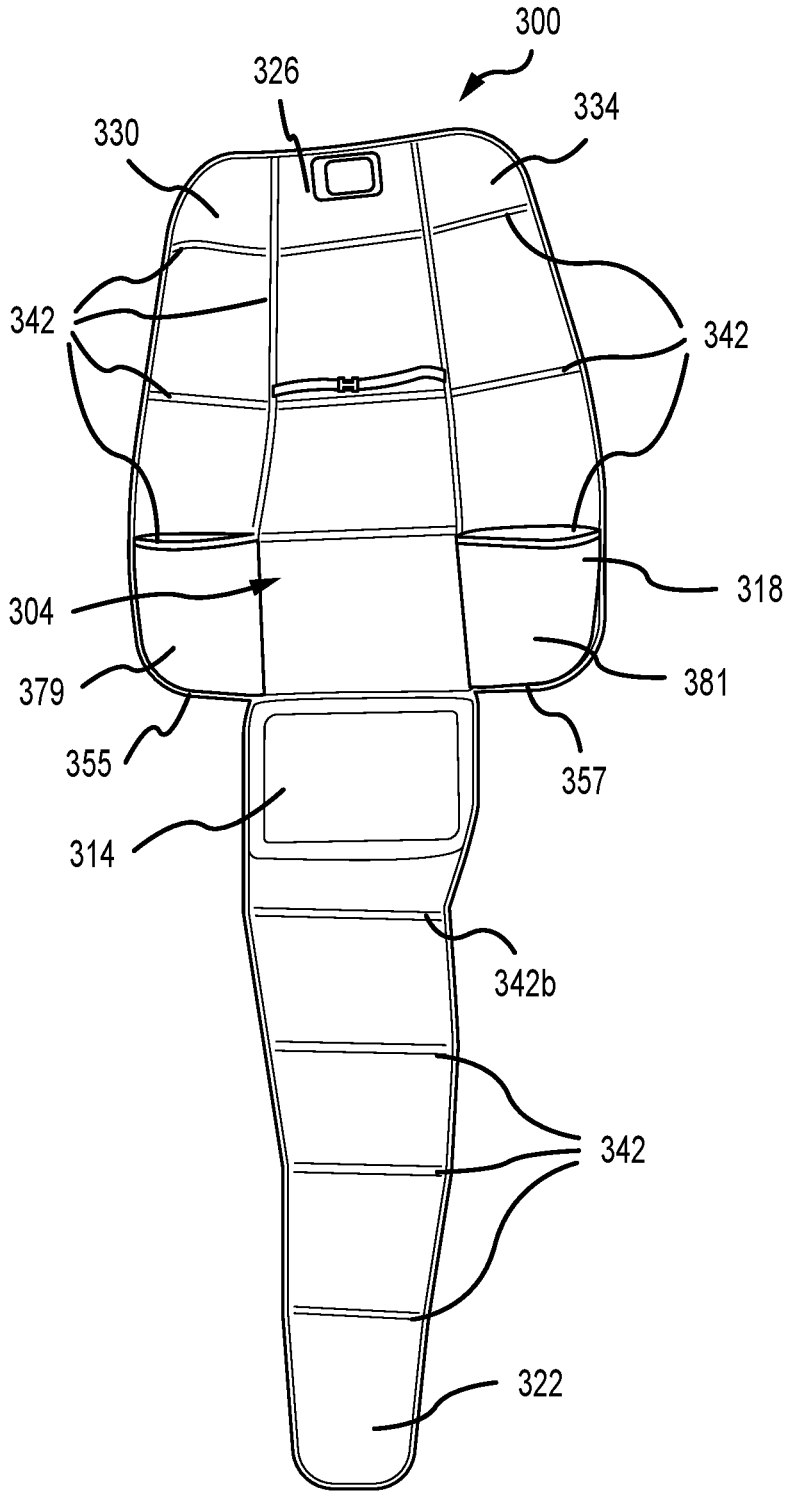
FIG. 29 is a perspective view of the collapsible travel luggage bag of FIG. 27A with the front flap disengaged to provide access to an interior chamber.

In some embodiments, the first and second side portions 330, 334 are detached from the base 14, as illustrated in FIG. 29. In these embodiments, as the first and second side portions 330, 334 fold away from each other, the portions 330, 334 can lie flat in a plane with the back portion 326. Once one or more items are placed into the interior chamber 102, the side portions 30, 34 are pivoted or folded towards each other, and the connection member 98 is reconnected (or closed), securing the front portion 22 to the back, first side, and second side portions 26, 30, 34, and optionally securing the side portion 30, 34 to the base 14, thereby closing the interior chamber 102.

This butterfly opening allows for unobstructed insertion of large or bulky items into the interior chamber 102, as not only do the side portions 30, 34 pivot or fold away from each other, with the arcuate face 66 removed there is no lip or other edge structure that would obstruct or otherwise hinder insertion of items into the interior chamber 102. In other words, when the travel luggage bag is closed or opened in the manner shown in FIG. 8, the arcuate face 66 overlaps a portion of the base 14 to enclose the interior chamber 102. By opening the arcuate face 66 away from the side portions 30, 34 and back portion 26, and then pivoting or folding the side portions 30, 34 away from each other along folds 42, the back, first side, and second side portions 26, 30, 34 thereby define a butterfly opening that provides ready access to the interior chamber 102 unobstructed by a portion of the cover 18. In other embodiments, the front portion 22 may be detachable or otherwise removable from the base 14.

Figure 14:
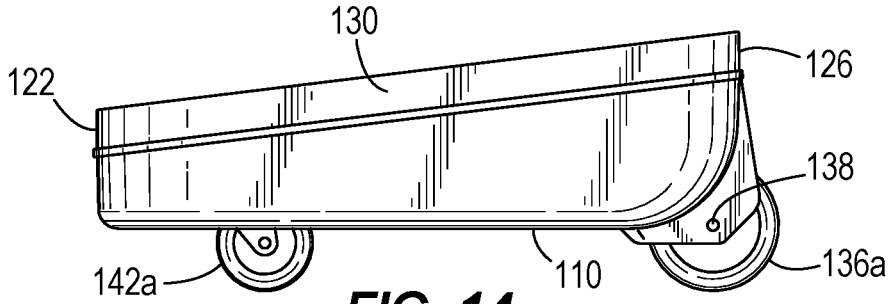
FIG. 14 is a first side view of the base taken along line 14-14 of FIG. 10.
Figure 15:
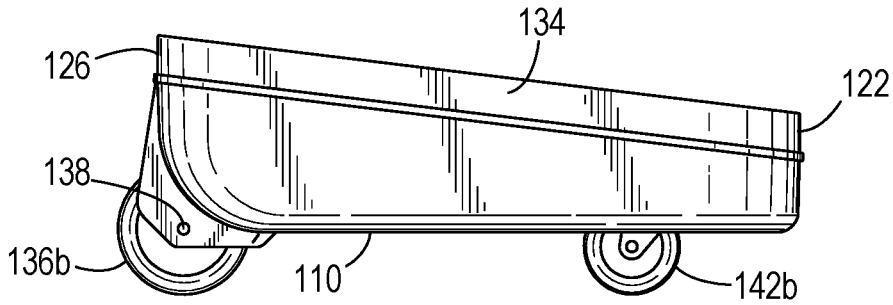
FIG. 15 is a second side view of the base taken along line 15-15 of FIG. 10.

With reference to FIGS. 10-15, the base 14 is illustrated in greater detail. The base 14 includes a bottom external surface 110 opposite an inside surface 114. The inside surface 114 is defined or surrounded by a front wall 122 opposite a back wall 126, and a first side wall 130 opposite a second side wall 134. The front wall 122 is located on the same side of the luggage bag 10 as the front portion 22, while the back wall 126 is provided on the same side of the luggage bag 10 as the back portion 26. As illustrated in FIGS. 14 and 15, the first and second side walls 130, 134 increase in height from the front wall 122 to the back wall 126, with the height being the distance of the wall away from the bottom surface 110. In other embodiments, the first and second side walls 130, 134 may have a uniform height from the front wall 122 to the back wall 126. The inside surface 114 preferably defines a planar or substantially flat receiving surface substantially free of protrusions or other structural obstructions that may interfere with receipt of items into the inside surface 114 of the base 14.

The base 14 includes a pair of wheels or skate wheels 136*a*, 136*b* provided on the back wall 126 side. The skate wheels 136*a*, 136*b* do not swivel about the base 14, and extend beyond a plane defined by the back wall 126 such that a portion of each of the wheels 136*a*, 136*b* extends outside of the base footprint defined by the bottom surface 110 and walls 122, 126, 130, 134. The wheels 136*a*, 136*b* include a common axis of rotation 138 preferably offset from the bottom surface 110 and a plane defined by the back wall 126 and are configured to act as a fulcrum about which the luggage bag 10 pivots from the upright position (see FIGS. 1 and 8) to a tilted position (see FIG. 19). The bottom surface 110 also includes a curved portion 139 between the wheels 136*a*, 136*b* (shown in FIGS. 10 and 13) defined by a radius preferably in a range of 50 mm to 70 mm, and more preferably about 60 mm. The radius of the curved portion 139 provides a ground clearance zone between the wheels 136*a*, 136*b* and the bottom surface 110.

The base 14 further includes a pair of caster wheels 142*a*, 142*b*, which swivel about the base 14. The caster wheels 142*a*, 142*b* each preferably swivel 360 degrees about the base 14 around a swivel axis to allow the luggage bag 10 to roll in a controlled manner when in the upright position.

Figure 10:
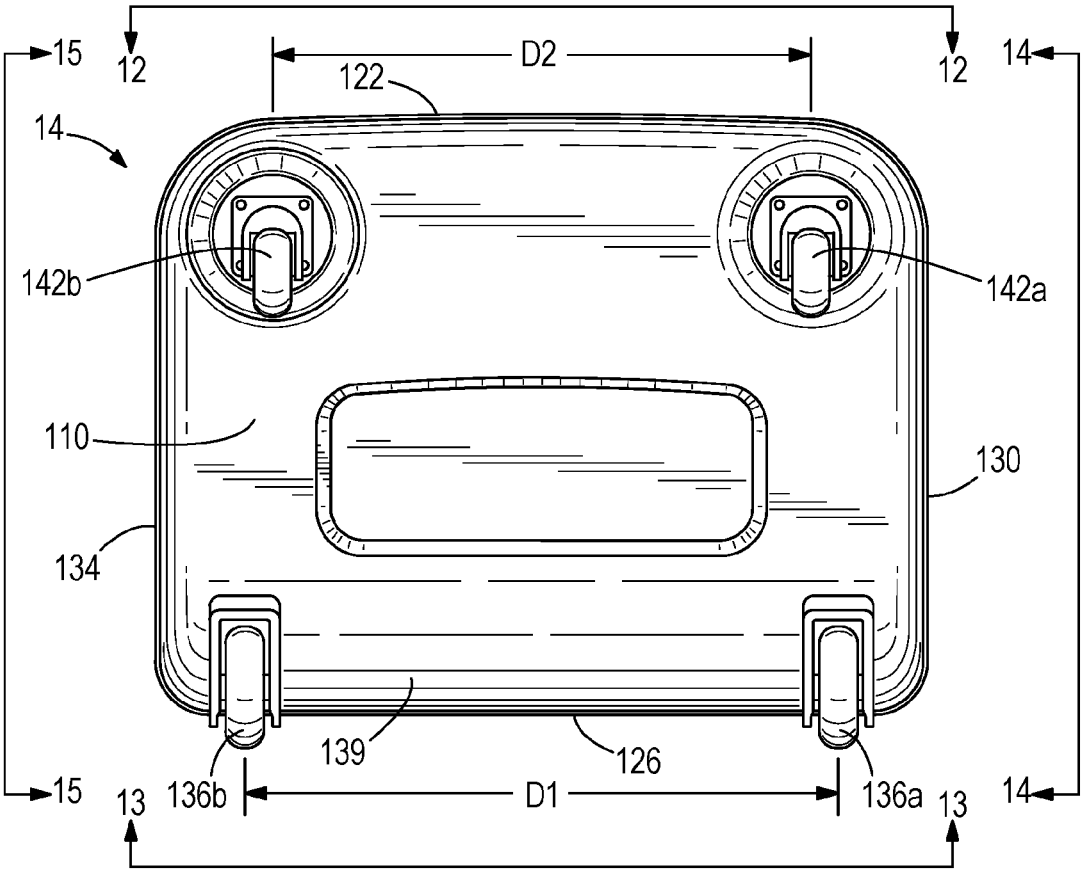
FIG. 10 is a bottom plan view of the rolling collapsible travel luggage bag of FIG. 1, illustrating an external bottom surface of the luggage bag base.
Figure 11:
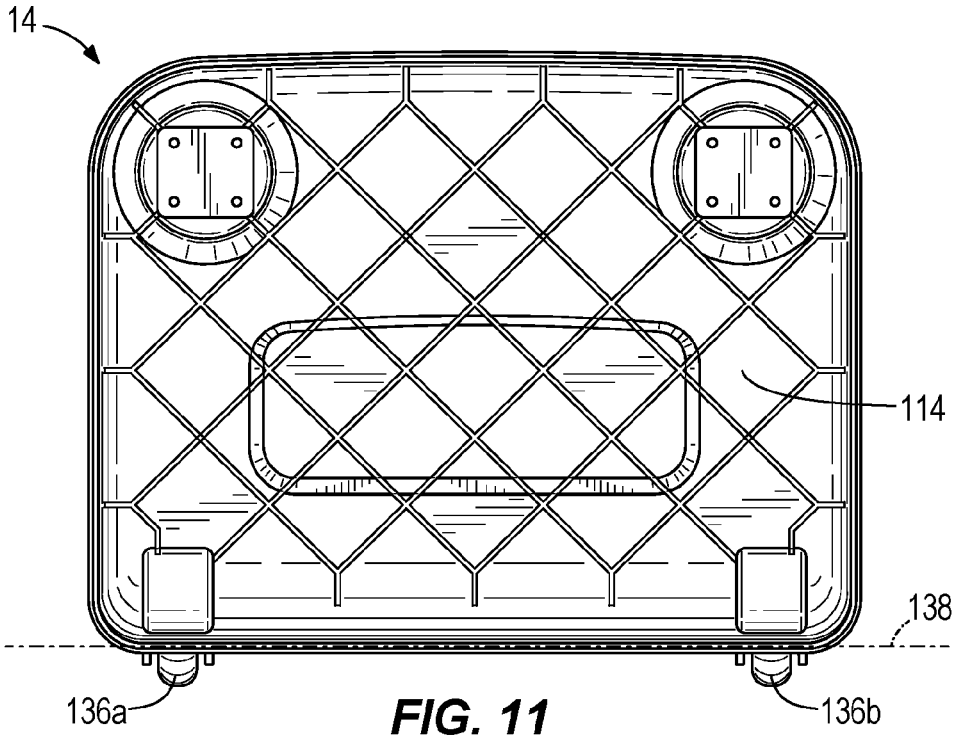
FIG. 11 is a top plan view of an internal bottom surface of the base of FIG. 10.
Figure 12:
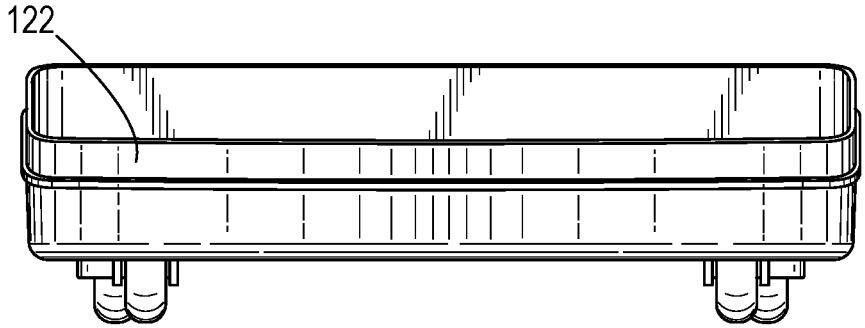
FIG. 12 is a front side view of the base taken along line 12-12 of FIG. 10.
Figure 13:
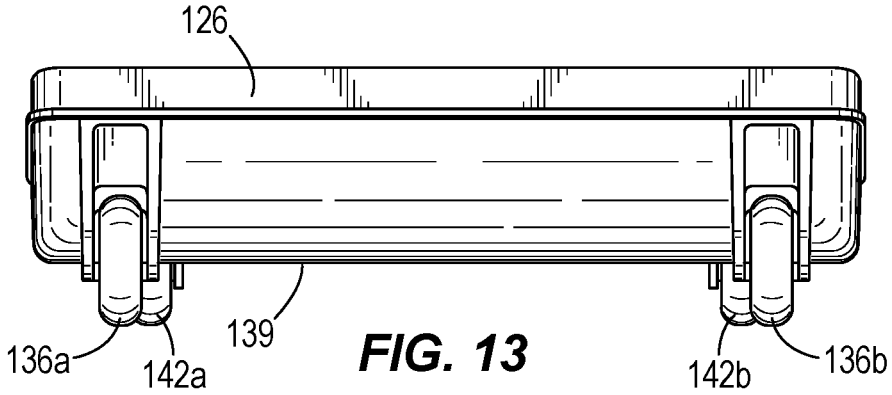
FIG. 13 is a back side view of the base taken along line 13-13 of FIG. 10.

As illustrated in FIG. 10, the wheels 136*a*, 136*b* are preferably separated by a first distance $D_1$ of approximately 330 mm between a point of rotation of each of the wheels 136*a*, 136*b* while the caster wheels 142*a*, 142*b* are preferably separated by a second distance $D_2$ of approximately 300 mm between a swivel axis of each of the wheels 142*a*, 142*b*. In other embodiments, the first and second distances $D_1$, $D_2$ can be any suitable or desired distance, with the first distance $D_1$ generally being greater than the second distance $D_2$. The wheels 136, 142 are positioned in the same plane, i.e., the wheels 136, 142 are positioned to contact a floor or other surface in the same horizontal plane. When the luggage bag 10 is in the upright position, both the non-swivel wheels 136*a*, 136*b* and the swivel wheels 142*a*, 142*b* remain in contact with the floor or other surface on which the luggage bag 10 is located. This contact by all wheels 136, 142 on the base 14 reduces the risk of unintended luggage movement while continuing to allow targeted rolling movement of the luggage bag 10. While the swivel wheels 142 permit directional movement of the luggage bag 10, the non-swivel wheels 136 act as a stop to help inhibit unintended luggage movement, for example if a person or object pushes (or applies a force) on one of the side portions 30, 34.

The luggage bag 10 is collapsible to reduce the storage footprint when not in use. The panels of the cover 18 fold along folds 42, 42*a* allowing the panels to be collapsed toward and at least partially received in the base 14. As referenced earlier, folds 42 are provided between adjacent or consecutive panels in each of the front, back, first side, and second side portions 22, 26, 30, 34. In addition, folds 42 are provided between panels of each adjacent or consecutive portion 26, 30, 34, such as between adjacent panels in a given panel zone 50. In some embodiments, the angled folds 42*a*, which are generally oblique to the base 14, also serve to facilitate collapsing luggage bag 10 toward base 14.

Figure 17:
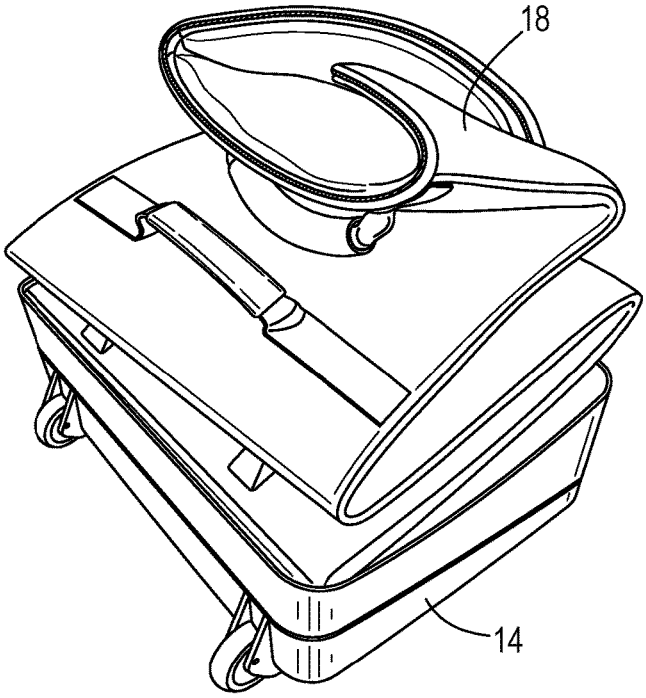
FIG. 17 is a perspective view of the rolling collapsible travel luggage bag of FIG. 1 in a partially collapsed position with a portion of the cover received by a base.

In some embodiments where the side portions 30, 34 remain attached to the base 14, to collapse the luggage bag 10, the connection member 98 is opened such that the front portion 22 is no longer secured to the back, first side, and second side portions 26, 30, 34. Referring to FIGS. 16 and 17, in these embodiments, the front portion 22 is folded or bent along the folds 42 between panels, and then received in the base 14. The side portions 30, 34 are also folded or bent along angled folds 42*a* towards the base 14. The panel between the base 14 and folds 42*a* is then received by the base 14, followed by the panel on the opposite side of folds 42*a*. With the side portions 30, 34 positioned inward (or toward each other) to contact the back portion 26, if used, the rails 182 disengage from the rail extensions 186, and the remainder of the cover 18 folds along folds 42 and is partially received in the base 14 (see FIG. 17). In other embodiments, the cover 18 may be partially, substantially, or entirely received in the base 14.

Figure 30:
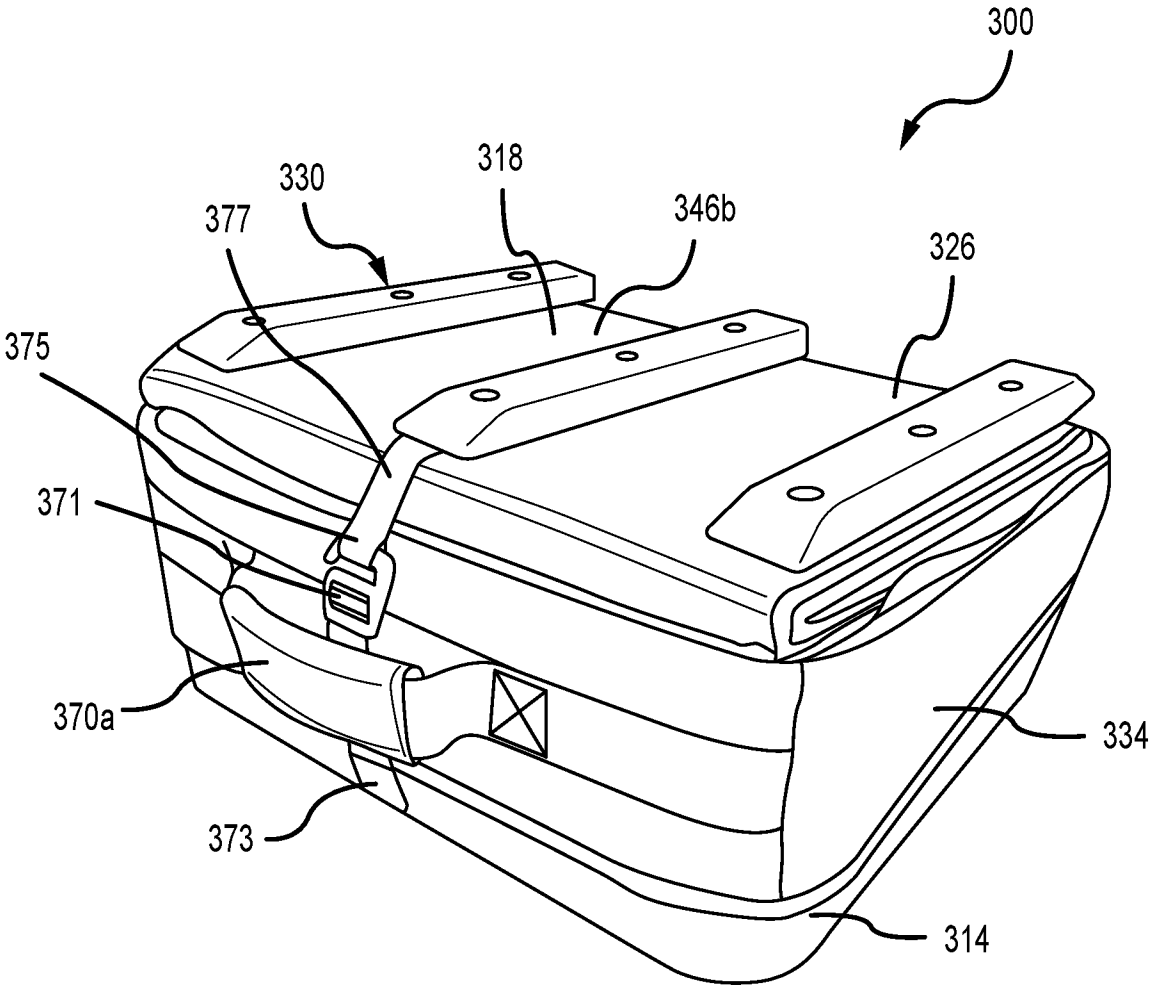
FIG. 30 is a perspective view of the travel luggage bag of FIG. 27A in a collapsed position with the cover received by a base.
Figures 31A, 31B, 31C:
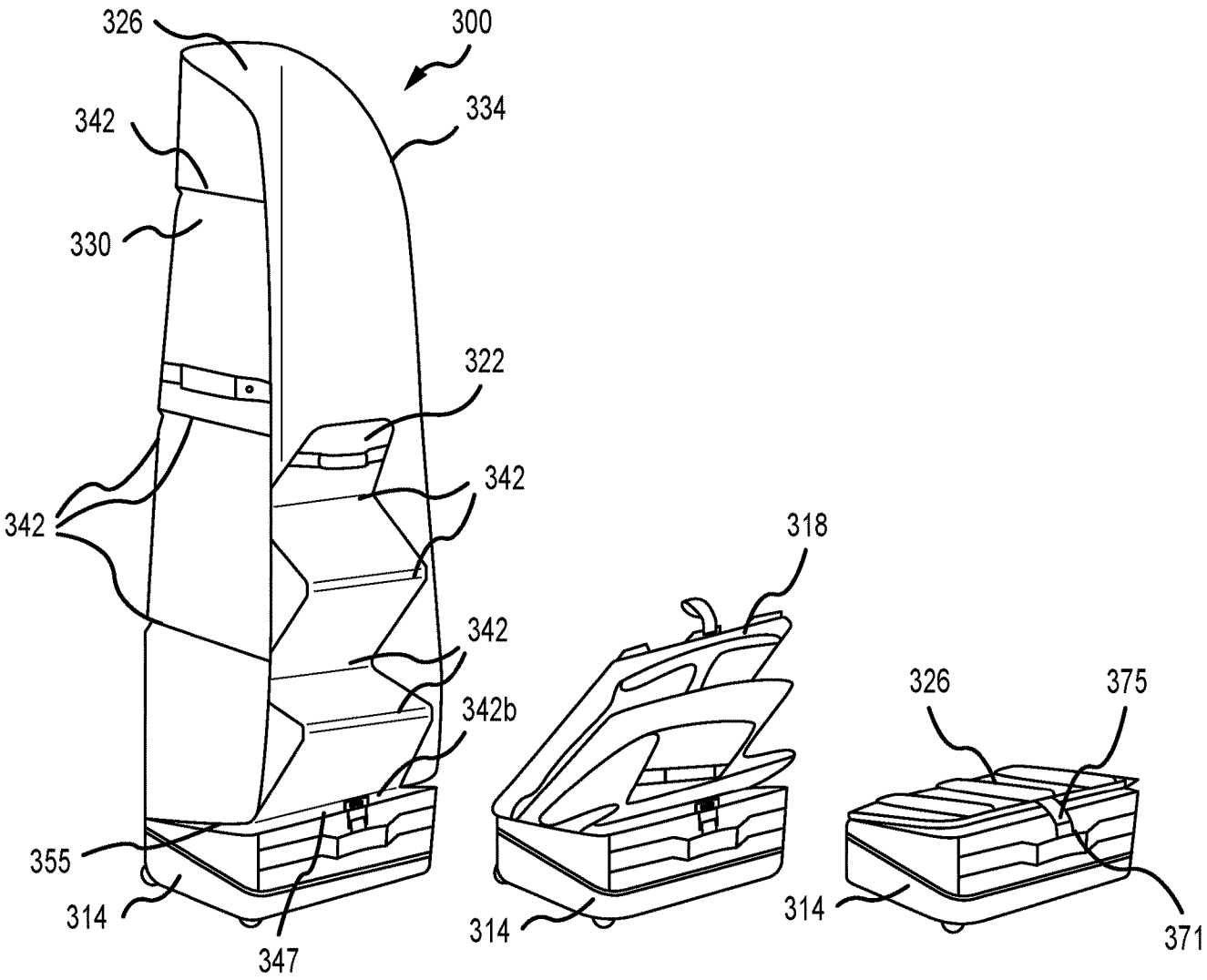
FIG. 31A is a perspective view of the travel luggage bag of FIG. 27A in the upright position with the front flap disengaged from a first side portion, a second side portion, and a back portion, and the first side portion and the second side portion disengaged from a base.
FIG. 31B is a perspective view of the travel luggage bag of FIG. 27A in a partially collapsed position with the cover partially received by a base.
FIG. 31C is a perspective view of the travel luggage bag of FIG. 27A in a collapsed position with the cover received by a base.

In other embodiments, such as the luggage bag 300, the side portions 330, 334 are detached from the base 14, as discussed in more detail below. In such an embodiment, to collapse the luggage bag 300, the connection member 98 is opened such that the front portion 322 is no longer secured to the back, first side, and second side portions 326, 330, 334, and further opened such that the side portions 330, 334 are no longer secured to the base. Referring to FIGS. 31A-31C, in these embodiments, the front portion 322 is first folded along a sub panel 342*b* and further folded along the folds 342 between panels 346, and then received in the base 314. The side portions 330, 334 are folded inwards towards the back portion 326 and then fully received by the base 314. To further secure the cover 318 into the base 314, the luggage bag 300 includes a clip 371 attached to the base 314 that is received within a loop attached to the back portion 326, as illustrated in FIG. 30.

Figure 18A:
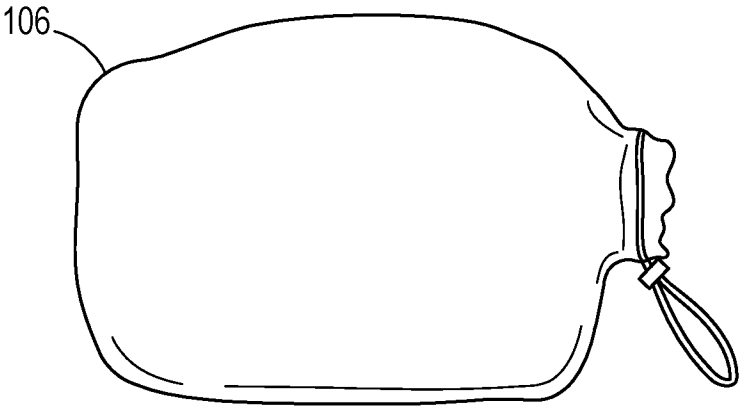
FIG. 18A is a side elevation view of a storage bag containing the luggage bag of FIG. 1 in a collapsed position
Figure 18B:
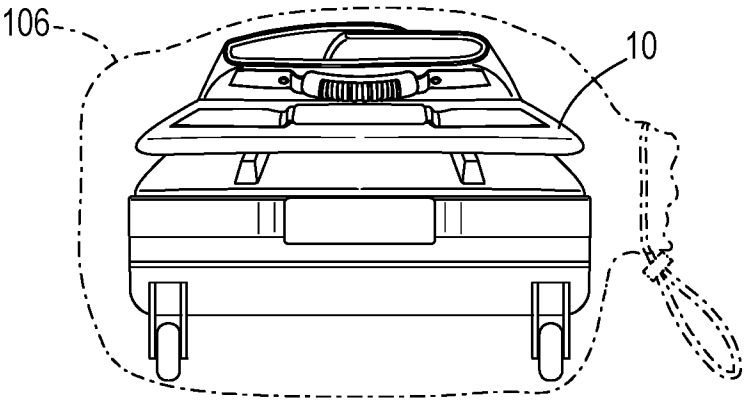
FIG. 18B is another side elevation view of the storage bag of FIG. 18A, with a portion of the storage bag shown in broken lines to illustrate the luggage bag of FIG. 1 in the collapsed position in the bag.
Figure 20:
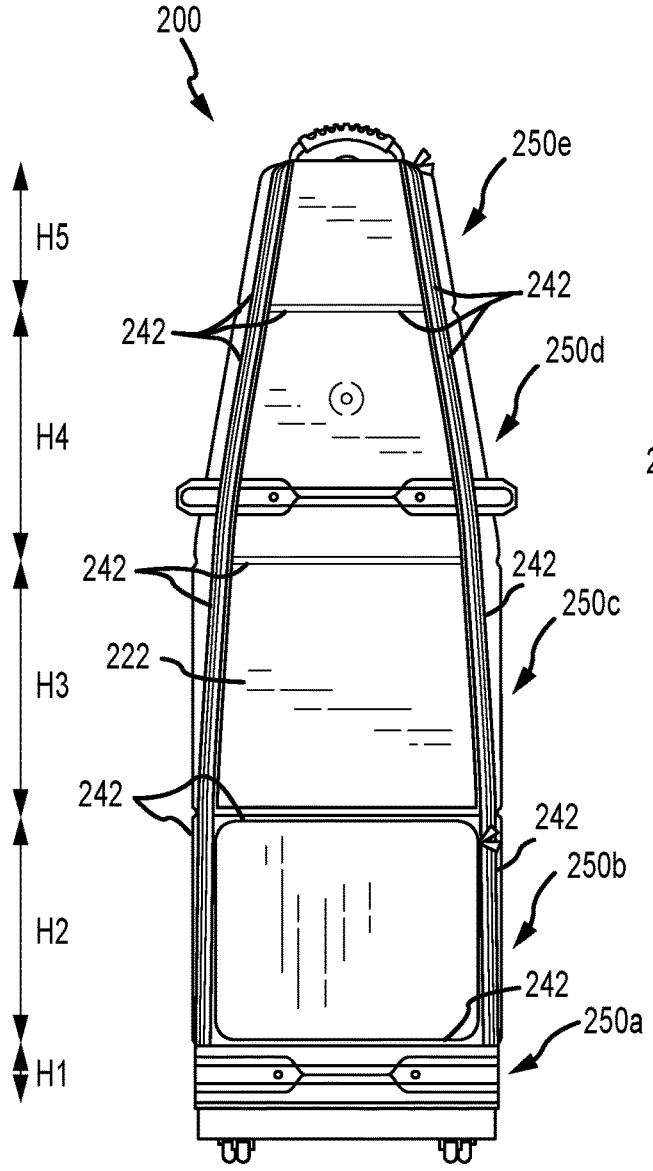
FIG. 20 is a front view of an embodiment of a collapsible travel luggage bag in an upright position.
Figure 21:
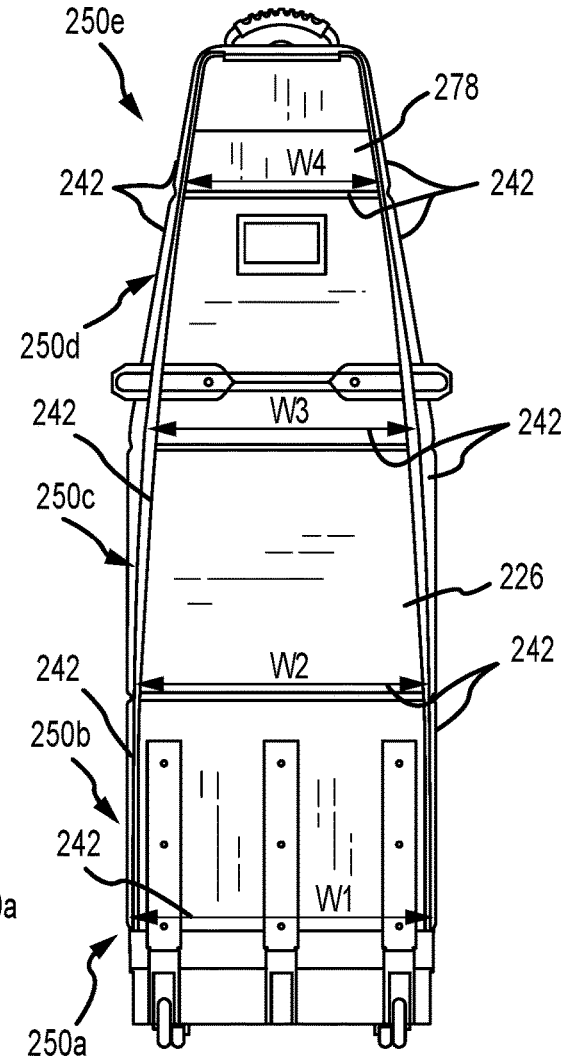
FIG. 21 is a rear view of the collapsible travel luggage bag of FIG. 20, in an upright position.

In some embodiments, in this collapsed, folded position, the luggage bag 10 itself may be received in a storage bag 106 (see FIGS. 18A-B) for storage until later use. While the cover 18 remains in the collapsed, folded position by way of the illustrated arrangement of panels and folds, the luggage bag 10 may include additional devices or assemblies to assist in retaining the luggage bag 10 in the collapsed, folded position for orderly storage. In some embodiments, the luggage bag 10 can include a simple strap or other device to maintain the cover 18 in the collapsed position and avoid an unintentional unraveling of the cover 18 from the collapsed position (for example by an unintended dropping of the collapsed, folded luggage bag 10). Such a simple strap may include a single strap or bungee-like cord that extends around a portion of the base 14 and cover 18 to assist in maintaining the cover in the collapsed, folded position.

Figure 26:
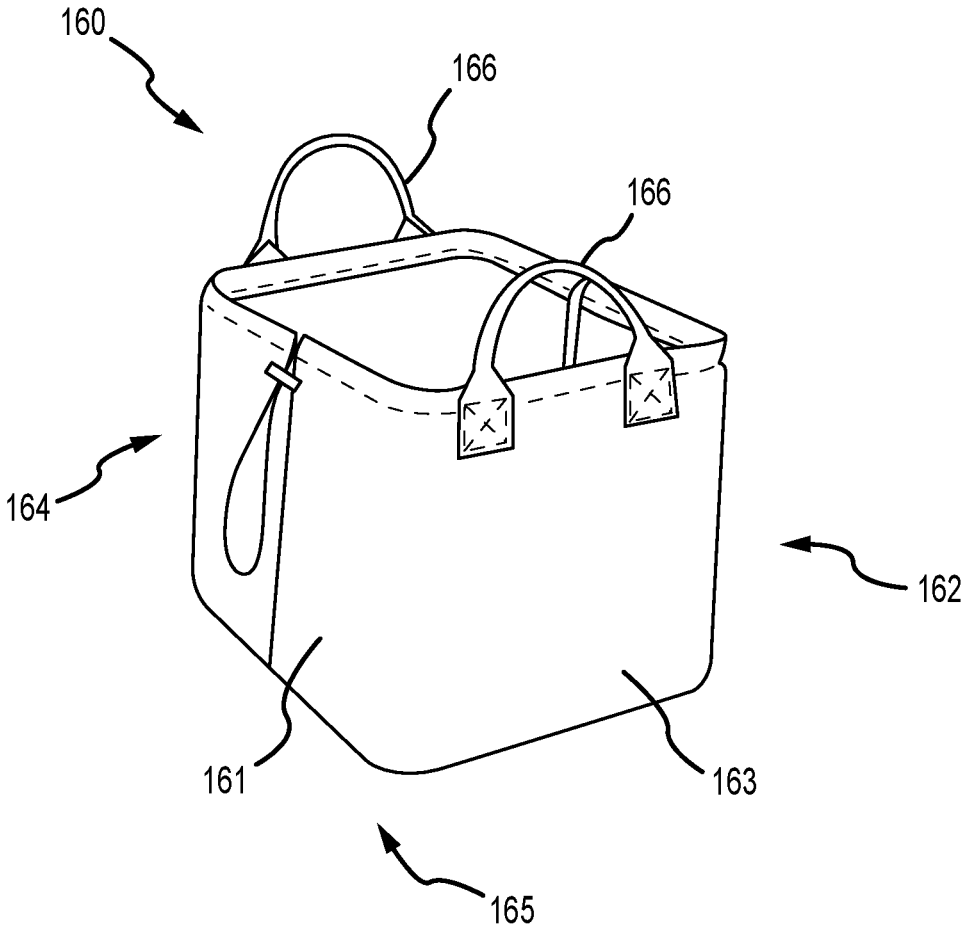
FIG. 26 is a front perspective view of an embodiment of a storage bag.

FIG. 26 illustrates another embodiment of a storage bag 160 for receiving the luggage bag 10 when the luggage bag 10 is in a collapsed or folded position. The storage bag 160 comprises a front panel 161, a back panel 162, a first side panel 163, a second side panel 164, a bottom panel 165, and two handles 166. The front panel 161, the back panel 162, the first side panel 163, the second side panel 164, and the bottom panel 165 each comprise a rectangular or approximately rectangular shape. Together, the panels form a box-like shape. The front, back, first side, and second side panels 161, 162, 163, and 164 are aligned perpendicular to the bottom panel 165. The first and second side panels 163 and 164 are aligned perpendicular to the front and back panels 161 and 162. A top of the storage bag 160 comprises a perimeter formed by edges of the front, back, first side, and second side panels 161, 162, 163, and 164.

The storage bag 160 comprises a height, measured orthogonal to the bottom panel from the bottom panel to the top perimeter of the storage bag 160. The height can range from 30 to 60 cm. In some embodiments, the height ranges from 30 to 40 cm, 35 to 45 cm, 40 to 50 cm, 45 to 55 cm, or 50 cm to 60 cm. In some embodiments, the height can be 30 cm, 31 cm, 32 cm, 33 cm, 34 cm, 35 cm, 36 cm, 37 cm, 38 cm, 39 cm, 40 cm, 41 cm, 42 cm, 43 cm, 44 cm, 45 cm, 46 cm, 47 cm, 48 cm, 49 cm, 50 cm, 51 cm, 52 cm, 53 cm, 54 cm, 55 cm, 56 cm, 57 cm, 58 cm, 59 cm, or 60 cm. The storage bag 160 comprises a width, measured parallel to an intersection between the bottom panel 165 and the front panel 161. The width can range from 35 to 55 cm. In some embodiments, the width ranges from 35 to 45 cm, 40 to 50 cm, or 45 to 55 cm. In some embodiments, the width can be 35 cm, 36 cm, 37 cm, 38 cm, 39 cm, 40 cm, 41 cm, 42 cm, 43 cm, 44 cm, 45 cm, 46 cm, 47 cm, 48 cm, 49 cm, 50 cm, 51 cm, 52 cm, 53 cm, 54 cm, or 55 cm. The storage bag 160 comprises a depth, measured parallel to an intersection between the bottom panel 165 and the first side panel 163. The depth ranges from 30 to 50 cm. In some embodiments, the depth ranges from 30 to 40 cm, 35 to 45 cm, or 40 to 50 cm. In some embodiments, the height can be 30 cm, 31 cm, 32 cm, 33 cm, 34 cm, 35 cm, 36 cm, 37 cm, 38 cm, 39 cm, 40 cm, 41 cm, 42 cm, 43 cm, 44 cm, 45 cm, 46 cm, 47 cm, 48 cm, 49 cm, or 50 cm.

The storage bag 160 can further comprise handles 166. In some embodiments, a first handle is connected to the first side panel 163, and a second handle is connected to the second side panel 164. Additionally, in some embodiments, the top perimeter of the storage bag comprises a channel for receiving and retaining a drawstring. In these embodiments, the drawstring extends through an opening in the channel adjacent the front panel 161.

Each panel 161, 162, 163, 164 and 165 of the storage bag 160 can be formed of a polyethylene board material [$(C_2H_2)_nH_2$], a foam material, a cloth material, or a combination thereof. The polyethylene board material may be any industry standard grade, including, but not limited to, ultra-high molecular weight polyethylene (UHMWPE), ultra-low molecular weight polyethylene (ULMWPE), high molecular weight polyethylene (HMWPE), high-density polyethylene (HDPE), high-density cross-linked polyethylene (HDXLPE), cross-linked polyethylene (PEX), medium-density polyethylene (MDPE), linear low-density polyethylene (LLDPE), low-density polyethylene (LDPE), very-low density polyethylene (VLDPE), and chlorinated polyethylene (CPE). In other embodiments, the panels 161, 162, 163, 164 and 165 may be formed of polyurethane, acrylonitrile butadiene styrene, combinations thereof, or any other suitable material. The composition of the storage bag 160 provides enough flexibility for the drawstring mechanism to partially collapse the storage bag 160 and hold in the collapsed luggage bag 10. However, the panels 161, 162, 163, 164 and 165 of the storage bag 106 also provide a level of rigidity that allows the luggage bag to be stored in a box-shaped container.

Figure 19:
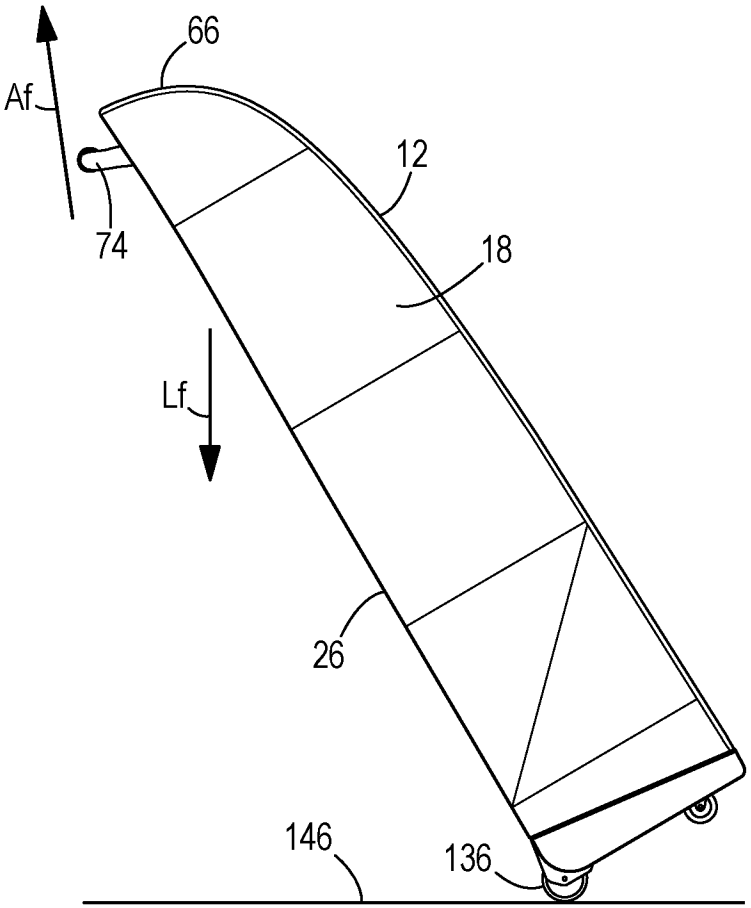
FIG. 19 is a schematic view of the rolling collapsible travel luggage bag of FIG. 1 in a tilted position, illustrating certain forces on the luggage.

Referring now to FIG. 19, in many embodiments the luggage bag 10 reduces strain on a user when in a tilted position or pivot position for rolling movement on the wheels 136. To reach the illustrated tilted position, a user pivots the luggage bag 10 about the axis of rotation 138 of wheels 136, for example with rolling handle 74. During the pivot, the front wall 122 end of the base 14 lifts away from the ground or surface 146. In addition, all swivel wheels 142 are lifted away from contact with the surface 146. The user then pulls on the handle 74, and the luggage bag 10 rolls on wheels 136. The positioning of the handle 74 on the back portion 26 advantageously reduces strain on a wrist, hand, and arm of the user pulling (or applying a pulling force to) the luggage bag 10 as the handle 74 location is further away or offset from the wheels 136 in a pulling direction, reducing the force $A_f$ applied by the user to overcome the load force $L_f$ of the luggage bag 10. In addition, a portion of the luggage bag 10 rests on the hand, wrist, and/or arm of the user as the user pulls the luggage bag 10 in the tilted position, reducing the application of luggage weight to a user's hand, wrist, and arm.

Figure 24:
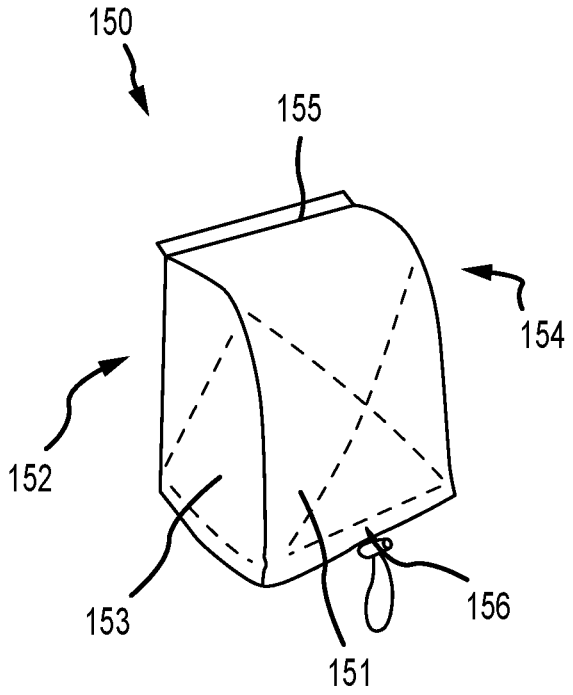
FIG. 24 is a perspective view an internal cover of a collapsible travel luggage bag.
Figure 25:
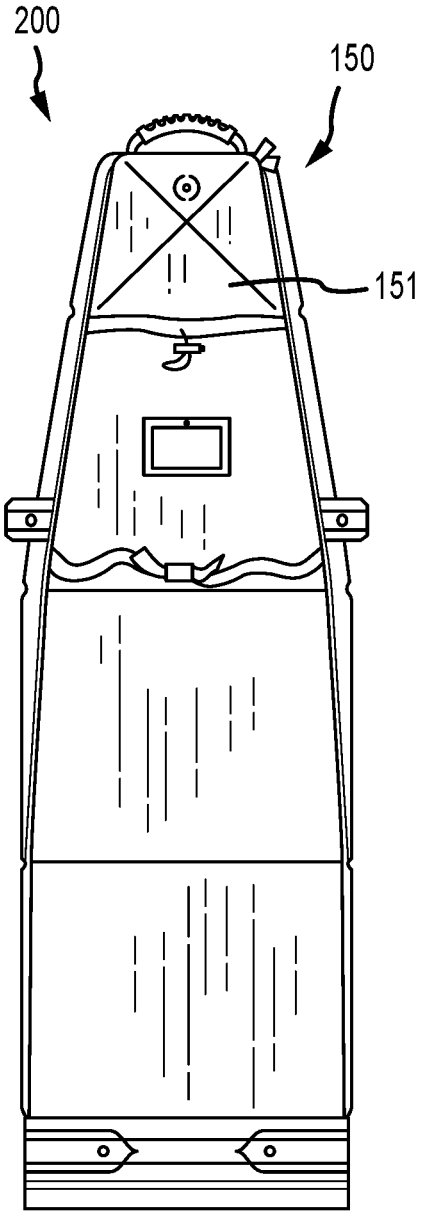
FIG. 25 is a front, x-ray view of the internal cover of FIG. 24, installed into a collapsible travel luggage bag.

Referring now to FIGS. 24 and 25, in some embodiments of the luggage bag 10, the interior chamber 102 further comprises an internal cover 150. The internal cover 150 can serve to further add protection and padding around golf club heads that are stored within the luggage bag 10. The internal cover 150 is shaped to fit within a top portion of the interior chamber 102 of the luggage bag 10. The internal cover 150 comprises a front panel 151, a first side panel 153, a second side panel 154, and a back panel 152. The front panel 151 curves to also form a top of the internal cover 150. The internal cover 150 further comprises an opening generally facing towards the base of the luggage bag 10. The internal cover 150 is attached to the luggage bag 10 only along one seam of the internal cover. The attached seam 155 is between the front panel and the rear panel, adjacent the top of the internal cover 150. The back panel 152 of the internal cover 150 can comprise a height, measured vertically, between 15 cm and 30 cm. For example, the back panel height of the internal cover can be 15 cm, 16 cm, 17 cm, 18 cm, 19 cm, 20 cm, 21 cm, 22 cm, 23 cm, 24 cm, 25 cm, 26 cm, 27 cm, 28 cm, 29 cm, or 30 cm. In the illustrated embodiment, the height of the back panel 152 is approximately 22 cm. The first and second side panels 153, 154 can each comprise a depth, measured parallel to the ground plane and roughly orthogonal to the back panel 152. The first side panel depth equals the second side panel depth. The depth of the side panels 153, 154 can range between 10 cm and 25 cm. For example, the depth of the side panels 153, 154 can be 10 cm, 11 cm, 12 cm, 13 cm, 14 cm, 15 cm, 16 cm, 17 cm, 18 cm, 19 cm, 20 cm, 21 cm, 22 cm, 23 cm, 24 cm, or 25 cm. In the illustrated embodiment, the depth of the side panels 153, 154 is approximately 16 cm. The front and back panels 151, 152 can each comprise a width, measured parallel to the ground plane and roughly orthogonal to the side panels 153, 154. In most embodiments, the front and back panel widths are the same. The front and back panel widths can range between 15 cm and 30 cm. For example, the front and back panel widths can be 15 cm, 16 cm, 17 cm, 18 cm, 19 cm, 20 cm, 21 cm, 22 cm, 23 cm, 24 cm, 25 cm, 26 cm, 27 cm, 28 cm, 29 cm, or 30 cm. In the illustrated embodiment, the front and back panel width is approximately 22 cm.

To prevent rattling and shifting of the golf club heads, the opening of the internal cover 150 comprises a perimeter draw string mechanism 156. The draw string mechanism 156 can comprise a string, a cord, a rope, a cord lock, a hem, a casing, loops, or other draw string mechanism elements known in the art. The perimeter draw string mechanism 156 secures the internal cover 150 around the golf club heads. In some embodiments, the internal cover 150 comprises fabric, foam, mesh, or other suitable padding material. In many embodiments, the internal cover 150 can comprise a thickness ranging between 0.05 cm and 2.0 cm, or between 0.5 and 1.5 cm. For example, the internal cover 150 can comprise a 1 cm thick open cell foam. In some embodiments, stitching is sewn across portions of the panels 151, 152, 153, and 154.

I. First Exemplary Embodiment

FIGS. 20-23 illustrate a first exemplary embodiment of the rolling collapsible luggage bag described herein. The example luggage bag 200 is similar to the luggage bag 10. In this embodiment, a first panel zone 250*a*, a second panel zone 250*b*, and a third panel zone 250*c* each comprise shapes relatively similar to the first panel zone 50*a*, second panel zone 50*b*, and third panel zone 50*c*, respectively, of the luggage bag 10. However, the fourth 250*d* and fifth panel 250*e* zones of the luggage bag 200 comprise a slightly different shape than the fourth panel zone 50*d* and fifth panel zone 50*e* of the luggage bag 10. From a front or rear view, illustrated in FIGS. 20 and 21, the fourth 250*d* and fifth panel 250*e* zones both comprise trapezoidal shapes that taper more sharply than in the first described embodiment. In other words, a fourth width $W_4$ of luggage bag 200 is less than the fourth width $W_4$ of luggage bag 10.

Figure 22:
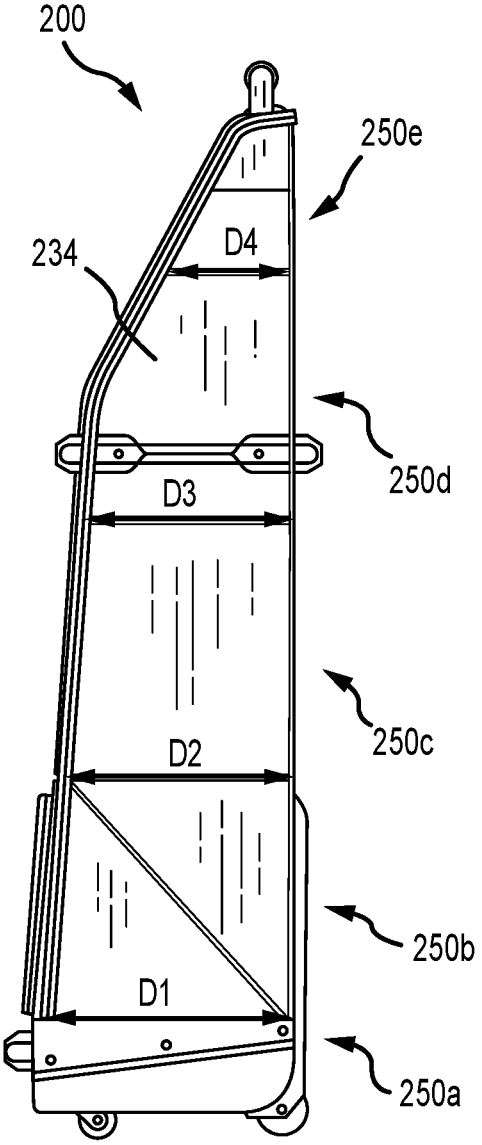
FIG. 22 is a first (right) side view of the collapsible travel luggage bag of FIG. 20, in an upright position.
Figure 23:
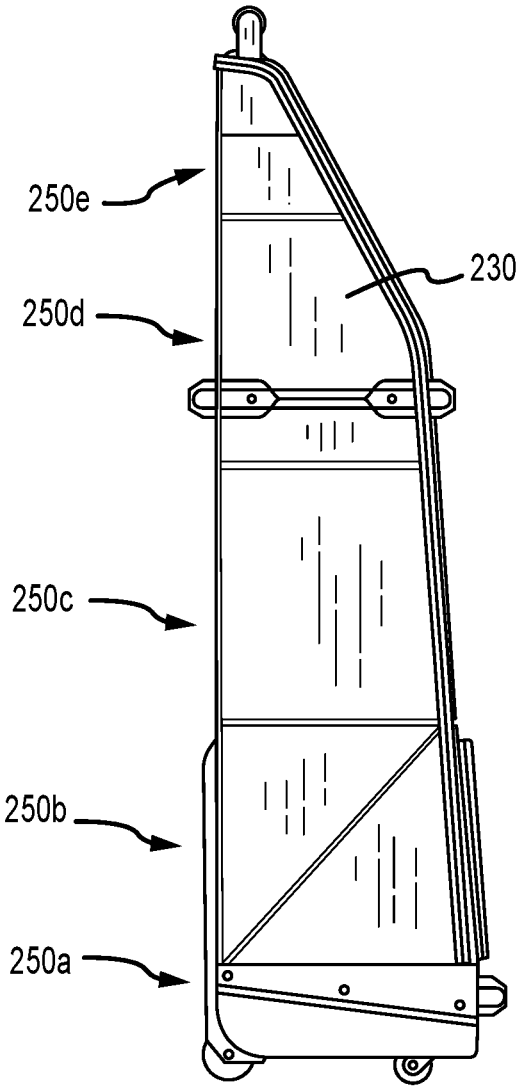
FIG. 23 is a second (right) side view of the collapsible travel luggage bag of FIG. 20, in an upright position.

In the illustrated embodiment, the height of the first panel zone 250*a* is approximately 6 cm, the height of the second panel zone 250*b* is 31.5 cm, the height of the third panel zone 250*c* is approximately 31.5, the height of the fourth panel zone 250*d* is approximately 31.5 cm, and the height of the fifth panel zone 250*e* is approximately 21.5 cm, when the heights are measured along a back portion 226. Additionally, from a side view, as illustrated in FIGS. 22 and 23, the fourth panel zone 250*d* can comprise a side edge with an angle change roughly halfway up the height of the panel. A top of the side edge of the leads into the fifth panel zone, which has a roughly straight angled edge instead of an arcuate edge. The edge of the fifth panel zone also comprises a change in angle in order to provide a small flat top portion that engages a handle.

II. Second Exemplary Embodiment

FIGS. 27A-33 illustrate another exemplary embodiment of the rolling collapsible luggage bag described herein. The luggage bag 300 includes a cover 318 that lies flat in the opened configuration to provide full access to the interior chamber 304. The luggage bag 300 can provide maximum access to the interior chamber 304 without compromising the ability to fully collapse. The luggage bag 300 is similar to the luggage bag 10 such that the luggage bag 300 includes a front flap 322, which is fully detachable from the back, first side, and second side portion 326, 330, 334. However, the first and second side portions 330, 334 are configured to fully detach from the base 314 to form a flat surface for a user to insert items into the luggage bag 300. Therefore, the luggage bag 300 provides the maximum amount of access to the interior chamber 304. The detachability of the side portions 330, 334 provides further benefits to the luggage bag 300 such as improved collapsibility and storage, as discussed in more detail below.

Referring to FIG. 27A, the front flap 322 is integrally formed with the base 314 and selectively removable from the back, first side, and second side portions 326, 330, 334 to provide access to the interior chamber 304. Further, the back portion 326 is integrally formed with the base, first side, and second side portions 314, 330, 334, similar to the luggage bag 10. The luggage bag 300 differs from the luggage bag 10 in that the first side portion 330 and the second side portion 334 are selectively removable from the base 314. When lying flat in the open configuration, the back, first side, and second side portions 326, 330, 334 form a flat surface that provides full access to the interior chamber 304, as illustrated in FIG. 29. In many previous designs, the back and side portions were not fully removable from the base, and therefore, did not provide maximum access to the interior chamber.

The luggage bag 300 comprises a plurality of panels 346 arranged into a plurality of panel zones 350. The construction and composition of the panels 346 of the luggage bag 300 are similar to the panels 46 of the luggage bag 10. The panels 346 of the luggage bag 300 each define a front height near the front portion 322, and a side height near the first and second side portions 330, 334. The height of the panels 346 within each zone 350 can be similar, or the height can vary. The main difference in the exemplary luggage bag 300 is the arrangement of the panels 346 within the panel zones 350. For example, in some panel zones 350, the panels 346 are stacked such that the panels 346 within the front portion, the back portion, and the first side, and second side portions 322, 326, 330, 334 are offset from one another, as illustrated in FIG. 27A. The offset of the panels allows the cover 318 to fully collapse into the base 314.

Figure 28A:
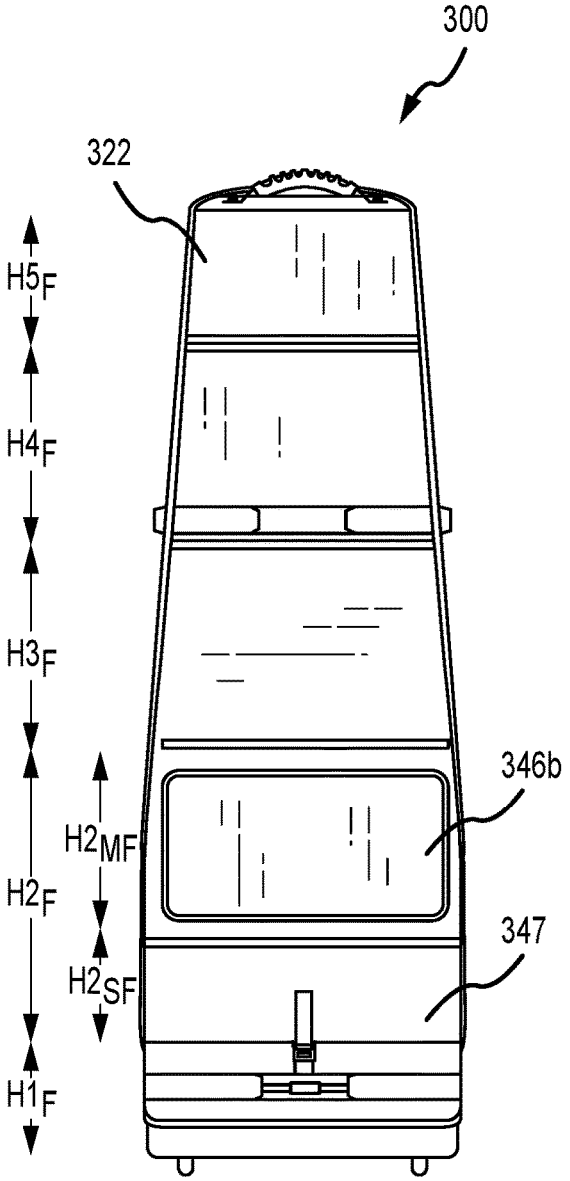
FIG. 28A is a front view of the collapsible travel luggage bag of FIG. 27A, in an upright position.
Figure 28B:
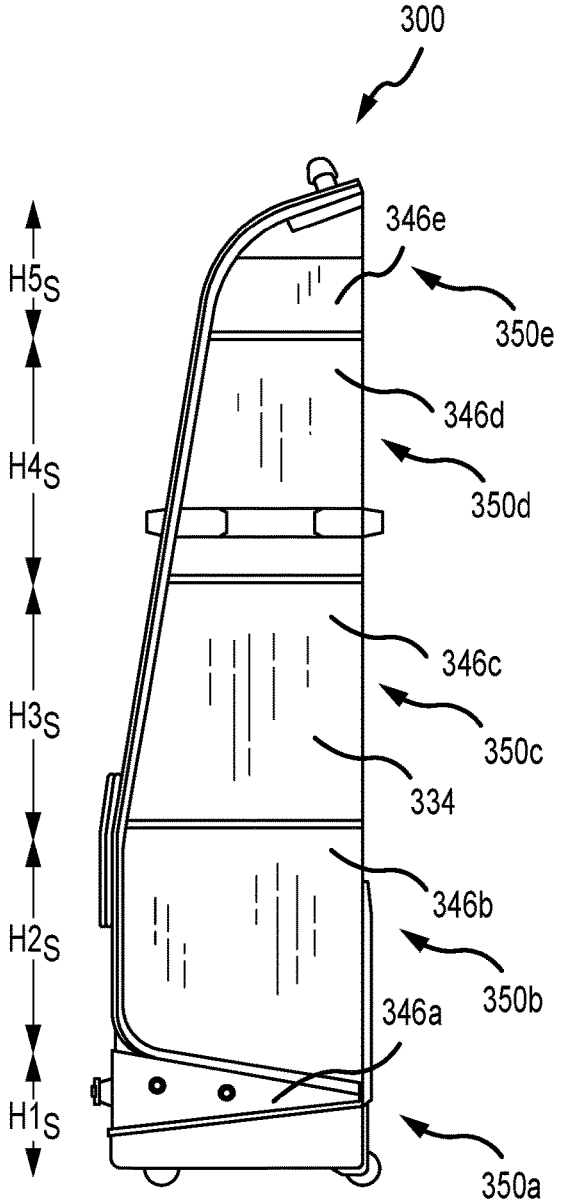
FIG. 28B is a side view of the collapsible travel luggage bag of FIG. 27A, in an upright position.

Referring to FIGS. 28A and 28B, the panels 346*a* within the first panel zone 350*a* have a first front panel height $H_{1F}$ of approximately 11 cm, but as discussed above, the first panel height $H_1$ can vary depending on the size, shape, and/or orientation of the luggage bag 300. The panels 346*a* within the first panel zone 350*a* further have a first side panel height His that decreases from the front to the rear such that the panels 346*a* are taller near the front flap 322 and shorter near the back portion 326 to conform to the sloping height of the base 314, as discussed in more detail below. The first side panel height $H_{S1}$ can be approximately 5.0 cm, 5.5 cm, 6.0 cm, 6.5 cm, 7.0 cm, 7.5 cm, 8.0 cm, 8.5 cm, 9.0 cm, 9.5 cm, 10.0 cm, 10.5 cm, 11.0 cm, 11.5 cm, 12 cm, 12.5 cm, 13.0 cm, 13.5 cm, 14.0 cm, 14.5 cm, or 15.0 cm. In some embodiments, the first side panel height $H_{S1}$ can be less than 6.5 cm, 6.4 cm, 6.3 cm, 6.2 cm, 6.1 cm, or 6.0 cm based on the size, shape, or orientation of the luggage bag 10. In other embodiments, the first side panel height $H_{S1}$ can be greater than 6.5 cm, 6.6 cm, 6.7 cm, 6.8 cm, 6.9 cm, or 7.0 cm based on the size, shape, or orientation of the luggage bag 10. In some embodiments, the first side panel height His tapers from between approximately 11 cm near the front flap 322 to approximately 2 cm near the back portion 326. The taper in the panels 346*a* from near the front flap 322 to near the back portion 326 creates triangular shaped panels near the first and second side portions 330, 334.

As discussed above, the luggage bag 300 utilizes a different collapsibility mechanism than the luggage bag 10. The main difference is in the configuration of the panels 346*b* within the second panel zone 350*b*. Referring to FIG. 28A, the panel 346*b* within the second panel zone 350*b* of the front flap 322 (the "main front panel 346*b*) comprises a sub panel 347. The sub panel 347 is located closer to the first panel zone 350*a* than the main front panel 346*b*. A sub fold 342*b* defines a boundary between the sub panel 347 and the main front panel 346*b*. To collapse the luggage bag 300, the front portion is first folded along the sub fold 342*b* such that the sub panel 347 is first received within the base 314.

Referring to FIG. 28A, the main front panel 346*b* defines a second main panel height $H_{2MF}$ of approximately 25 cm. In some embodiments, the second main panel height $H_{2MF}$ can be 20 cm, 21 cm, 22 cm, 23 cm, 24 cm, 25 cm, 26 cm, 27 cm, 28 cm, 29 cm, 30 cm, 31 cm, 32 cm, 33 cm, 34 cm, 35 cm, 36 cm, 37 cm, 38 cm, 39 cm, or 40 cm. In some embodiments, the second main panel height $H_{2MF}$ can be less than 30 cm, 29 cm, 28 cm, 27 cm, 26 cm, or 25 cm based on the size, shape, or orientation of the luggage bag 10. In other embodiments, the second main panel height $H_{2MF}$ can be greater than 20 cm, 21 cm, 22 cm, 23 cm, 24 cm, or 25 cm based on the size, shape, or orientation of the luggage bag 10. The sub panel 347 defines a sub panel height $H_{2SF}$ of approximately 12 cm. In some embodiments, the sub panel height $H_{2SF}$ can be approximately 5.0 cm, 5.5 cm, 6.0 cm, 6.5 cm, 7.0 cm, 7.5 cm, 8.0 cm, 8.5 cm, 9.0 cm, 9.5 cm, 10.0 cm, 10.5 cm, 11.0 cm, 11.5 cm, 12 cm, 12.5 cm, 13.0 cm, 13.5 cm, 14.0 cm, 14.5 cm, or 15.0 cm. In some embodiments, the sub panel height $H_{2SF}$ can be less than 6.5 cm, 6.4 cm, 6.3 cm, 6.2 cm, 6.1 cm, or 6.0 cm based on the size, shape, or orientation of the luggage bag 10. In other embodiments, the sub panel height $H_{2SF}$ can be greater than 6.5 cm, 6.6 cm, 6.7 cm, 6.8 cm, 6.9 cm, or 7.0 cm based on the size, shape, or orientation of the luggage bag 10.

Referring again to FIG. 28A, the main front panel 346*b* within the second panel zone 350*b* and the sub panel 347 define a combined second front panel height $H_{2F}$ of approximately 40 cm. In some embodiments, the second front panel height $H_{2F}$ can be less than 50 cm. In some embodiments, the second front panel height $H_{2F}$ can be 20 cm, 21 cm, 22 cm, 23 cm, 24 cm, 25 cm, 26 cm, 27 cm, 28 cm, 29 cm, 30 cm, 31 cm, 32 cm, 33 cm, 34 cm, 35 cm, 36 cm, 37 cm, 38 cm, 39 cm, 40 cm, 41 cm, 42 cm, 43 cm, 44 cm, 45 cm, 46 cm, 47 cm, 48 cm, 49 cm, or 50 cm. In some embodiments, the second front panel height $H_{2F}$ can be less than 30 cm, 29 cm, 28 cm, 27 cm, 26 cm, or 25 cm based on the size, shape, or orientation of the luggage bag 10. In other embodiments, the second front panel height $H_{2F}$ can be greater than 30 cm, 31 cm, 32 cm, 33 cm, 34 cm, or 35 cm based on the size, shape, or orientation of the luggage bag 10.

The sub panel height $H_{2SF}$ is approximately the same as the height of the base 314, thereby allowing the sub panel 347 to fold into the base 314 and rest against a front wall of the base, as illustrated in FIG. 31A. The sub panel 347 raises the height of the main front panel 346*b*, such that the main front panel 346*b* is located at an offset from the panels 346*b* near the first and second side portions 330, 334, as illustrated in FIG. 27A.

In addition to the sub panel 347, the panels 346*b* within the first and second side portions 330, 334 further differ from those of the luggage bag 10. Specifically, the panels 346*b* do not include an angled fold as in the previous embodiments (see FIG. 6). Instead, the panels 346*b* near the first and second side portions 330, 334 each comprise a single panel. The single panel can prevent buckling within the second panel zone 350*b*, thereby preventing wear within the panels 346*b* at the intersection between the base 314 and the cover 318. Wearing occurred in a similar area of the panels in a previous design, where the side panels were not fully removable from the base. In other embodiments, the angled fold can help facilitate the collapsibility of the cover. The luggage bag 300, however, utilizes a different collapsibility mechanism, as discussed in more detail below.

Referring to FIG. 28B, the panels 346*b* within the second panel zone 350*b* further have a second side panel height $H_{2S}$ that increases from the front to the rear such that the panels 346*b* are taller near the back portion 326 and shorter near the front flap 322. In some embodiments, the second side panel height $H_{2S}$ can be less than 50 cm. In some embodiments, the second side panel height $H_{2S}$ can be 20 cm, 21 cm, 22 cm, 23 cm, 24 cm, 25 cm, 26 cm, 27 cm, 28 cm, 29 cm, 30 cm, 31 cm, 32 cm, 33 cm, 34 cm, 35 cm, 36 cm, 37 cm, 38 cm, 39 cm, 40 cm, 41 cm, 42 cm, 43 cm, 44 cm, 45 cm, 46 cm, 47 cm, 48 cm, 49 cm, or 50 cm. In some embodiments, the second side panel height $H_{2S}$ can be less than 30 cm, 29 cm, 28 cm, 27 cm, 26 cm, or 25 cm based on the size, shape, or orientation of the luggage bag 10. In other embodiments, the second side panel height $H_{2S}$ can be greater than 30 cm, 31 cm, 32 cm, 33 cm, 34 cm, or 35 cm based on the size, shape, or orientation of the luggage bag 10. In one exemplary embodiment, the second side panel height $H_{2S}$ increases from approximately 30 cm near the front flap 322 to approximately 36.5 cm near the back portion 326.

The taper of the panels 346*b* within the second panel zone 350*b* follows the contour of the first panel zone panel 350*a* near the first and second side portions 330, 334. Referring to FIG. 27A, the height increase in the panels 346*b* of the second panel zone 350*b* creates trapezoidal panels near the first and second side portions 330, 334.

As discussed above, the luggage bag 300 comprises a first panel zone 350*a* and a second panel zone 350*b* that differ from the first panel zone 50*a* and a second panel zone 50*b* of the luggage bag 10. The luggage bag 300 further comprises a third panel zone 350*c*, a fourth panel zone 350*d*, and a fifth panel zone 350*e* each comprise shapes relatively similar to the first panel zone 50*a*, second panel zone 50*b*, and third panel zone 50*c*, respectively, of the luggage bag 10.

Referring to FIGS. 28A and 28B, the panels 346*c* within the third panel zone 350*c* have a third front panel height $H_{3F}$ of approximately 25 cm. In some embodiments, the third front panel height $H_{3F}$ can be 20 cm, 21 cm, 22 cm, 23 cm, 24 cm, 25 cm, 26 cm, 27 cm, 28 cm, 29 cm, 30 cm, 31 cm, 32 cm, 33 cm, 34 cm, 35 cm, 36 cm, 37 cm, 38 cm, 39 cm, or 40 cm. In some embodiments, the third front panel height $H_{3F}$ can be less than 30 cm, 29 cm, 28 cm, 27 cm, 26 cm, or 25 cm based on the size, shape, or orientation of the luggage bag 10. In other embodiments, the third front panel height $H_{3F}$ can be greater than 20 cm, 21 cm, 22 cm, 23 cm, 24 cm, or 25 cm based on the size, shape, or orientation of the luggage bag 10. The panels 346*c* within the third panel zone 350*c* further have a third side panel height $H_{3S}$ of approximately 33.5 cm. In some embodiments, the third side panel height $H_{3S}$ can be 20 cm, 21 cm, 22 cm, 23 cm, 24 cm, 25 cm, 26 cm, 27 cm, 28 cm, 29 cm, 30 cm, 31 cm, 32 cm, 33 cm, 34 cm, 35 cm, 36 cm, 37 cm, 38 cm, 39 cm, or 40 cm. In some embodiments, the third side panel height $H_{3S}$ can be less than 40 cm, 39 cm, 38 cm, 37 cm, 36 cm, or 35 cm based on the size, shape, or orientation of the luggage bag 10. In other embodiments, the third side panel height $H_{3S}$ can be greater than 30 cm, 31 cm, 32 cm, 33 cm, 34 cm, or 35 cm based on the size, shape, or orientation of the luggage bag 10. Similar to the panels 346*b* of the second panel zone 350*b*, the panel 346*c* near the front flap 322 is located at an offset from the panels 346*c* near the first and second side portions 330, 334, as illustrated in FIG. 27A. The heights $H_{3F}$, $H_{3S}$ remain substantially constant such that the panels 346*c* are rectangular.

Referring to FIGS. 28A and 28B, the panels 346*d* within the fourth panel zone 350*d* have a fourth front panel height $H_{4F}$ of approximately 25 cm. The panels 346*d* within the fourth panel zone 350*d* further have a fourth side panel height $H_{4S}$ of approximately 33.5 cm. Similar to the panels 346*b* of the second panel zone 350*b*, the panel 346*d* near the front flap 322 is located at an offset from the panels 346*d* near the first and second side portions 330, 334, as illustrated in FIG. 27A. The heights $H_{4F}$, $H_{4S}$ remain substantially constant such that the panels 346*d* are rectangular.

Referring to FIGS. 28A and 28B, the panels 346*e* within the fifth panel zone 350*e* have a fifth front panel height $H_{5F}$ and a fifth side panel height $H_{5S}$ of approximately 20 cm. In some embodiments, the fifth front panel height $H_{5F}$ can be 10 cm, 11 cm, 12 cm, 13 cm, 14 cm, 15 cm, 16 cm, 17 cm, 18 cm, 19 cm, 20 cm, 21 cm, 22 cm, 23 cm, 24 cm, 25 cm, 26 cm, 27 cm, 28 cm, 29 cm, or 30 cm. In some embodiments, the fifth front panel height $H_{5F}$ can be less than 30 cm, 29 cm, 28 cm, 27 cm, 26 cm, or 25 cm based on the size, shape, or orientation of the luggage bag 10. In other embodiments, the fifth front panel height $H_{5F}$ can be greater than 20 cm, 21 cm, 22 cm, 23 cm, 24 cm, or 25 cm based on the size, shape, or orientation of the luggage bag 10. The panels 346*e* within the fifth panel zone 350*e* are substantially similar to the panels 46*e* within the fifth panel zone 50*e* of the luggage bag 10 with regard to panel type, positioning, and shape.

The luggage bag 300 is similar to the luggage bag 10, but for the differences in the panel configuration, and panel heights. The panels 346 of the luggage bag 300 define similar widths, depths, and thicknesses as the panels 46 of the luggage bag 10. The luggage bag 300 further includes a plurality of handles 370*a*, 370*b*, 370*c*, 370*d*, 370*e*, and 374 similar to the handles of the luggage bag 10.

Referring to FIG. 27A, the luggage bag 300 further comprises a storage pocket 390 located on the front portion 322. The storage pocket 390 is located above the sub panel 347 on the main front panel 346*b*. To facilitate collapsibility of the luggage bag 300, the storage pocket 390 remains within the main front panel 346*b* and does not extend to any adjacent panel. In other words, the storage pocket 390 does not cross over the folds 342, and therefore, does not hinder the collapsibility of the luggage bag 300.

Figure 32:
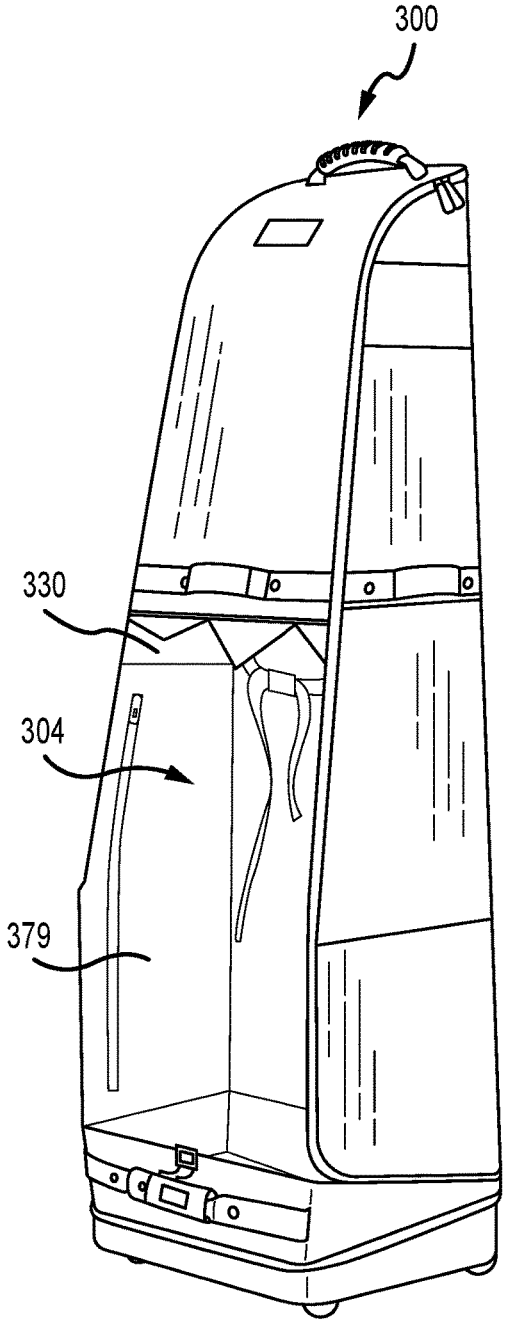
FIG. 32 is a partial view of the collapsible travel luggage bag of FIG. 27A illustrating an inner pocket.
Figure 33:
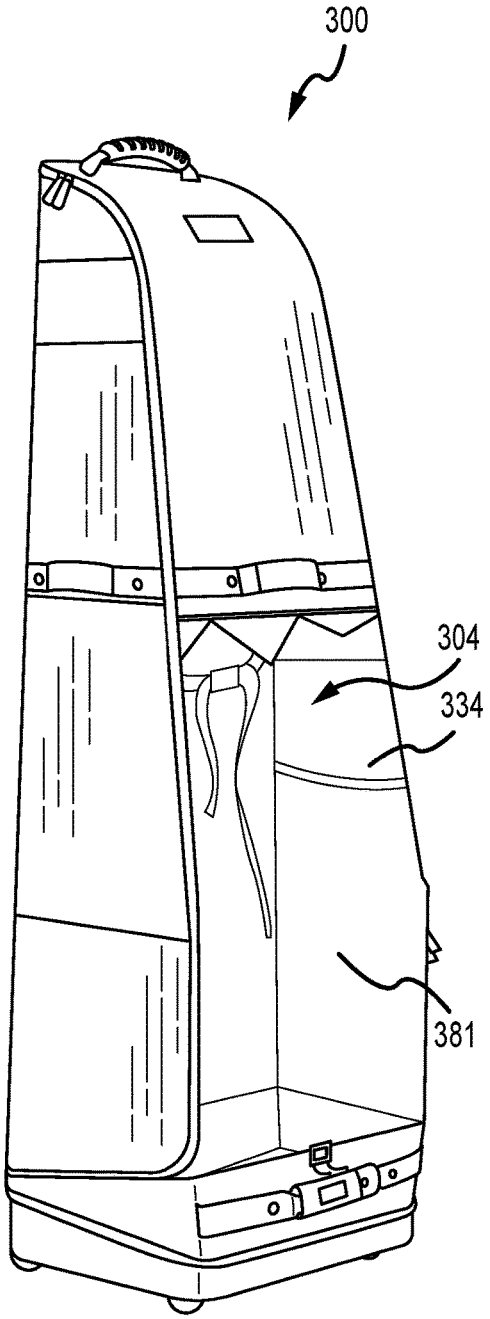
FIG. 33 is a partial view of the collapsible travel luggage bag of FIG. 27A illustrating an inner pocket.

In some embodiments, the luggage bag 300 further comprises one or more inner pockets formed near the interior chamber 304. Referring to FIGS. 32 and 33, the luggage bag 300 can comprise a first inner pocket 379 near the first side portion 330, and a second inner pocket 381 near the second side portion 334. The one or more inner pockets 379, 381 can be formed from mesh or can be zipper pockets. In some embodiments, the one or more inner pockets 379, 381 can extend over the folds 342 such that the inner pockets 379, 381 extend into multiple panel zones 350, as illustrated in FIGS. 32 and 33. In other embodiments, the inner pockets 379, 381 do not extend into multiple panel zones 350, as illustrated in FIG. 29. The inner pockets 379, 381 can be accessed while the luggage bag 300 is in the open configuration.

FIG. 29 illustrates the luggage bag 300 in the opened configuration in which clubs can be stored. Similar to the luggage bag 10, the back portion 326 is integrally formed with the first side portion 330, the second side portion 334, and the base 314. However, in contrast to the luggage bag 10, the first and second side portions 330, 334 are not formed integrally with the base 314. As such, the first side portion 330 defines a first bottom edge 355, and the second side portion defines a second bottom edge 357. The first and second bottom edges 355, 357 each define a portion of the perimeter of the first and second side portions 330, 334, respectively. To open the luggage bag 300, the connection member 398 (see also FIGS. 4A-B) separates the front portion 322 from the first and second side portions 330, 334 and the back portion 326. The connection member 398 further separates the first and second side portions 330, 334 from the base 314. A first portion of the connection member 398 defines a portion of a perimeter of the front portion 322, while a second portion of the connection member 398 defines a portion of a perimeter of the first and second side portions 330, 334, extends along the first and second bottom edges 355, 357. The connection member 398 thus removably connects the front portion 322 to the back, first side, and second side portions 326, 330, 334, and further removably connects the first and second side portions 330, 334 from the base 314. Since the first and second bottom edges 355, 357 are not formed integrally with the base 314, they allow the first and second side portions 330, 334 to open away from the base 314. Similar to the luggage bag 10, the front portion 322 of the luggage bag 300 can be selectively or partially disconnected or disengaged from the back, first side, and second side portions 326, 330, 334 so that a user has various degrees of access to the interior chamber 304.

While the connection mechanism of the front flap 322 is similar to that of the luggage bag 10, the luggage bag 300 includes an improved butterfly opening of the luggage bag 300. Referring again to FIG. 29, the first and second side portions 330, 334 fold or bend to form a flat surface, or second opening access position, in order to provide greater access to the interior chamber 304. With the luggage bag 300 placed with the back portion 326 positioned on a floor or other supporting surface, the connection member 398 can be opened so that the front portion 322 is no longer connected with the back portion 326, the first side portion 330, and the second side portion 334 to expose the interior chamber 304. The connection member can further be opened so that the first and second side portions are no longer connected with the base 314. The first and second side portions 330, 334 are then free to pivot or fold away from each other along the respective folds 342 (or seams) between the side portions 330, 334 and the back portion 326.

In the open configuration, the first and second side portions 330, 334 lie flat in a plane with the back portion 326. This flat, mat-like opening allows for unobstructed insertion of large or bulky items into the interior chamber 304 as there is no lip or other edge structure that would obstruct or otherwise hinder insertion of items into the interior chamber 304. Therefore, the luggage bag 300 provides the maximum allowable access to the interior chamber 304.

Once one or more items are placed into the interior chamber 304, the side portions 330, 334 are pivoted or folded towards each other, and the connection member 398 is reconnected (or closed), securing the first and second side portions 330, 334 to the base, and further securing the front portion 322 to the back, first side, and second side portions 326, 330, 334, thereby closing the interior chamber 304. In many prior art luggage bags, the cover is arranged with a single connection member or a zipper through a middle section. In these embodiments, the user has to maneuver a golf bag through a single, central opening of the luggage bag, and further maneuver the zipper around the golf bag to enclose the interior cavity. The luggage bag 300, however, allows the user to place items on to a flat surface (the flattened back and first and second side portions 326, 330, 334) and to easily reconnect each portion to enclose the interior chamber 304.

The base 314 of the luggage bag 300 is similar to the base 14 of the luggage bag 10. Specifically, the height of the base 314 increases from near the front portion 322 to near the back portion 326. However, the base 314 can be slightly taller near the front portion 322 to facilitate collapsibility, as discussed in more detail below. In some embodiments, the height of the base can be 10 cm, 11 cm, 12 cm, 13 cm, 14 cm, 15 cm, 16 cm, 17 cm, 18 cm, 19 cm, 20 cm, 21 cm, 22 cm, 23 cm, 24 cm, 25 cm, 26 cm, 27 cm, 28 cm, 29 cm, or 30 cm. In one exemplary embodiment, the height of the base 314 is 16.2 cm near the front portion 322.

The luggage bag 300 is collapsible to reduce the storage footprint when not in use. The panels 346 of the cover 318 fold along folds 342, **342*b* allowing the panels 346 to be collapsed toward and received in the base 314. The folds 342 are provided between adjacent or consecutive panels in each of the front, back, first side, and second side portions 322, 326, 330, 334. In addition, folds 342 are provided between panels of each adjacent or consecutive portion 326, 330, 334, such as between adjacent panels in a given panel zone 350**.

FIGS. 31A-31C illustrate the collapsibility of the luggage bag 300. The collapsibility of the luggage bag 300 slightly differs from that of the luggage bag 10. First, the luggage bag 300 does not include an angled fold within the second panel zone **350*b* to facilitate the collapsibility of the first and second side portions 330, 334. Rather, the front portion 322 of the luggage bag 300 further comprises a sub fold 342*b* that allows the sub panel 347 to collapse inward toward the base 314**.

To collapse the luggage bag 300, the connection member 398 is opened such that the front portion 322 is no longer secured to the back, first side, and second side portions 326, 330, 334, and further opened such that the side portions 330, 334 are no longer secured to the base. Referring to FIG. 31A, the front portion 322 is first folded along the sub fold **342*b* such that the sub panel 347 is the first panel received within the base 314. The front portion 322 is further folded along the folds 342 between panels 346, and then received in the base 314. The side portions 330, 334 are folded inwards towards the back portion 326 and received by the base 314. If used, the rails 382 disengage from the rail extensions 386, and the remainder of the cover 318 folds along folds 342 and is partially received in the base 314 (see FIGS. 31A-31C**).

Figure 27B:
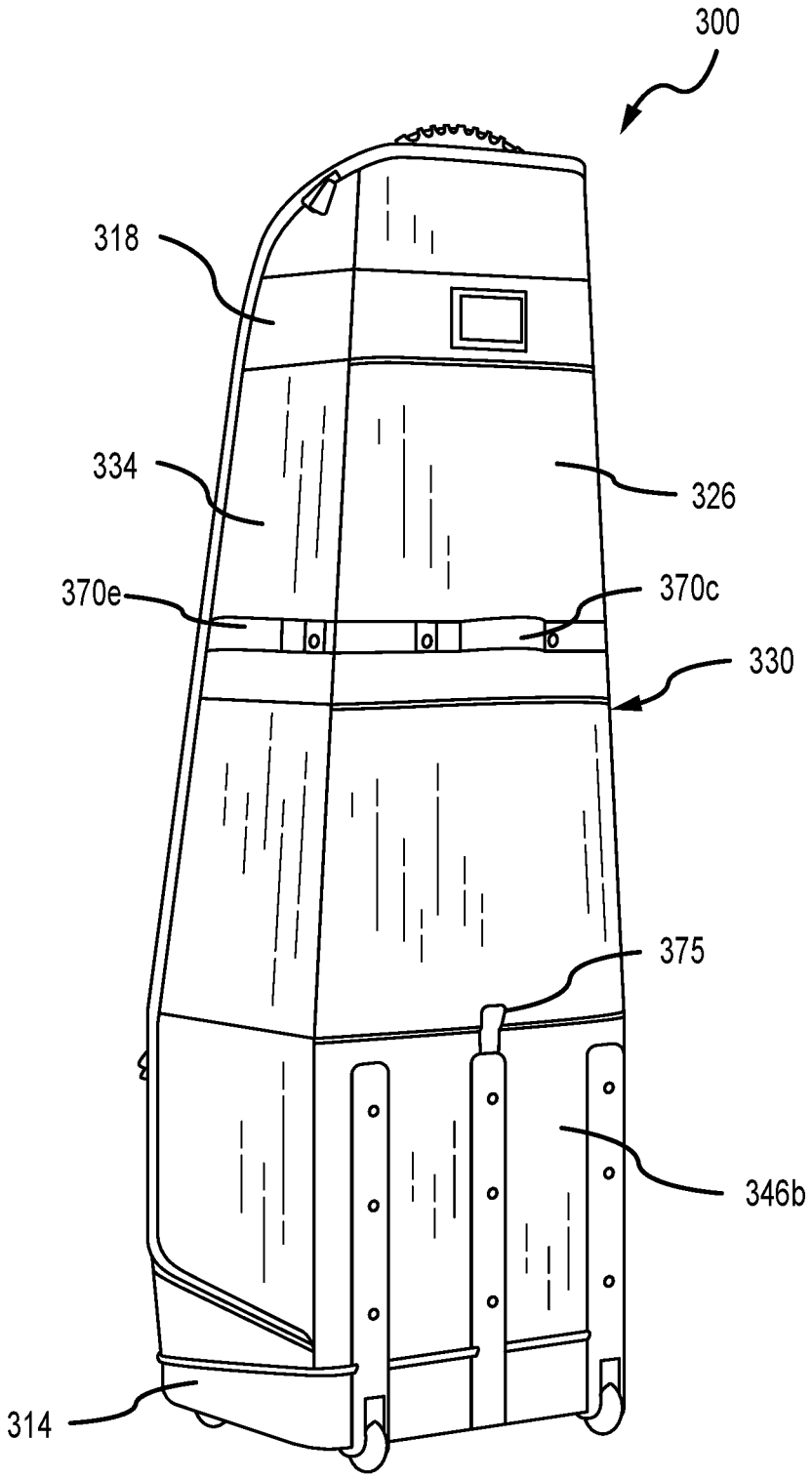
FIG. 27B is a rear perspective view of the collapsible travel luggage bag of FIG. 27A, in an upright position.

The luggage bag 300 utilizes a self-storage function and does not require an additional storage bag to assist in retaining the luggage bag 300 in the collapsed, folded position for orderly storage. Referring to FIG. 30, this self-storage function is facilitated by a clip 371 positioned on the base 314 that is received within a loop 375 positioned on the back portion 326. In the collapsed position, the clip 371 engages the loop 375 to compress the cover 318 into the base 314. The clip 371 is secured to the base via a first strap 373, which is attached to the base 314 near the front of the luggage bag 300. The loop 375 is secured to the back portion 326 via a second strap 377, which is attached to the panel **346*b* near the back portion, as illustrated in FIG. 27B. The first and second straps 373, 377 can be sewn, or otherwise attached to the luggage bag 300. As discussed above, in the collapsed position, the cover 318 is received within the base such that the panel 346*b* near the back portion 326 is exposed to the exterior. As such, in the collapsed position, the loop 375 is proximate the clip 372, thereby allowing the user to easily hook the clip 371 within the loop 375 to compress the cover 318 within the base 314. When the luggage bag 300 is in the collapsed position, the luggage bag 300 is movable along the ground or a supporting surface via the wheels. Therefore, the user can utilize the handle 370*a* easily stow the luggage bag 300** in a low position.

Method of Manufacture

A method of manufacturing the luggage bag 10 includes providing the base 14, and coupling a first wheel **136*a*, a second wheel 136*b*, a third wheel 142*a*, and a fourth wheel 142*b* to the base 14. The method further includes attaching or securing the back, first side, and second side portions 26, 30, 34 to the base 14. In addition, the method includes attaching or securing the front portion 22 to the base 14. The method also includes removably connecting the front portion 22 to the back, first side, and second side portions 26, 30, 34 by the connection member 98**. It should be appreciated that the disclosed method of manufacturing is illustrative, and the method may be completed in any suitable order or sequence of steps. In addition, two or more manufacturing steps may be completed concurrently.

The rolling luggage bag 10 provides advantages over known luggage in the art. Among them, utilizing an improved wheel arrangement of non-swivel wheels 136 combined with swivel wheels 142 that all remain in contact with the floor or other surface when the luggage bag 10 is in the upright position reduces the risk of unintended luggage movement while continuing to allow targeted rolling movement of the luggage bag 10 and reducing its overall weight. In addition, the positioning of the handle 74 also reduces user strain when the luggage bag 10 is rolled in a tilted position. Further, the user has unobstructed access to the interior chamber 102 defined by the luggage bag 10 through a butterfly opening, which additionally facilitates insertion and removal of large and/or bulky items. Moreover, the panels that define the front, back, first side, and second side portions 22, 26, 30, 34 fold along a plurality of folds 42 that separate adjacent panels. By folding, the portions 22, 26, 30, 34 cooperate to collapse into the base 14, reducing the storage footprint of the luggage bag 10 when not in use.

EXAMPLE

Further described herein is a comparison between two luggage bags that utilized different collapsibility mechanisms. The results compared the effects that the panel construction and collapsibility mechanism had on the overall collapsibility of the bag. As discussed above, these variables can determine how much the golf bag is able to collapse for ease of storage.

The control golf bag comprised twenty-two total panels arranged in five panel zones, similar to the luggage bag illustrated in FIGS. 1-6. The panels of the control golf bag were arranged such that the side portions were permanently attached to the base. To open the control bag, the front portion was removed from the side portions, which pivoted or folded away from one another. Since the side portions were connected to the base, the control bag defined a butterfly opening, similar to that shown in FIGS. 8-9. The control bag also included an angled fold to facilitate the collapsibility of the bag. To collapse the control bag, the front portion was removed from the side portions, folded along the folds between each panel, and received within the base. The side portions were then folded along the angled folds towards the base, similar to the luggage bag illustrated in FIG. 17. In the collapsed position, the control bag was 43.8 cm wide, 33.6 cm deep, and 30.5 cm tall. In the upright position, the volume of the interior chamber of the control bag was 0.118 $m^3$.

The exemplary golf bag comprised twenty-one total panels arranged in five panel zones, similar to the luggage bag illustrated in FIGS. 27A-28B. The panels of the exemplary bag were arranged such that the side portions were removable from the base, and the front portion included a sub-panel. To open the exemplary bag, the front portion was removed from the side portions, which folded away from one another. Since the side portions were removable from the base, the exemplary bag defined flat surface, similar to that shown in FIG. 29. To collapse the exemplary bag, the front portion was removed from the side portions, the sub-panel was received within the base, and the remaining panels were folded and received within the base. The side portions were then folded inward toward the back portion and received within the base, similar to the luggage bag illustrated in FIGS. 31A-31C. The exemplary bag included a clip that engaged with a loop to compress the cover into the base, similar to the luggage bag illustrated in FIG. 30. In the collapsed position, the exemplary bag was 43.8 cm wide, 33.6 cm deep, and 21.6 cm tall. In the upright position, the volume of the interior chamber of the control bag was 0.118 $m^3$.

The comparison measured the volume of the interior chamber in the upright position and the volume and height of each golf bag in the collapsed position. The volume of the interior chamber is maximized for each golf bag to ensure that any golf bag can be retained within the interior chamber. The collapsed height and volume of the golf bag determines how easy it is to store the golf bag. The exemplary golf bag exemplified an ease of storage in comparison to the control bag, as discussed in further detail below.

TABLE 1

| | Control Luggage Bag | Exemplary Luggage Bag |
|---|---|---|
| Interior Chamber Volume [$m^3$] | 0.118 | 0.118 |
| Collapsed Height [cm] | 30.5 | 21.6 |
| Collapsed Volume [$cm^3$] | 0.0448 | 0.0317 |

Referring to Table 1, the exemplary golf bag demonstrated improved collapsibility over the control bag. While the bags had a similar interior chamber volume of 0.118 $m^3$ in the upright position, the exemplary bag demonstrated a smaller collapsed volume. Specifically, the control bag had a collapsed volume of 0.0448 $m^3$ and the exemplary bag had a collapsed volume of 0.0317 $m^3$ (29.2% smaller). Additionally, the exemplary bag was 8.9 cm shorter than the control bag in the collapsed position. The reduced height and volume of the exemplary luggage bag allows the bag to be stored more easily than the control bag. The improved performance of the exemplary golf bag was attributed to the panel construction and collapsibility mechanism.

As discussed above, the exemplary bag included side portions, which were fully detachable from the base. The side portions were then able to fully pivot inward toward the back portion before being received within the base. The exemplary bag further included a sub-panel on the front portion to help the front portion fit within the base. Together, the removable side portions and sub-panel optimized the storage capability of the base, resulting in a smaller collapsed height and volume. In contrast, the control bag included side portions that were permanently attached to the base, and the side portions were first folded along an angled fold before being received within the base. These angled folds did not optimize collapsibility, which led to the increase in the collapsed volume.

CLAUSES

Clause 1. A rolling luggage bag comprising: a cover fixedly coupled to a base, the base including a first side opposite a second side and a bottom face extending there between; wherein the cover comprises a plurality of panels, arranged in a direction away from the base, wherein the plurality of panels comprises a first panel zone proximate the base, a second panel zone adjacent the first panel zone in a direction away from the base, a third panel zone adjacent the second panel zone in a direction away from the base, a fourth panel zone adjacent the third panel zone in a direction away from the base, and a fifth panel zone adjacent the fourth panel zone in a direction away from the base; a first wheel and a second wheel coupled to the base, the first and second wheels configured to rotate about an axis of rotation and separated by a first distance along the axis of rotation, at least a portion of each of the first and second wheels projecting from the first side and from the bottom face; a third wheel and a fourth wheel coupled to the bottom face, the third and fourth wheels configured to independently swivel about a respective swivel axis and separated by a second distance extending between the swivel axes; wherein the plurality of panels defines an interior chamber, the interior chamber comprising an internal cover fixedly attached to the panels of the fifth panel zone.

Clause 2. The rolling luggage bag of clause 1, wherein the rolling luggage bag further comprises a plurality of rail members positioned in the second panel zone, and a plurality of rail extensions positioned on the base, wherein when the rolling luggage bag is in the upright position each rail member engages one of the pluralities of rail extensions to form a bumper that extends from the base along a portion of the cover.

Clause 3. The rolling luggage bag of clause 1, wherein the first distance is greater than the second distance.

Clause 4. The rolling luggage bag of clause 1, wherein the rolling luggage bag is configured to be movable along the surface through rotation of the first, second, third, and fourth wheels.

Clause 5. The rolling luggage bag of clause 1, wherein the rolling luggage bag is pivotable about the axis of rotation into a titled position such that the first and second wheels are in rolling contact with the surface, and the third and fourth wheels are removed from rolling contact with the surface, and wherein the rolling luggage bag is movable along the surface in the tilted position.

Clause 6. The rolling luggage bag of clause 1, wherein when the rolling luggage bag is in an upright position, the first, second, third, and fourth wheels all contact a surface the rolling luggage bag stands on.

Clause 7. The rolling luggage bag of clause 1, wherein the panels of the first panel zone are rectangular in shape and the panels of second panel zone are square in shape, wherein the square shape is defined by two separate triangular panels having an angled fold there between.

Clause 8. The rolling luggage bag of clause 1, wherein the panels of the third, fourth, and fifth panel zones are trapezoidal in shape.

Clause 9. The rolling luggage bag of clause 1, wherein the panels of the first panel zone have a greater stiffness than the panels of the second panel zone.

Clause 10. The rolling luggage bag of clause 1, wherein the first panel zone has a first handle on a side of the cover aligned with the first side of the base.

Clause 11. The rolling luggage bag of clause 1, wherein the second panel zone has a storage pocket.

Clause 12. The rolling luggage bag of clause 1, wherein the fourth panel zone has a plurality of second handles.

Clause 13. A collapsible luggage bag comprising: a back portion connected to a first side portion and a second side portion; a front flap removably connected to the first side portion, the second side portion, and the back portion by a connection member; a base connected to the back portion, the first side portion, the second side portion, and the front flap; wherein the base is fixedly connected to the back portion; wherein the back portion, first side portion, second side portion, and front flap comprise a plurality of panels, wherein the plurality of panels comprises a first panel zone proximate the base, a second panel zone adjacent the first panel zone in a direction away from the base, a third panel zone adjacent the second panel zone in a direction away from the base, a fourth panel zone adjacent the third panel zone in a direction away from the base, and a fifth panel zone adjacent the fourth panel zone in a direction away from the base, wherein each of the panel zones extends around a circumference defined by a portion of the back portion, first side portion, second side portion, and the front flap; wherein the second panel zone has a storage pocket, wherein the fourth panel zone has a plurality of second handles, wherein the first and second side portions pivot away from each other about respective folds between the respective side portion and the back portion when the front flap is at least partially removed; a first wheel and a second wheel coupled to the base, the first and second wheels configured to rotate about an axis of rotation and separated by a first distance along the axis of rotation, at least a portion of each of the first and second wheels projecting from the first side and from a bottom face; and a third wheel and a fourth wheel coupled to the bottom face, the third and fourth wheels configured to independently swivel about a respective swivel axis and separated by a second distance extending between the swivel axes; wherein the plurality of panels defines an interior chamber, the interior chamber comprising an internal cover fixedly attached to the panels of the fifth panel zone.

Clause 14. The collapsible luggage bag of clause 13, wherein the rolling luggage bag further comprises a plurality of rail members positioned in the second panel zone, and a plurality of rail extensions positioned on the base, wherein when the rolling luggage bag is in the upright position each rail member engages one of the pluralities of rail extensions to form a bumper that extends from the base along a portion of the cover.

Clause 15. The collapsible luggage bag of clause 13, wherein the second panel zone includes an arcuate portion of the front flap.

Clause 16. The collapsible luggage bag of clause 13, wherein when the rolling luggage bag is in an upright position, the first, second, third, and fourth wheels all contact a surface the rolling luggage bag stands on.

Clause 17. The collapsible luggage bag of clause 13, wherein the panels of the first panel zone are rectangular in shape, the panels of second panel zone are square in shape, wherein the square shape is defined by two separate triangular panels having an angled fold there between, and the panels of the third, fourth, and fifth panel zones are trapezoidal in shape.

Clause 18. The collapsible luggage bag of clause 13, wherein the panels of the first panel zone have a greater stiffness than the panels of the second panel zone.

Clause 19. The collapsible luggage bag of clause 13, wherein the connection member is a zipper, wherein the zipper includes at least two sliders.

Clause 20. The collapsible luggage bag of clause 13, wherein the collapsible luggage bag is pivotable about the axis of rotation into a titled position such that the first and second wheels are in rolling contact with the surface, and the third and fourth wheels are removed from rolling contact with the surface, and wherein the collapsible luggage bag is movable along the surface in the tilted position.

The invention claimed is:

1. A rolling luggage bag comprising:

a cover fixedly coupled to a base, wherein the cover comprises a front portion, a back portion, a first side portion, and a second side portion opposite the first side portion, wherein the front portion, the back portion, the first side portion, and the second side portion are each formed from a plurality of panels, arranged in a direction away from the base and defining a plurality of folds between each of the plurality of panels, wherein;

the front portion is formed integrally with the base and is removably connected to the first side portion, the second side portion, and the base via a connection member;

the first side portion and the second side portions are formed integrally with back portion and are removably connected to the base via the connection member;

the first side portion and the second side portion pivot away from each other about respective folds between the respective side portion and the back portion when the front portion is at least partially removed;

the plurality of panels comprises a first panel zone proximate the base, a second panel zone adjacent the first panel zone in a direction away from the base, a third panel zone adjacent the second panel zone in a direction away from the base, a fourth panel zone adjacent the third panel zone in a direction away from the base, and a fifth panel zone adjacent the fourth panel zone in a direction away from the base;

the plurality of panels defines an interior chamber;

the base comprises a first side opposite a second side and a bottom face extending there between;

a first wheel and a second wheel coupled to the base, the first and second wheels configured to rotate about an axis of rotation and separated by a first distance along the axis of rotation, at least a portion of each of the first and second wheels projecting from the first side and from the bottom face; and a third wheel and a fourth wheel coupled to the bottom face, the third and fourth wheels configured to independently swivel about a respective swivel axis and separated by a second distance extending between the respective swivel axes of the third and fourth wheels.

2. The rolling luggage bag of claim 1, wherein the connection member is a zipper, wherein the zipper includes at least two sliders.

3. The rolling luggage bag of claim 1, wherein the second panel zone comprises a storage pocket.

4. The rolling luggage bag of claim 1, wherein when the first and second side portions pivot away from each other, the first side portion, the second side portion, and the back portion define a flat surface.

5. The rolling luggage bag of claim 1, wherein the rolling luggage bag further comprises a first inner pocket near the first side portion, and a second inner pocket near the second side portion.

6. The rolling luggage bag of claim 1, wherein the first side portion defines a first bottom edge, and the second side portion defines a second bottom edge, and the first bottom edge and the second bottom edge each define a portion of a perimeter of the first and second side portions, respectively.

7. The rolling luggage bag of claim 6, wherein a first portion of the connection member defines a portion of a perimeter of the front portion, and a second portion of the connection member defines a portion of a perimeter of the first and second side portions and extends along the first and second bottom edges.

8. The rolling luggage bag of claim 1, wherein the rolling luggage bag further comprises a plurality of rail members positioned in the second panel zone, and a plurality of rail extensions positioned on the base, wherein when the rolling luggage bag is in an upright position each rail member engages one of the plurality of rail extensions to form a bumper that extends from the base along a portion of the cover.

9. The rolling luggage bag of claim 1, wherein the rolling luggage bag is pivotable about the axis of rotation into a titled position such that the first and second wheels are in rolling contact with a surface, and the third and fourth wheels are removed from rolling contact with the surface, and wherein the rolling luggage bag is movable along the surface in a tilted position.

10. The rolling luggage bag of claim 1, wherein when the rolling luggage bag is in an upright position, the first, second, third, and fourth wheels all contact a surface the rolling luggage bag stands on.

11. The rolling luggage bag of claim 1, wherein the panels of the second panel zone are trapezoidal in shape.

12. The rolling luggage bag of claim 1, wherein the panels of the first panel zone have a greater stiffness than the panels of the second panel zone.

13. A collapsible luggage bag comprising:

a cover fixedly coupled to a base, wherein the cover comprises a front portion, a back portion, a first side portion, and a second side portion opposite the first side portion, wherein the front portion, the back portion, the first side portion, and the second side portion are each formed from a plurality of panels, arranged in a direction away from the base and defining a plurality of folds between each of the plurality of panels, wherein;

the front portion is formed integrally with the base and is removably connected to the first side portion, the second side portion, and the base via a connection member;

the first side portion and the second side portions are formed integrally with back portion and are removably connected to the base via the connection member;

the first side portion and the second side portion pivot away from each other about respective folds between the respective side portion and the back portion when the front portion is at least partially removed;

the plurality of panels comprises a first panel zone proximate the base, a second panel zone adjacent the first panel zone in a direction away from the base, a third panel zone adjacent the second panel zone in a direction away from the base, a fourth panel zone adjacent the third panel zone in a direction away from the base, and a fifth panel zone adjacent the fourth panel zone in a direction away from the base;

the plurality of panels defines an interior chamber;

wherein the front portion of the second panel zone comprises a main front panel and a sub panel;

wherein a height of the sub panel is similar to a height of the base near the front portion;

the base comprises a first side opposite a second side and a bottom face extending there between;

a first wheel and a second wheel coupled to the base, the first and second wheels configured to rotate about an axis of rotation and separated by a first distance along the axis of rotation, at least a portion of each of the first and second wheels projecting from the first side and from the bottom face; and a third wheel and a fourth wheel coupled to the bottom face, the third and fourth wheels configured to independently swivel about a respective swivel axis and separated by a second distance extending between respective the swivel axes of the third and fourth wheels.

14. The collapsible luggage bag of claim 13, wherein the connection member is a zipper, wherein the zipper includes at least two sliders.

15. The collapsible luggage bag of claim 13, wherein the second panel zone comprises a storage pocket.

16. The collapsible luggage bag of claim 13, wherein the panels of the second panel zone are trapezoidal in shape.

17. The collapsible luggage bag of claim 13, wherein when the first and second side portions pivot away from each other, the first side portion, second side portion, and back portion define a flat surface.

18. The collapsible luggage bag of claim 13, wherein the collapsible luggage bag further comprises a plurality of rail members positioned in the second panel zone, and a plurality of rail extensions positioned on the base, wherein when the collapsible luggage bag is in an upright position, each rail member engages one of the plurality of rail extensions to form a bumper that extends from the base along a portion of the cover.

19. The collapsible luggage bag of claim 13, wherein the collapsible luggage bag is pivotable about the axis of rotation into a titled position such that the first and second wheels are in rolling contact with a surface, and the third and fourth wheels are removed from rolling contact with the surface, and wherein the collapsible luggage bag is movable along the surface in a tilted position.

20. The collapsible luggage bag of claim 13, wherein when the collapsible luggage bag is in an upright position, the first, second, third, and fourth wheels all contact a surface the collapsible luggage bag stands on.

* * * * *